US006638129B2

(12) United States Patent
Sano et al.

(10) Patent No.: US 6,638,129 B2
(45) Date of Patent: Oct. 28, 2003

(54) SURFACE DISCHARGE TYPE PLASMA DISPLAY PANEL WITH INTERSECTING BARRIER RIBS

(75) Inventors: Ko Sano, Tokyo (JP); Kanzou Yoshikawa, Tokyo (JP); Takeo Saikatsu, Tokyo (JP); Takao Yasue, Tokyo (JP); Toyohiro Uchiumi, Tokyo (JP)

(73) Assignee: Mitsubishi Denki Kabushiki, Tokyo (JP)

( * ) Notice: Subject to any disclaimer, the term of this patent is extended or adjusted under 35 U.S.C. 154(b) by 0 days.

(21) Appl. No.: 09/846,314

(22) Filed: May 2, 2001

(65) Prior Publication Data

US 2001/0026255 A1 Oct. 4, 2001

Related U.S. Application Data

(62) Division of application No. 09/116,950, filed on Jul. 17, 1998, now Pat. No. 6,249,264.

(30) Foreign Application Priority Data

Jan. 27, 1998 (JP) ..... 10-014380

(51) Int. Cl.[7] ..... H01J 9/24
(52) U.S. Cl. ..... 445/24
(58) Field of Search ..... 445/24; 313/582, 313/584, 586, 587

(56) References Cited

U.S. PATENT DOCUMENTS

| | | | | |
|---|---|---|---|---|
| 5,661,550 A | 8/1997 | Ko | ..... | 399/45 |
| 5,967,872 A | 10/1999 | Betsui et al. | ..... | 445/24 |
| 6,008,582 A | 12/1999 | Asano et al. | | |
| 6,380,678 B1 * | 4/2002 | Kim | ..... | 313/582 |
| 6,400,081 B1 * | 6/2002 | Matsumoto et al. | ..... | 313/292 |

FOREIGN PATENT DOCUMENTS

| | | |
|---|---|---|
| EP | 704834 | 4/1996 |
| JP | 31421 | 1/1991 |
| JP | 3112035 | 5/1991 |
| JP | 990900 | 4/1997 |
| JP | 2770847 | 4/1998 |
| JP | 2776309 | 5/1998 |
| JP | 2814557 | 8/1998 |
| JP | 2845183 | 10/1998 |
| JP | 2964512 | 8/1999 |

OTHER PUBLICATIONS

Fujii et al., "A Sandblast–Processed Color–PDP Phosphor Screen," Dai Nippon Printing Co., Ltd., Central Research Institute (1992), IDY92–22, pp. 33–36, (with English translation, 6 pages).

Wani, Koichi, "Color DC Plasma Displays," Matsushita Electronics Corporation, Takatusuki Osaka 569–11, Japan, IDW'95, PDP–2, pp. 33–36.

* cited by examiner

*Primary Examiner*—Kenneth J. Ramsey
(74) *Attorney, Agent, or Firm*—Birch, Stewart, Kolasch & Birch, LLP

(57) ABSTRACT

Barrier ribs of the second type (50) of the same height and material as barrier ribs of the first type (29) are formed on a second substrate in parallel with each other along a first direction (D1) to which display electrodes XE and YE extend. Further, phosphors (28) adhere to both side surface portions (50W3 and 50W4) of the barrier ribs of the second type (50). This achieves a surface discharge type PDP capable of reducing a loss of ultraviolet rays due to repetition of the self absorption and emission of ultraviolet rays, and preventing the leakage of luminescence and discharge to adjacent display lines.

12 Claims, 55 Drawing Sheets

F I G. 4 8
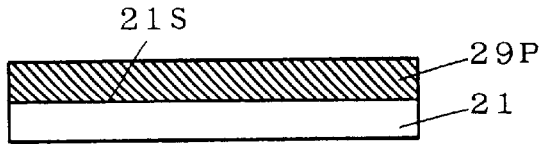
F 9 I G. 4 9
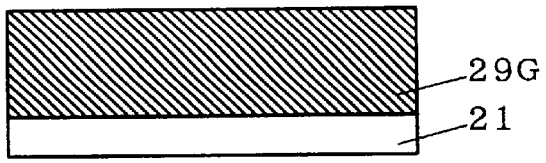
F I G. 5 0 A
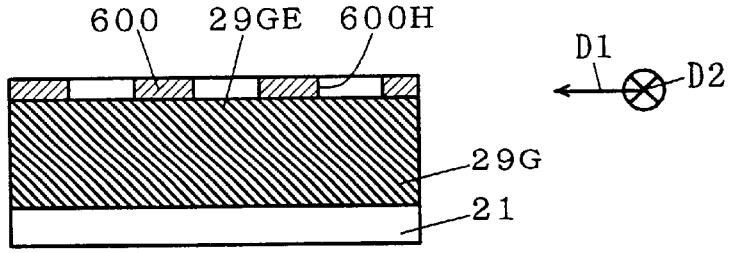
F I G. 5 0 B
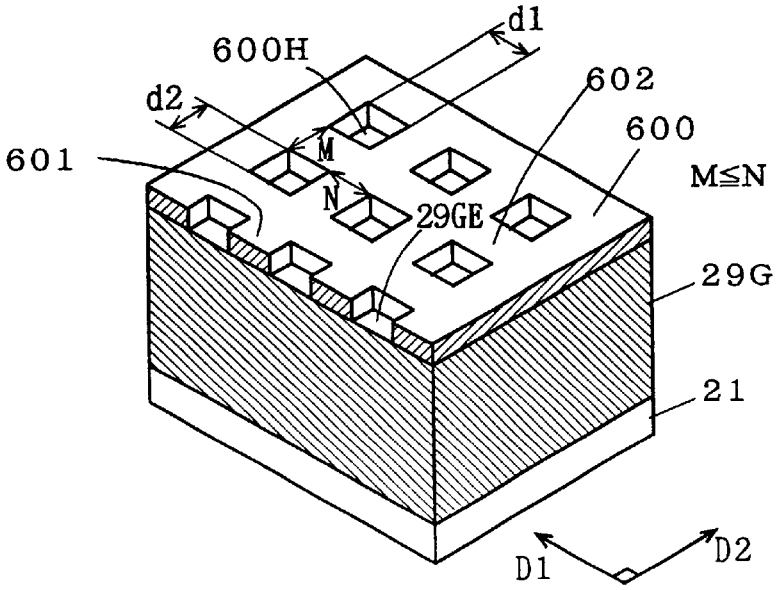

1C

SURFACE DISCHARGE TYPE PLASMA DISPLAY PANEL WITH INTERSECTING BARRIER RIBS

This application is a division of Ser. No. 09/116,950, filed on Jul. 17, 1998, now U.S. Pat. No. 6,249,264.

BACKGROUND OF THE INVENTION

1. Field of the Invention

The present invention relates to a surface discharge type plasma display panel and its manufacturing method, and a surface discharge type plasma display device. Especially, the present invention is directed to a structure of barrier ribs and a technique for forming the barrier ribs.

2. Background of the Invention

FIG. 60 is a block diagram showing a plasma display panel device , for example, as disclosed in FIG. 1 of Japanese Patent Laid-Open Gazette P5-307935A or in FIG. 14 of U. S. Pat. No. 5,661,500. In FIG. 60, the reference character 100P indicates a plasma display device; 1P indicates a plasma display panel (hereinafter referred to as a PDP) including X and Y display electrodes (hereinafter referred to as X and Y electrodes, respectively) and an address electrode (hereinafter referred to as an A electrode); 110P indicates a scan control portion; 120P indicates an A/D converter for converting an input signal from analog to digital (hereinafter referred to as an A/D); 130P indicates a frame memory for storing an output of the A/D 120P; 141P indicates an X-electrode driving circuit for providing a driving signal to the X electrode of the PDP 1P; 142P indicates a Y-electrode driving circuit for providing a driving signal to the Y electrode of the PDP 1P; 143P indicates an A-electrode driving circuit for providing a driving signal to the A electrode of the PDP 1P. The reference character 2P indicates a drive control system consisting of the A/D 120P, the frame memory 130P, the scan control portion 1110P, the X-electrode driving circuit 141P, the Y-electrode driving circuit 142P, and ace A-electrode driving circuit 143P FIG. 61 is a perspective view showing the outline of a sectional structure of the conventional PDP 1P, for example, as disclosed in FIG. 3 of Japanese Patent Laid-Open Gazette No. P5-299019A or in FIG. 2 of U.S. Pat. No. 5,661,500. In FIG. 61, the reference numeral 211 indicates a first substrate which is a front substrate; 217 indicates a dielectric layer covering the X and Y electrodes; 218 indicates a protective layer formed of MgO or the like, for covering the surface of the dielectric layer 217; 222 indicates an A electrode extending along a second direction orthogonal to a first direction which will be described later; 221 indicates a second substrate which is a rear substrate; 228 indicates a phosphor formed in stripes along side walls of barrier ribs 229 which will be described later, without interruption; 229 indicates a barrier rib formed in parallel along the second direction on the second substrate 221 and separated from each other, and 230 indicates a discharge space filled with discharge gas (Penning gas) including Xe atoms for emitting ultraviolet rays to be absorbed into the phosphors 228. Further, 241 indicates a strip transparent conductive film consisting of a tin oxide film or the like, and extending in parallel along the first direction at a predetermined interval (discharge gap) so as to constitute X and Y electrodes XEP and YEP; and 242 indicates a strip metal film for supplementing conductivity of the strip transparent conductive film 241, consisting of multiple films such as Cr—Cu—Cr or Cr—Al—Cr. Each of the X and Y electrodes XEP and YEP consists of the strip transparent conductive film 241 and the strip metal film 242 added to the strip transparent conductive film 241. The reference character EGP indicates one pixel consisting of three unit luminescent areas EUP emitting red light (R), green light (G), and blue light (B), respectively, (indicated by $EUP_R$, $EUP_G$, $EUP_B$, respectively, in FIG. 61) for a color display device. The reference character SP indicates a display surface.

Next, operation of the conventional plasma display device 100P will be described. The plasma display device 100P consists of the PDP 1P, and the drive control system 2P electrically connected to the X, Y, and A electrodes of the PDP 1P via a flexible printed circuit board (not shown).

In the drive control system 2P, an input signal VINP for providing image data is first converted from analog to digital by the A/D 120P, and digital data outputted from the A/D 120P is stored into the frame memory 130P. Then, the scan control portion 110P accesses the digital image signals stored in the frame memory 130P, and on the basis of the signals, outputs various control signals for controlling drive of the X-electrode driving circuit 141P, the Y-electrode driving circuit 142P, and the A-electrode driving circuit 143P to the corresponding circuits 141P to 143P, respectively. Upon receipt of the control signals, the driving circuits 141P to 143P apply driving pulse signals such as priming pulses, write pulses, or discharge sustain pulses to their corresponding electrodes, which drives the PDP 1P.

The PDP 1P is a three-electrode, surface discharge type PDP where a pair of display electrodes (the X and Y electrodes XEP and YEP) and the A electrode 222 correspond to the unit luminescent areas EU, respectively. Each of the X and Y electrodes XEP and YEP consists of the strip transparent conductive film 241 and the strip metal film 242, and it is arranged on the inside surface of the first substrate 211 on the side of the display surface SP.

On the other hand, the barrier ribs 229 are provided in strips on the second substrate 211. A height h of the barrier ribs 229 specifies a height of the dicharge space 230. The discharge space 230 is sectioned per unit luminescent area EUP along an extending direction of the X and Y electrodes XEP and YEP, that is, along the first direction.

On the inside surface of the second substrate 221 between the adjacent barrier ribs 229 formed in parallel with each other, the A electrodes 222 of a predetermined width are arranged by printing and firing a pattern of a silver paste. Further, except where the barrier ribs 229 are in contact with the protective layer 218 and its vicinity, the phosphors 228 emitting red light R, green light G, blue light B, respectively are provided so as to cover the inside surface of the second substrate 221.

Accordingly, in the PDP 1P, the continuous stripe phosphors 228 are provided almost on the whole inside surface of the second substrate 221 including both side surfaces of the barrier ribs 229 and the surface of the A electrodes 222.

Further, in some cases, a layer (black stripe) using a low melting point glass with a black pigment added, for example, may be provided on the inside surface of the first substrate 211 in order to prevent deterioration in image contrast due to extraneous light entering from outside through the first substrate 211 forming the display surface SP.

The aforementioned conventional technique, however, contains some problems. For easy understanding of one of those problems, a logic of phenomena of the discharge and the propagation of ultraviolet rays will be described schematically with reference to FIG. 62.

On occurrence of discharge (especially display discharge) between the X and Y electrodes, Xe atoms included In discharge gas are excited and emit 147 nm ultraviolet rays. This emission of ultraviolet rays occurs when Xe atoms of resonance level return to their ground level, accompanied with what is called "self absorption". The "self absorption" is a phenomenon that the ultraviolet rays once emitted from the Xe atoms are absorbed by different Xe atoms being at a ground level, and the different Xe atoms are excited.

These excited different Xe atoms will also emit ultraviolet rays of the same wavelength when returning to their ground level. By repeating the self absorption and the emission of ultraviolet rays in this way, the 147 nm ultraviolet rays propagate and diffuse at random within the discharge space. FIGS. 62A and 62B schematically show this self absorption of ultraviolet rays.

Since the ultraviolet rays propagate and diffuse within the discharge space as described above, the expansion of ultraviolet rays due to the gas discharge between the X and Y electrodes far more reaches than both physical widths of the X and Y electrodes. FIG. 63A schematically shows the expansion of ultraviolet rays when gas discharge occurs between any X and Y electrodes XEP and YEP located in an upper portion of the space which extends along the second direction and is surrounded by the adjacent barrier ribs 229, the phosphors 228, and the protective layer 218 as described above. Further, FIG. 63B schematically shows luminance on the side of the first substrate 211 at that time, where the horizontal axis indicates a distance from the center of discharge gap (substantially corresponding to the center of a display line D).

The discharge between the X and Y electrodes XEP and YEP generates ultraviolet rays as described above, and the ultraviolet rays are propagated and diffused by the self absorption and emission- In this case, since the adjacent barrier ribs 229 are in parallel with each other as shown in FIG. 61, the occurrence of the gas discharge is spatially limited only in the second direction along the A electrode 222. Thus, as schematically shown in FIG. 63B, the distribution of luminance extends along the second direction. The metal electrodes 242, however, do not transmit light from the phosphors 228, so that the display light can not propagate to an area positioned right over the metal electrodes 242. Thus, the distribution of luminance to be observed breaks at positions corresponding to places where the metal electrodes 242 are formed.

A correlation between gas discharge and luminescence state will be further described with reference to FIG. 64. FIG. 64 is a plan view schematically showing the positioning of each unit luminescent area EUP, the barrier ribs 229, and the phosphors 228. In FIG. 64, the phosphors emitting red light R, green light G, and blue light B are denoted by the reference characters 228R, 228G, and 228B, respectively.

As shown in FIGS. 63A and 63B, on the occurrence of the gas discharge between the X and Y electrodes XEP and YEP, the Xe atoms included in the discharge gas are excited and emit ultraviolet rays. The ultraviolet rays are incident on the facing phosphors 228, which causes luminescence (generation of visible light) from the phosphors 228. The phosphors 228 themselves are almost white against the visible light, so that the visible light is hardly absorbed by the phosphors 228. Thus, luminescence emitted from the phosphors 228 is reflected on the surface of the phosphors 228. The barrier ribs 229 also consist of materials for reflecting luminescence. The emitted luminescence does not leak into the unit luminescent areas EUP adjacent to each other with respect to the first direction D1 and emitting luminescence of different colors, because the phosphors 228 are provided in generally U-shaped consecutive stripes along the second direction D2 and the adjacent barrier ribs 229 extending along the first direction D1 prevents the phosphors 228 from emitting in the first direction D1. However, the emitted visible light reflects on the surface of the phosphors 228, and consequently leaks into the unit luminescent areas EUP adjacent to each other with respect to the second direction D. and emitting luminescence of the same color as shown in FIG. 64, because only the generally U-shaped consecutive stripe phosphors 228 of white color exist in the way along the second direction D2. In FIG. 64, the hatched blocks show the propagation region of luminescence emitted from each unit luminescent area.

In this manner, the leakage of luminescence may color a pixel to be generally white, for example, by red because of red light leaked from the adjacent unit luminescent area EUP of the adjacent pixel. Namely, the leakage of luminescence from a pixel of the next line to a pixel of the previous line gives an adverse effect on the pixel of the previous line.

As described above, a conventional display device involves some problems due to the propagation and diffusion of ultraviolet rays:

Conventional Problem (1): While the self absorption and emission of ultraviolet rays are repeated, the excited Xe atoms may be ionized. In this case, a loss increases with the number of repetitions, which deteriorates luminous efficiency.

Conventional Problem (2): The ultraviolet rays may be absorbed by the protective layer 218 in the course of the phenomenon of the self absorption and emission of ultraviolet rays occurring along the barrier ribs 229 to thereby cause loss of ultraviolet rays. In this case, loss increases with increasing traveling distance of the phenomenon, which deteriorates luminous efficiency The aforementioned conventional problems (1) and (2) are raised of the aspect of luminous efficiency. Further, from the viewpoint of the leakage of luminescence as described with reference to FIG. 64, the following other problems are presented.

Conventional Problem (3): Between pixels EG adjacent to each other with regard to the second direction D2, luminescence generated at each adjacent display line leaks into its adjacent unit luminescent area EUP of the same color This leakage of luminescence makes it difficult to hold a required pixel dimension and to achieve image display with required luminance at each of adjacent display lines, especially affecting color balance of a combination of primary colors to be used in a s standard color display.

Further, another problem comes up in manufacturing a high-resolution plasma display device so as to keep up with th e increase in pixel density.

Conventional Problem (4): When luminescence occurring at each unit luminescent area EUP extends over different unit luminescent areas of adjacent pixels as shown in FIG. 64, as a space between the adjacent display lines decreases, leakage of discharge tends to occur between the display lines (hereinafter referred to as discharge between cells) as schematically shown by circles with hatching in FIG. 65. This changes a stock of wall charges between cells where gas discharge occurred from its original state, hindering display operation. Further, unnecessary discharge may be caused or no display discharge may not be induced by the leakage of discharge associated with the achievement of high resolution.

Such influence of discharge between cells increases as increasing applied voltage in display operation or decreasing pitch between electrodes, which presents an obstacle to the increase in pixel density of PDP1.

SUMMARY OF THE INVENTION

A first aspect of the present invention is directed to a surface discharge type plasma display panel comprising: a first substrate; a second substrate facing the first substrate in parallel, which provides a plurality of discharge spaces filled with discharge gas therebetween; a dielectric which is arranged on an opposing surface of the first substrate to the second substrate, abuts on the plurality of discharge spaces, and has a surface storing first and second wall charges in accordance with each of the plurality of discharge spaces; a plurality of barrier ribs of a first type which are arranged in parallel with each other on an opposing surface of the second substrate to the first substrate and has portions which reflect light of a visible-light area, each of the plurality of barrier ribs of the first type comprising a first side surface portion, a second side surface portion opposite to the first side surface portion, and a first top portion led to the first and second side surface portions; a barrier rib of a second type arranged on the opposing surface of the second substrate and intersecting with the plurality of barrier ribs of the first type; and phosphors provided on the opposing surface of the second substrate sandwitched between adjacent barrier ribs out of the plurality of barrier ribs of the first type, on the first side surface portion of one of the adjacent barrier ribs of the first type, and on the second side surface portion of the other of the adjacent barrier ribs of the first type, the phosphors emitting visible light in accordance with ultraviolet rays caused by discharge between the first and second wall charges.

Preferably, in the surface discharge type plasma display panel according to a second aspect of the present invention, the barrier rib of the second type has a portion which reflects the light of the visible-light area.

Preferably, in the surface discharge type plasma display panel according to a third aspect of the present invention, the barrier rib of the second type comprises: a third side surface portion; a fourth side surface portion opposite to the third side surface portion; and a second top portion led to the third and fourth side surface portions. The phosphors are further provided on the third and fourth side surface portions of the barrier rib of the second type.

Preferably, in the surface discharge type plasma display panel according to a fourth aspect of the present invention, the first top portion of each of the plurality of barrier ribs of the first type is in contact with the dielectric; and the plurality of barrier ribs of the first type has a first height from the second substrate to the first top portion which is almost equal to a second height from the second substrate to the second top portion of the barrier rib of the second type.

Preferably, in the surface discharge type plasma display panel according to a fifth aspect of the present invention, the first top portion of each of the plurality of barrier ribs of the first type is in contact with the dielectric; and a second height from the second substrate to the second top portion of the barrier rib of the second type is smaller than a first height from the second substrate to the first top portion of each of the plurality of barrier ribs of the first type.

Preferably, in the surface discharge type plasma display panel according to a sixth aspect of the present invention, the phosphors are further provided on the second top portion of the barrier rib of the second type.

Preferably, in the surface discharge type plasma display panel according to a seventh aspect of the present invention, the second height is set on the basis of a correlation between luminance of display light emitted from the first substrate to the outside, and an exhaust conductance corresponding to a flow path of gas specified by the adjacent barrier ribs of the first type, the second top portion of the barrier rib of the second type, and the dielectric.

Preferably, in the surface discharge type plasma display panel according to an eighth aspect of the present invention, if a shape factor $\beta$ determining the exhaust conductance is found by: $\beta=(a\cdot b)^2/((a+b)\cdot L)$, the shape factor $\beta$ satisfies an inequality as follows: $1.5\ E{-4}\ mm^2 \leqq \beta < (Hmain-b)^2/((Hmain+b)\cdot L)$, where Hmain and Hsub are the first and second heights, respectively; L is a width of the barrier rib of the second type; b is a length of a first side of a quadrangle having the maximum area out of quadrangles inscribed in the flow path, on the side of the second top portion; and a is a length of a second side orthogonal to the first side, which is found by (Hmain−Hsub).

Preferably, in the surface discharge type plasma display panel according to a ninth aspect of the present invention, the second height is set on the basis of the minimum priming voltage at which priming discharge occur in all of the plurality of discharge spaces.

Preferably, in the surface discharge type plasma display panel according to a tenth aspect of the present invention, a discharge shape factor K is not less than 0.03 $\mu$m/Torr, if the discharge shape factor K is found by $K=(a\cdot b)/(p\cdot L)$, where L is a width of the barrier rib of the second type; a is a difference of height found by (Hmain−Hsub) where Hmain and Hsub are the first and second heights, respectively; b is a gap between the first side surface portion of the one of the adjacent barrier ribs of the first type and the second side surface portion of the other of the adjacent barrier ribs of the first type; and p is pressure of the discharge gas.

Preferably, the surface discharge type plasma display panel according to an eleventh aspect of the present invention further comprises: a plurality of pairs of electrodes each consisting essentially of first and second display electrodes extending in parallel with each other along a first direction on the opposing surface of the first substrate and constituting a corresponding one of display lines, said plurality of pairs of electrodes covered by the dielectric. In the panel, the second substrate comprises a plurality of address electrodes each extending along a second direction orthogonal to the first direction and located between the adjacent barrier ribs of the first type; each of the plurality of discharge spaces is specified by a pair of electrodes out of the plurality of pairs of electrodes, and an address electrode arranged so as to be orthogonal to the pair of electrodes out of the plurality of address electrodes; each of the first and second display electrodes comprises a strip transparent conductive film, and a metal electrode provided on an area of an opposing surface of the strip transparent conductive film to the plurality of discharge spaces on the side of an adjacent display line out of the display lines; the barrier rib of the second type extends along the first direction; each of the plurality of barrier ribs of the first type extends along the second direction; the barrier rib of the second type is provided on a first area of the opposing surface of the second substrate, the first area facing the metal electrode of the first display electrode corresponding to a discharge space isolated from its adjacent discharge space by the barrier rib of the second type, out of the plurality of discharge spaces; and the third surface portion of the barrier rib of the second type is provided on a second area of the opposing surface of the second substrate, the second area facing the strip transparent conductive film of the first display electrode except where the metal electrode is formed.

Preferably, in the surface discharge type plasma display panel according to a twelfth aspect of the present invention, the barrier rib of the second type is provided on a third area of the opposing surface of the second substrate, the third area facing the metal electrode of the second display electrode corresponding to the adjacent discharge space; and the fourth side surface portion of the barrier rib of the second type is provided on a fourth area of the opposing surface of the second substrate, the fourth area facing the strip transparent conductive film of the second display electrode except where the metal electrode is formed.

Preferably, the surface discharge type plasma display panel according to a thirteenth aspect of the present invention, further comprises: a second barrier fib of the second type formed in parallel with the barrier rib of the second type, between the jth unit luminescent area corresponding to the jth discharge space counted from the ith unit luminescent area along the opposed first and second side surface portions, and the (j+1)th unit luminescent area corresponding to the (j+1)th discharge space, on the opposing surface of the second substrate, where the ith unit luminescent area is an unit luminescent area corresponding to any one of the plurality of discharge spaces sandwitched between the adjacent barrier ribs of the first type and isolated by the barrier rib of the second type.

Preferably, in the surface discharge type plasma display panel, according to a fourteenth aspect of the present invention, the phosphors are further provided on both side surface portions of the second barrier rib of the second type.

Preferably, the surface discharge type plasma display panel according to a fifteenth aspect of the present invention, further comprises a plurality of pairs of electrodes each consisting essentially of the first and second display electrodes extending in parallel with each other along a first direction on the opposing surface of the first substrate and constituting a corresponding one of display lines, said plurality of pairs of electrodes covered by the dielectric. In the panel, the second substrate comprises a plurality of address electrodes each extending along a second direction orthogonal to the first direction and located between the adjacent barrier ribs of the first type; each of the plurality of discharge spaces is specified by intersection of the plurality of pairs of electrodes and the plurality of address electrodes; the barrier rib of the second type has a plurality of barrier ribs; the plurality of barrier ribs extend along the first direction; each of the plurality of barrier ribs of the first type extends along the second direction; and each of the plurality of barrier ribs is provided for each of the plurality of discharge spaces.

Preferably, in the surface discharge type plasma display panel according to a sixteenth aspect of the present invention, the second substrate comprises a plurality of address electrodes each extending along a second direction and located between the adjacent barrier ribs of the first type; and the jth unit luminescent area corresponds to the (i+1)th unit luminescent area. The ith and (i+1)th unit luminescent areas are specified by: (a) a first display electrode, common to the ith and (i+1)th unit luminescent areas, extending along a first direction orthogonal to the second direction on the opposing surface of the first substrate, extending over the ith and (i+1)th unit luminescent areas, and covered by the dielectric; (b) a second display electrode extending across the ith unit luminescent area along the first direction on the opposing surface of the first substrate and covered by the dielectric, which constitutes one display line in pair with the first display electrode; (c) another second display electrode extending across the (i+1)th unit luminescent area along the first direction on the opposing surface of the first substrate and covered by the dielectric, which constitutes another display line in pair with the first display electrode; and (d) the plurality of address electrodes. Further, the barrier rib and second barrier rib of the second type both extend along the first direction; and each of the plurality of barrier ribs of the first type extends along the second direction.

Preferably, the surface discharge type plasma display panel according to a seventeenth aspect of the present invention, further comprises: a third barrier rib of the second type provided between the ith and (i+1)th unit luminescent areas on the opposing surface of the second substrate, wherein the phosphors are further provided on both side surface portions of the third barrier rib of the second type.

An eighteenth aspect of the present invention is directed to a plasma display device comprising: a first substrate: a second substrate facing the first substrate in parallel, which provides a plurality of discharge spaces filled with discharge gas therebetween; a plurality of pairs of electrodes each consisting essentially of first and second electrodes which extend in parallel with each other along a first direction on an opposing surface of the first substrate to the second substrate; a dielectric which is formed on the opposing surface of the first substrate, covers the plurality of pairs of electrodes, and has a surface storing first and second wall charges in accordance with each of the plurality of discharge spaces; a plurality of barrier ribs of a second type extending in parallel with each other along the first direction on an opposing surface of the second substrate to the first substrate; and a plurality of barrier ribs of a first type extending in parallel with each other along a second direction orthogonal to the first direction on the opposing surface of the second substrate to the first substrate, the plurality of barrier ribs of the first type intersecting with the plurality of barrier ribs of the second type; a plurality of phosphors each provided on an area of the opposing surface of the second substrate surrounded by adjacent barrier ribs of the plurality of barrier ribs of the first type and by adjacent barrier ribs of the second type, and on opposed side surface portions of at least one out of both of the adjacent barrier ribs of the first type and the adjacent barrier ribs of the second type, each of the plurality of phosphors having portions emitting visible light in accordance with ultraviolet rays caused by discharge between the first and second wall charges stored in the surface of the dielectric. In the device, the second substrate comprises a plurality of third electrodes extending in parallel with each other along the second direction and located between the adjacent barrier fibs of the first type, and each of the plurality of discharge spaces is specified by a pair of electrodes of the plurality of pairs of electrodes, and a third electrode orthogonal to the pair of electrode out of the plurality of third electrodes. The plasma display device further comprises: a drive control circuit having a plurality of drivers each connected to the first and second electrodes of the plurality of pairs of electrodes, and the plurality of third electrodes, and each generating and outputting a driving signal to be applied to its corresponding electrode.

A nineteenth aspect of the present invention is directed to a method of manufacturing a surface discharge type plasma display panel comprising steps of: (a) providing a second substrate which specifies a plurality of discharge spaces filled with discharge gas with a first substrate, and comprises a plurality of address electrodes extending along a second direction, and; (b) on the second substrate, forming a plurality of barrier ribs of a first type extending in parallel with each other at first intervals along the second direction so that each of the plurality of address electrodes is located between adjacent barrier ribs out of the plurality of barrier ribs of the first type, and a plurality of barrier ribs of a second type extending in parallel with each other at second intervals along a first direction orthogonal to the second direction so as to intersect with the plurality of barrier ribs of the first type; (c) adhering phosphors to an area of the second substrate sandwitched between adjacent barrier ribs out of the plurality of barrier ribs of the first type, a first side surface portion of one of the adjacent barrier ribs of the first type, and a second side surface portion of the other of the adjacent barrier ribs of the first type facing to the first side surface portion.

Preferably, in the method of manufacturing a surface discharge type plasma display panel according to a twentieth aspect of the present invention, the step (a) comprises a step of: (a-1) preparing a member utilized when a mask is generated, the mask comprising a reticulated pattern specified by the first and second intervals. In the step (b), the mask is made from the member, and the plurality of barrier ribs of the first type and the plurality of barrier ribs of the second type are formed at the same time on the basis of the mask.

Preferably, in the method of manufacturing a surface discharge type plasma display panel according to a twenty and first aspect of the present invention, the step (a-1) further comprises steps of: (a-1-2) preparing a glass paste; and (a-1-3) preparing a predetermined photosensitive film as the member, and the step (b) comprises steps of: (b-1) forming the glass paste of a predetermined thickness on the whole surface of the second substrate; and (b-2) sticking the photosensitive film on the surface of the glass paste to form a dry film resist comprising the reticulated pattern as the mask by lithography method, and continuing to bore a hole in the glass paste by sand blast method from an exposed surface of the glass paste through a reticulated aperture of the dry film resist until the hole reaches the second substrate.

Preferably, in the method of manufacturing a surface discharge type plasma display panel according to a twenty and second aspect of the present invention, the dry film resist comprises a first mask portion of a first mask width extending along the second direction, and a second mask portion of a second mask width extending along, the first direction so as to be orthogonal to the first mask portion, the first mask width is not less than the second mask width; and the first and second mask widths are set on the basis of the first and second intervals, respectively.

Preferably, in the method of manufacturing a surface discharge type plasma display panel according to a twenty and third aspect of the present invention, the step (a) further comprises steps of: (a-2) preparing a glass paste; and (a-3) preparing a photosensitive film of a predetermined thickness as the member, and the step (b) comprises steps of: (b-1) sticking the photosensitive film on the whole surface of the second substrate; (b-2) transferring the reticulated pattern to the photosensitive film by arranging a first mask comprising the reticulated pattern specified by the first and second intervals on the surface of the photosensitive film and by irradiating the photosensitive film with a predetermined light through the first mask to thereby expose the photosensitive film, and then developing the photosensitive film; and (b-3) coating the glass paste on the second substrate. by using the photosensitive film with reticulated pattern transferred as the mask, drying the glass paste, and then stripping the photosensitive film.

Preferably, in the method of manufacturing a surface discharge type plasma display panel according to a twenty and fourth aspect of the pre-sent invention, the step (a-1) comprises a step of preparing a first mask having mask widths each corresponding to the first and second intervals, and a second mask with a plurality of apertures extending along the first direction and having a width corresponding to the first intervals which are arranged at intervals corresponding to the width of the barrier ribs of the first type. The step (a) further comprises steps of: (a-2) preparing a glass paste; and (a-3) preparing a first photosensitive film of a first thickness and a second photosensitive film of a second thickness as the member, and the step (b) comprises steps of: (b-1) sticking the first photosensitive film on the whole surface of the second substrate; (b-2) transferring a pattern of the first mask corresponding to the reticulated pattern to the first photosensitive film by arranging the first mask on the surface of the first photosensitive film and by irradiating the first photosensitive film with a predetermined light through the first mask to thereby expose the first photosensitive film, and then developing the first photosensitive film; (b-3) sticking the second photosensitive film on the surface of the developed first photosensitive film; (b-4) transferring a pattern of the second mask to the second photosensitive film by arranging the second mask on the surface of the second photosensitive film and by irradiating the second photosensitive film with the predetermined light through the second mask to thereby expose the second photosensitive film, and then developing the second photosensitive film; and (b-5) drying the glass paste after coating the glass paste on the second substrate by using the first and second photosensitive films remaining after the step (b-4) as the mask, and then stripping the first and second photosensitive films, wherein the sum of the first. thickness and the second thickness corresponds to the height of the barrier ribs of the first type from the second substrate.

According to the first aspect of the present invention, since the barrier rib of the second type is formed to be orthogonal to the plurality of barrier ribs of the first type, the following effects ① and ② can be achieved in any discharge spaces emitting visible light of the same color and isolated from each other by the barrier rib of the second type:

① In any discharge spaces, gas discharge between cells due to leakage of discharge can be reduced or completely suppressed. Namely, when atoms or molecules or the like in a discharge gas as the source of luminescence of ultraviolet rays, are excited by each gas discharge occurring in each of any discharge spaces and move forward the barrier rib of the second type, they can collide with the barrier rib of the second type, providing their kinetic energy with the barrier rib of the second type. This loss of energy causes the excited atoms or molecules or the like to return to their ground state. (a) When the barrier ribs of the first and second types are the same in height and their top portions are in contact with the surface of the dielectric, all of the excited atoms or molecules or the like can collide with the barrier rib of the second type while losing their energy, because their movement toward the adjacent discharge space is impeded by the barrier rib of the second type. As a result, the leakage of discharge is completely prevented between the discharge spaces isolated by the barrier rib of the second type. On the other hand, (b) when the height of the barrier ribs of the first type is larger than the height of the barrier rib of the second type, or when the barrier ribs of the first and second types are the same in height but their top portions are not in contact with the surface of the dielectric, the excited atoms or the like will try to go over the barrier rib of the second type to the adjacent discharge space. However, since many of the excited atoms or the like still collide with the barrier rib of the second type and lose their energy, the number of excited atoms making their way into the adjacent discharge space over the barrier rib of the second type can be remarkably reduced in comparison with the conventional device with no barrier rib of the second type. Thus, the barrier rib of the second type remarkably reduces the leakage of discharge between the adjacent discharge spaces.

② Further, when discharge between cells to be the cause of the leakage of discharge is certainly reduced or completely suppressed, a pitch between electrodes can be reduced as well in any discharge spaces isolated by the barrier rib of the second type. This allows an increase in pixel density along the barrier rib of the second type. Thus, a high-resolution panel can be achieved by providing the barrier rib of the second type across the panel.

According to the second aspect of the present invention, leakage of luminescence or visible light from one discharge space to another can be completely suppressed or sufficiently reduced in any discharge spaces isolated by the barrier rib of the second type. This completely or sufficiently suppresses the influence on color balance of pixels along the barrier rib of the second type, and makes it possible to display a further clear image without making a color run while improving picture quality. Thus, a fine panel with high luminance and high picture quality can be achieved by providing the barrier rib of the second type across the panel.

Since each discharge space is surrounded by the first side surface portion of one of the adjacent barrier ribs of the first type, the second side surface portion of the other of the adjacent barrier ribs of the first type, and the third and fourth side surface portions of the barrier rib of the second type, according to the present invention, visible light occurring in each of unit luminescent areas of any discharge spaces is reflected not only at the first side surface portion of one of the adjacent barrier ribs of the first type and the second side surface portion of the other of the adjacent barrier ribs of the first type which surround the unit luminescent area, but also at the third and fourth side surface portions of the barrier rib of the second type. This remarkably increases the amount of visible light to be emitted toward an observer. Thus, (a) when the barrier ribs of the first and second types are the same in height and their top portions are in contact with the surface of the dielectric, traveling of visible light from one unit luminescent area to another can be certainly prevented by the reflection of visible light at the third and fourth side surface portions of the barrier rib of the second type. Further, (b) when the height of the barrier ribs of the first type is larger than the height of the barrier rib of the second type, or when the barrier ribs of the first and second types are the same in height but their top portions are not in contact with the surface of the dielectric, since much of visible light is reflected at the third and fourth side surface portions of the barrier rib of the second type, the traveling of visible light can be prevented with a high probability. This increases the amount of visible light to be emitted toward an observer while preventing or sufficiently reducing the influence of the leakage of luminescence from one unit luminescent area to another, thereby achieving a plasma display panel with high luminance.

According to the third aspect of the present invention, since the phosphors adhere not only to the first and second side surface portions of the barrier ribs of the first type but also to the third and fourth side surface portions of the barrier rib of the second type, the following two effects ① and ② can be achieved in the respective unit luminescent areas of any discharge spaces isolated from each other by the barrier rib of the second type:

① Luminous efficiency in converting ultraviolet rays into visible light can be improved in comparison with the conventional device, which improves luminance.

Namely, in respective discharge spaces isolated from each other, since the phosphors adhere so as to make its longitudinal section, which is vertical to the first and second substrates, U-shaped, the area of the phosphors for receiving ultraviolet rays caused by discharge can be increased. This makes it possible to irradiate the phosphors more speedily with more ultraviolet rays before a loss of ultraviolet rays is increased by increase in repetitions of discharge or by absorption of ultraviolet rays into the dielectric with increase in the traveling distance of ultraviolet rays, thereby remarkably reducing the loss of ultraviolet rays.

② Further, since the phosphors are provided so as to surround gas discharge, the leakage of visible light from one unit luminescent area to another can be sufficiently suppressed. Namely, since visible light emitted from the phosphor in one unit luminescent area is reflected not only by the first and second side surface portions, and the third and fourth side surface portions in the unit luminescent area, and the phosphors on the first and second side surface portions but also by the phosphors on the third and fourth side surface portions, more visible light can be propagated to an observer. This further reduces the amount of visible light to be leaked into other unit luminescent areas.

According to the fourth aspect of the present invention, since the first height of the barrier ribs of the first type is almost equal to the second height of the barrier rib of the second type, in any discharge spaces isolated from each other by the barrier rib of the second type, it becomes possible to achieve (a) high luminance by reduction of the loss of ultraviolet rays; (b) suppression of the leakage of luminescence; and (c) suppression of the leakage of discharge, while achieving the effect as obtained by providing the adjacent barrier ribs of the first type in the conventional technique.

According to the fifth aspect of the present invention, since the second height of the barrier rib of the second type is set to be smaller than the first height of the barrier ribs of the first type, in any discharge spaces isolated from each other by the barrier rib of the second type, it becomes possible to achieve the following two effects ① and ②, while achieving the effect as obtained by providing the adjacent barrier ribs of the first type in the conventional technique:

① By stabilizing discharge operation while facilitating the exhaustion of each discharge space and the filling of discharge gas into each discharge space in manufacturing the plasma display panel; it becomes possible to achieve (a) high luminance by reduction of the loss of ultraviolet rays; (b) suppression of the leakage of luminescence; and (c) suppression of the leakage of discharge;

② By stabilizing discharge operation while simultaneously and certainly inducing the priming discharge in each discharge space, it becomes possible to achieve (a) high luminance by reduction of the loss of ultraviolet rays; (b) suppression of the leakage of luminescence; and (c) suppression of the leakage of discharge.

According to the sixth aspect of the present invention, since the phosphors adhere to the second top portion of the barrier rib of the second type, in any discharge spaces isolated from each other by the barrier rib of the second type, it becomes possible to further improve: (a) high luminance by reduction of the loss of ultraviolet rays; and (b) suppression of the leakage of luminescence. This is because ultraviolet rays traveling into a gap between the second top portion of the barrier rib of the second type and the surface of the dielectric is absorbed by the phosphors on the second top portion, and visible light traveling into the gap is reflected from the surface of the phosphors on the second top portion to an observer.

According to the seventh aspect of the present invention, since the difference between the first and second heights is determined on the basis of the correlation between the exhaust conductance and the luminance of display light, in each discharge space isolated by the barrier rib of the second type, it becomes possible to achieve (a) high luminance by reduction of the loss of ultraviolet rays; (b) suppression of the leakage of luminescence; and (c) suppression of the leakage of discharge, as well as to (d) facilitate the exhaustion of each discharge space and the filling of discharge gas into each discharge space in manufacturing the plasma display panel.

According to the eighth aspect of the present invention, since the shape factor $\beta$ is not less than 1.5 E−4 $mm^2$ and less than the value found by $(Hmain-b)^2/((Hmain+b)\cdot L)$, in any discharge spaces isolated from each other by the barrier rib of the second type, it becomes possible to stabilize discharge operation while facilitating and making reliable the exhaustion of each discharge space and the filling of discharge gas into each discharge space in manufacturing the plasma display panel. Especially, the shape factor $\beta$ closer to 1.5 E−4 $mm^2$ further stabilizes the discharge operation, which maximizes the effects: (a) high luminance by reduction of the loss of ultraviolet rays; (b) suppression of the leakage of luminescence; and (c) suppression of the leakage of discharge.

According to the ninth aspect of the present invention, since the difference between the first and second heights is determined on the basis of the minimum priming voltage at which the priming discharge occur in all of the plurality of discharge spaces, in any discharge spaces isolated from each other by the barrier rib of the second type, it becomes possible to achieve: (a) high luminance by reduction of the loss of ultraviolet rays; (b) suppression of the leakage of luminescence; and (c) suppression of the leakage of discharge by stabilizing the discharge operation in each discharge space, while simultaneously and certainly inducing the priming discharge in each discharge space.

According to the tenth aspect of the present invention, since the minimum priming voltage at which the priming discharge occur simultaneously and certainly in all of the discharge spaces can be optimized, in any discharge space isolated by the barrier rib of the second type, the following effects ① to ④ can be achieved:

① (a) Increase in dark luminance; (b) occurrence of discharge outside the display area of the panel; and (c) deterioration in insulation between terminals electrically connecting the panel and external driving circuits, caused by too high priming voltage can be certainly prevented from happening;

② Deterioration in withstand-voltage capability of the external driving circuits in generating the priming voltage can be certainly prevented from happening;

③ The necessity of using an active element with especially high withstand voltage as an element of the external driving circuits in generating the priming voltage can be avoided, and the use of an active element with flexibility becomes available;

④ Deterioration in withstand-voltage capability of the dielectric can be certainly prevented from happening.

According to the eleventh aspect of the present invention, the third side surface portion of the barrier rib of the second type is provided on the second area of the opposing surface of the second substrate, the second area facing the strip transparent conductive film of the first display electrode except where the metal electrode is formed. This achieves the following two effects ① and ②:

① In a discharge space isolated from its adjacent discharge space by the third side surface of the barrier rib of the second type out of any discharge spaces, it becomes possible to facilitate reduction of power consumption by suppressing gas discharge at the metal electrode of the first display electrode. This achieves a further efficient surface discharge type plasma display panel. Namely, in the discharge space between the barrier rib of the second type provided in the first area facing the metal electrode of the first display electrode and the portion of the dielectric facing the metal electrode, when the barrier ribs of the first and second types are the same in height and their top portions are in contact with the surface of the dielectric, all excited atoms or molecules and the like moving toward the adjacent discharge space can collide with the barrier rib of the second type to thereby lose their energy. This completely avoids occurrence of gas discharge which cannot contribute to the luminance occurring in the discharge space. On the other hand, when the barrier ribs of the first and second types are different in height, or when the barrier ribs of the first and second types are the same in height but their top portions are not in contact with the surface of the dielectric, most of excited atoms or molecules and the like moving toward the adjacent discharge space can still collide with the barrier rib of the second type, so that unnecessary occurrence of discharge can be reduced as compared with the case in the conventional technique.

② In a discharge space isolated by the third side surface portion of the barrier rib of the second type out of any discharge spaces, since both of the third side surface portion and the phosphors adhering thereto more project over the discharge space, ultraviolet rays occurring in the discharge space between the opposing surface of the second substrate and the portion of the dielectric which face the strip transparent conductive film of the first display electrode except where the metal electrode is formed, can further speedily reach the phosphors on the third side surface portion and the barrier rib of the second type. This further increases the effects: (a) high luminance by reduction of the loss of ultraviolet rays; (b) suppression of the leakage of luminescence; and (c) suppression of the leakage of discharge.

According to the twelfth aspect of the present invention, the fourth side surface of the second barrier rib is provided on the fourth area of the opposing surface of the second substrate, the fourth area facing the strip transparent conductive film of the second display electrode except where the metal electrode is formed. This achieves the following two effects ① and ②:

① In a discharge space isolated from its adjacent discharge space by the forth side surface of the barrier rib of the second type, it becomes possible to facilitate reduction of power consumption by suppressing gas discharge at the metal electrode of, the first display electrode. This achieves a further efficient surface discharge type plasma display panel. Namely, in the discharge space between the barrier rib of the second type provided on the first area facing the metal electrode of the first display electrode and the portion of the dielectric facing the metal electrode, (a) when the barrier ribs of the first and second types are the same in height and their top portions are in contact with the surface of the dielectric, all excited atoms or molecules or the like moving toward the adjacent discharge space can collide with the barrier rib of the second type to lose their energy. This completely avoids occurrence of discharge which cannot contribute to the luminance occurring in the discharge space. Further, (b) when the barrier ribs of the first and second types are different in height, or when the barrier ribs of the first and second types are the same in height but their top portions are not in contact with the surface of the dielectric, most of excited atoms or molecules or the like moving toward the adjacent discharge space can still collide with the barrier rib of the second type, so that unnecessary occurrence of discharge can be further reduced as compared with the case in the conventional technique.

② In a discharge space isolated by the fourth side surface portion of the barrier rib of the second type, since both the fourth side surface portion and the phosphors adhering thereto more project over the discharge space, ultraviolet rays occurring in the discharge space between the opposing surface of the second substrate and the portion of the dielectric which face the strip transparent conductive film of the first display electrode except where the metal electrode is formed, can further speedily reach the phosphors on the third side surface portion and the barrier rib of the second type. This further increases the effects: (a) high luminance by reduction of the loss of ultraviolet rays; (b) suppression of the leakage of luminescence; and (c) suppression of the leakage of discharge:

According to the thirteenth aspect of the present invention, since the second barrier rib of the second type is further provided between the jth and (j+1)th unit luminescent areas, the effect as obtained in any unit luminescent area by providing the barrier rib of the second type, that is, reduction or complete prevention of the leakage of discharge, can be obtained as well in the jth and (j+1)th unit luminescent areas isolated by the second barrier rib of the second type.

According to the fourteenth aspect of the present invention, since the phosphors also adhere to the second barrier rib of the second type provided between the jth and (j+1)th unit luminescent areas, all the effects as obtained in any unit luminescent area by providing the barrier rib of the second type and adhering the phosphors thereon can be obtained as well in the jth and (j+1)th unit luminescent areas isolated by the second barrier rib of the second type.

According to the fifteenth aspect of the present invention, the same effect as obtained in the fourteenth aspect of the present invention can be obtained in an unit luminescent area of any pixel.

According to the sixteenth aspect of the present invention, since the first display electrode is common to an area including the unit luminescent areas of adjacent pixels of the same color, and-two barrier ribs of the second type are provided so as to be orthogonal to the adjacent barrier ribs of the first type. This achieves the following four effects ① to ④:

① The first display electrode common to two pixels brings about high pixel density, thereby achieving high resolution.

② The same effect as obtained in the fourteenth aspect of the present invention can be achieved in the area including the unit luminescent areas of adjacent pixels of the same color.

③ The first display electrode common to two pixels excludes the influence of discharge occurring between the adjacent first and second display electrodes on each unit luminescent area of adjacent pixels of the same color.

④ The barrier rib of the second type provided only for every two pixels along the second direction permits an increase in alignment margin in sticking the first and second substrates together.

According to the seventeenth aspect of the present invention, since the third barrier rib of the second type is provided on the second substrate between the ith and (i+1)th unit luminescent areas, besides the effects ① to ③ of the sixteenth aspect, the following(Y effect can be further achieved:

④ The leakage of discharge occurring between the common first display electrode and the second display electrode of further adjacent pixel can be completely or sufficiently reduced.

According to the eighteenth aspect of the present invention, it becomes possible to achieve the surface discharge plasma display device achieving the effects as obtained in the surface discharge type plasma display panel, described in the eleventh, twelfth, and fifteenth to seventeenth aspects of the present invention.

According to the nineteenth aspect of the present invention, it is possible to achieve the second substrate with the phosphors adhering to each box-shaped discharge space surrounded by two adjacent barrier ribs of the first type and two adjacent barrier ribs of the second type. This allows the surface discharge type plasma display panel to achieve: (a) high luminance by reduction of the loss of ultraviolet rays; (o) suppression of the leakage of luminescence; and (c) suppression of the leakage of discharge.

According to the twentieth aspect of the present invention, a plurality of barrier ribs of the first type and a plurality of barrier ribs of the second type can be easily formed at the same time on the basis of a mask comprising a reticulated pattern.

According to the twenty-first aspect of the present invention, the barrier ribs of the first and second types of the same height can be formed at the same time by using the conventional sand blast method as it is.

According to the twenty-second aspect of the present invention, the barrier ribs of the first type and the barrier ribs of the second type smaller in height than the barrier ribs of the first type can be formed at the same time by using the conventional sand blast method as it is.

According to the twenty-third and twenty-forth aspects of the present invention, fine barrier ribs of the first and second types can be accurately formed at the same time without rounding their edge portions and making large fluctuation in height.

The present invention is made to solve the problems of the conventional device, pursuing the following objects:

An object of the present invention is to increase luminous efficiency.

Another object of the present invention is to improve luminance so as to maintain an original color balance, while reducing or completely preventing the leakage of luminescence.

A further object of the present invention is to increase the applied voltage in the display operation, and to stabilize display operation with increasing pixel density by reducing or completely preventing the gas discharge between cells.

To achieve the aforementioned objects, the present invention has proposed the second substrate having a new structure.

The present invention has further proposed the manufacturing method of a plasma display panel (PDP) with such characteristics.

These and other objects, features, aspects and advantages of the present invention will become more apparent from the following detailed description of the present invention when taken in conjunction with the accompanying drawings.

BRIEF DESCRIPTION OF THE DRAWINGS

FIGS. 48 to 53 are longitudinal sectional views showing the manufacturing process of both barrier ribs according to the sixth preferred embodiment.

DESCRIPTION OF THE PREFERRED EMBODIMENTS

Figure 1:
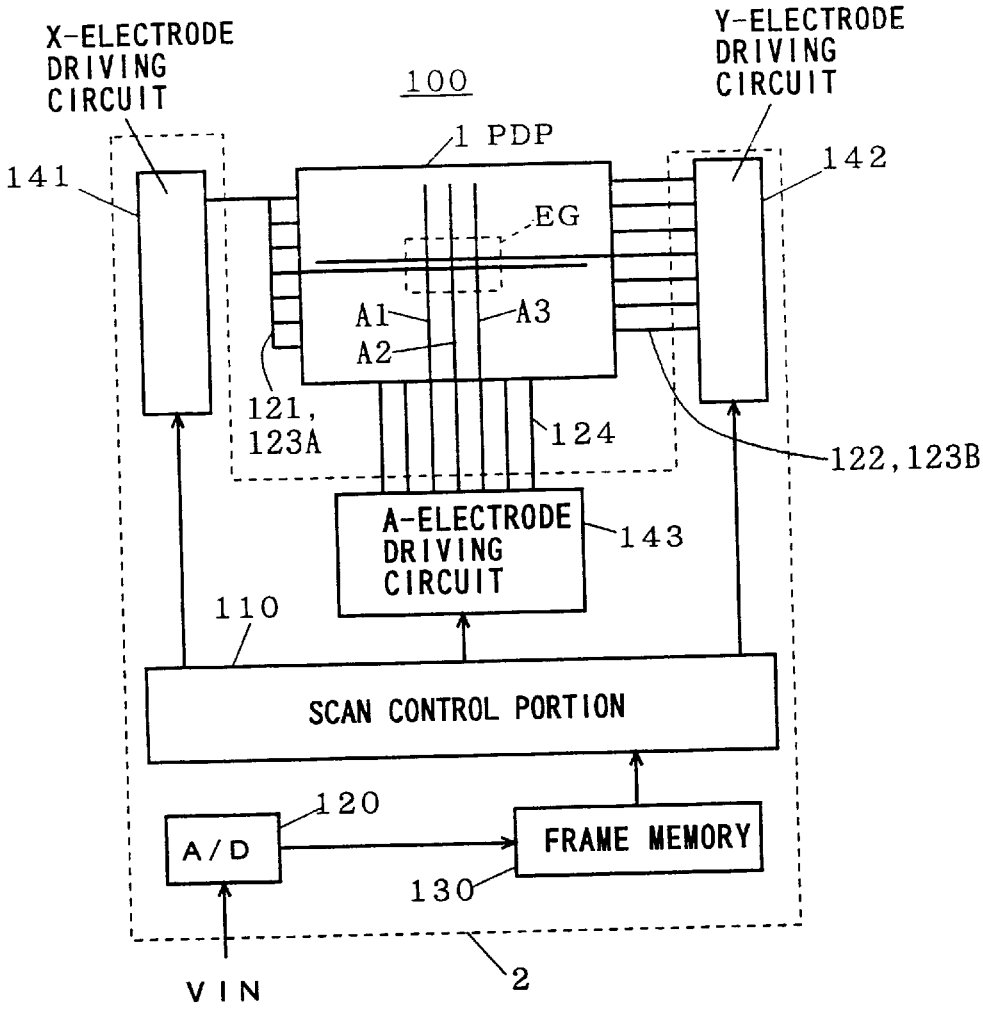
FIG. 1 is a block diagram showing an overall structure of a surface discharge type plasma display device according to the present invention.

We will now describe a surface discharge type plasma display device, and a plasma display panel and its manufacturing method according to the present invention, with reference to the drawings each showing examples of specified preferred embodiments. In the drawings, the same reference numerals or characters with those as used in the description of the conventional technique indicate the same or corresponding parts.

0. Common Feature to First to Third Preferred Embodiments

FIG. 1 is a block diagram showing an overall structure of a plasma display device 100 according to the present invention. As shown in FIG. 1, the device 100 is roughly divided into a plasma display panel 1 (hereinafter referred to as a PDP), and a drive control system 2 for applying each driving signal such as a priming pulse, write pulses, sustain pulses, and the like, to the PDP 1. The drive control system 2 consists of an A/D 120, a frame memory 130, a scan control portion 110, an X-electrode driving circuit 141, a Y-electrode driving circuit 142, and an A-electrode driving circuit 143.

The PDP 1 is an AC three electrode, surface discharge type panel including an X electrode which is a first display electrode or first electrode provided on the side of a first substrate, a Y electrode which is a second display electrode or second electrode provided on the side of a first substrate, and an A electrode which is a third electrode or address electrode arranged on the side of a second substrate facing the first substrate so as to be orthogonal to a pair of X and Y electrodes.

Next, operation of the plasma display panel device 100 will be described. The plasma display panel 1000 consists of the PDP 1, and the drive control system 2 electrically connected to the X, Y, and A electrodes of the PDP 1 via a flexible printed circuit (FPC) board (not shown).

Figures 3A, 3B, 3C, 3D, 3E:
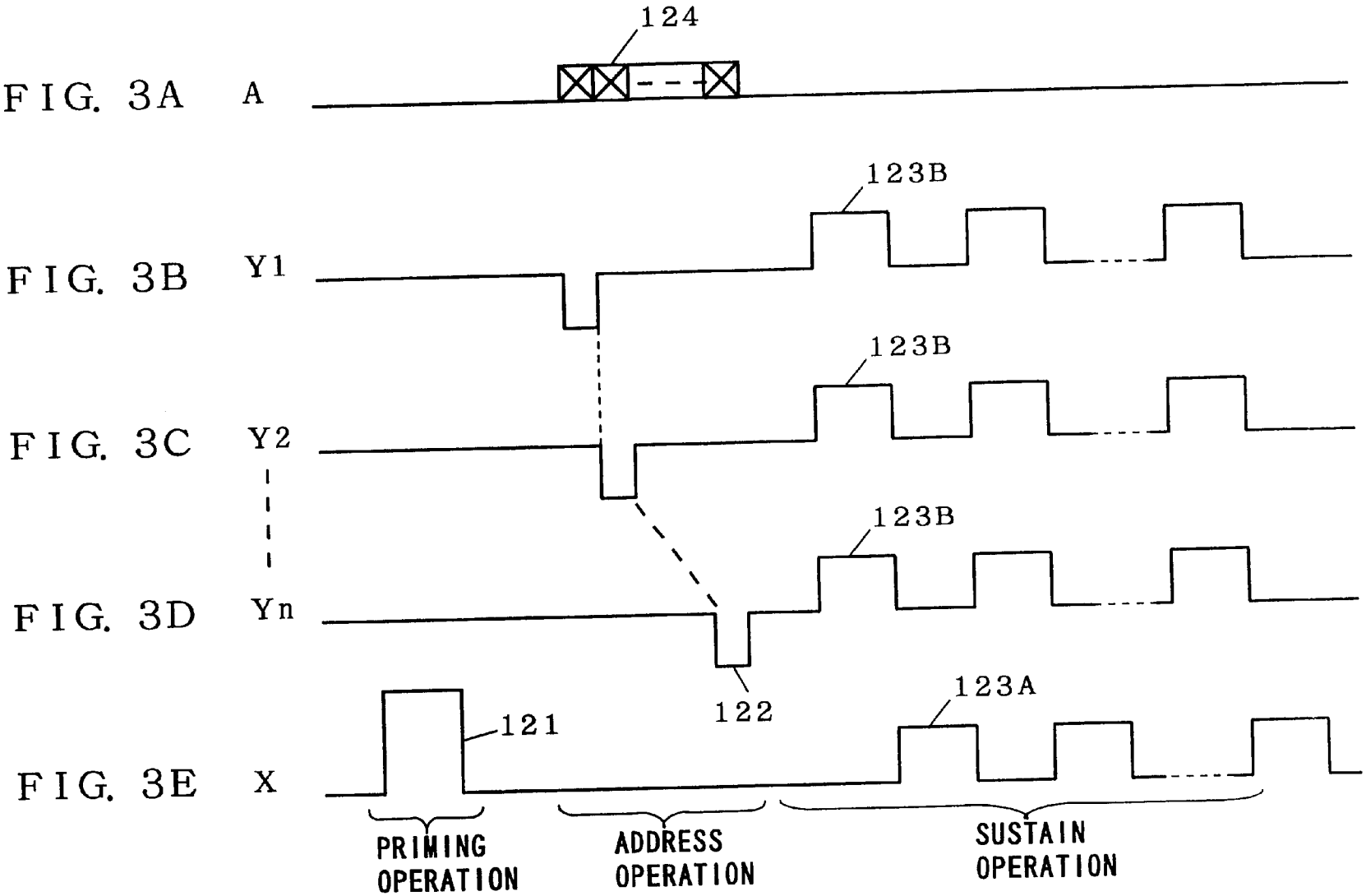
FIGS. 3A to 3E are timing charts of driving signals of the surface discharge type plasma display device according to the present invention.

In the drive control system 2, an input signal VIN providing image data is converted from analog to digital by an A/D 120, and digital data outputted from the A/D 120 is stored into the frame memory 130. Then, the scan control portion 110 accesses the digital image signal stored in the frame memory 130, and on the basis of these signals, outputs control signals for controlling drive of the X-electrode driving circuit 141, the Y-electrode driving circuit 142, and the A-electrode driving circuit 143, respectively, to the corresponding driving circuits 141 to 143. Upon receipt of the control signals, the driving circuits 141 to 143 apply driving pulse signals, such as a priming pulse 121, write pulses 122, address pulses 124, or discharge sustain pulses 123A and 123B as shown in FIGS. 3A and 3B, to the corresponding electrodes of the PDP 1, which drives the PDP 1.

Assuming that A-electrode lines A1 to A3 in FIG. 1 are arranged just below respective phosphors emitting red light R, green light G, and blue light B, respectively, an area specified by two points where each of the A-electrode lines A1 to A3 intersects with an X-electrode line and a Y-electrode line, respectively, is defined as an "unit luminescent area" which will be described later; and an area EG surrounded by a broken line corresponds to one pixel.

Figure 2:
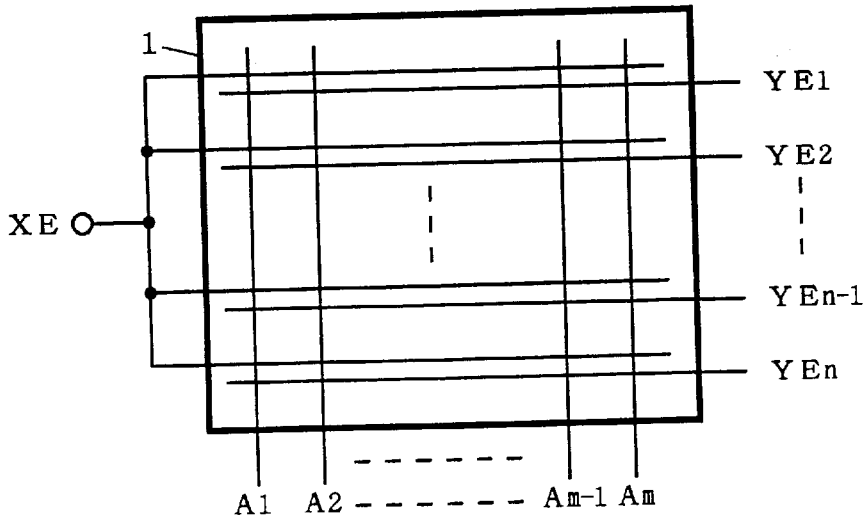
FIG. 2 is a plan view schematically showing wiring of the surface discharge type plasma display device according to the present invention.

FIG. 2 is a plan view schematically showing wiring of the X-electrode, Y-electrode, and A-electrode lines in the PDP 1. Namely, the X electrode or X-electrode line XE common to all the unit luminescent areas and each of the Y electrodes or Y-electrode lines $YE_i$ (i=1 to n) constitute a plurality of pairs of electrodes, and each of the pairs of electrodes intersects with each of the A-electrode lines $A_j$ (j=1 to m) to form m×n unit luminescent areas.

FIGS. 3A to 3E are timing charts of a priming pulse 121 and a first sustain pulse 123A outputted from the X-electrode driving circuit 141, write pulses 122 and second sustain pulses 123B outputted from the Y-electrode driving circuit 142, and address signals 124 outputted from the A-electrode driving circuit 143, respectively.

The above description with reference to FIGS. 1 to 3E is common to the following first to third preferred embodiments and their modifications.

1. First Preferred Embodiment

Figure 4:
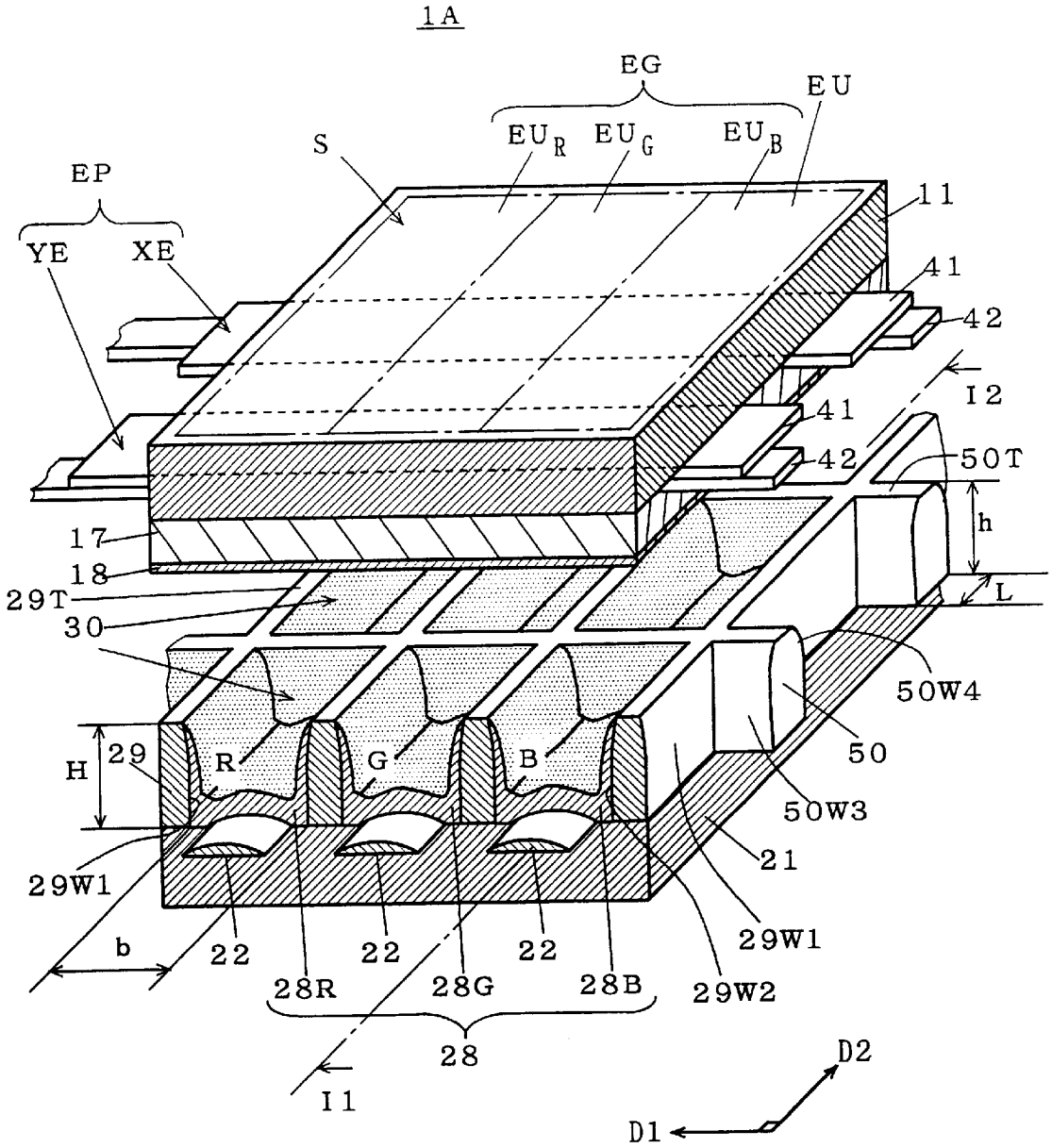
FIG. 4 is a perspective view schematically showing a structure of a surface discharge type plasma display panel according to a first preferred embodiment of the present invention.

FIG. 4 is a perspective view showing the outline of a sectional structure of a plasma display panel (PDP) 1A according to a first preferred embodiment of the present invention, extracting the pixel EG in FIG. 1.

In FIG. 4, the reference numeral 11 indicates a first substrate which is a front substrate formed of, for example, a transparent glass; 17 indicates a transparent dielectric layer; and 18 indicates a protective layer formed of, for example, MgO. These members 11, 17, 18, and the following X, Y electrodes XE, YE constitute what is called a "front panel". Further, the reference numeral 21 indicates a second substrate which is a rear substrate; and 22 indicates an address electrode (A electrode) of a predetermined width formed by printing and firing a pattern of a silver paste. These members 21 and 22, and the following members 29, 50, 28 constitute what is called a "rear panel". The PDP 1A is formed by sticking peripheral portions of the front and rear panels together and sealing subsequently.

In the following description, as a general rule, the dielectric layer 17 together with the protective layer 18 will be called a "dielectric" (which will be used in the following second and third preferred embodiments and their modifications as well).

The reference numeral 28R indicates a phosphor emitting red light R (visible light of a predetermined wavelength) by absorbing an ultraviolet ray of a predetermined wavelength emitted from Xe atom; 28G indicates a phosphor emitting green light G; and 28B indicates a phosphor emitting blue light B. The phosphors 28R, 28G, and 28B are generically called a phosphor 28.

The reference numeral 29 indicates a barrier rib of a first type formed of a material capable of reflecting visible light and arranged in strips; 30 indicates a discharge space filled with discharge gas including the Xe atoms, such as Penning gas; 41 indicates a strip transparent conductive film (hereinafter referred to as a transparent electrode) consisting of a tin oxide layer or the like; 42 indicates a strip metal film (hereinafter referred to as a metal electrode) consisting of multiple films such as Cr—Cu—Cr or Cr—Al—Cr; and the reference character EG indicates one pixel. The pixel EG consists of three unit luminescent areas $EU_R$, $EU_G$, $EU_B$ emitting red light R, green light G, and blue light B, respectively (which are generically called a unit luminescent area EU).

The reference character S indicates a display surface which is part of the outside surface of the first substrate 11 (second main surface); XE and YE are X and Y electrodes, respectively, arranged at predetermined intervals in parallel with each other on the inside surface of the first substrate 11 (first main surface) and extending along a first direction D1. Each of the X and Y electrodes XE and YE consists of the transparent electrode 41 (main electrode), and the metal electrode 42 (sub-electrode) which reduces resistance of the main electrode. The reference numeral 50 indicates a barrier rib of a second type extending along the first direction D1 so as to intersect with the barrier rib of the first type 29. The barrier rib of the second type 50 consists of the same materials as the barrier rib of the first type 29 (for example, a glass paste as a base material). This preferred embodiments is characterized by the barrier rib of the second type 50.

Further, the electrodes XE, YE, 22 of the PDP 1A and their corresponding output terminals of the drive control system 2, are electrically connected with each other via a flexible printed circuit board (not shown).

We will now describe in detail a panel structure of the PDP 1A and a state of discharge. A circuit structure and driving method of the PDP 1A are the same as previously described.

On the inside or opposing surface of the first substrate 11, n pairs of electrodes EP, corresponding to the number of display lines, n (see FIG. 2), are arranged at predetermined intervals in accordance with a space between the display lines, and extend along the first direction D1. Each of the pairs of electrodes EP consists of the X and Y electrodes XE and YE, or the first and second display electrodes, arranged in parallel with each other along the first direction D1. As previously described, each of the X and Y electrodes XE and YE consists of the transparent electrode 41 and the metal electrode 42, and arranged on the inside surface of the first substrate 11 on the side of the display surface S.

The transparent dielectric layer 17 is further formed on the inside surface of the first substrate 11 so as to cover the X and Y electrodes XE and YE, and the protective layer 18 is formed on the whole surface of the dielectric layer 17. The protective layer 18 has functions (a) to prevent deterioration of the dielectric layer 17 due to ion bombardment caused by discharge; (b) to stabilize discharge by smoothing electron emission during discharge; and (c) to store first and second wall charges of different polarity (generically called a wall charge) in its surface which is an interface with the discharge space 30.

On the inside surface of the second substrate 21 which is an opposing surface to the inside surface of the first substrate 11 and is called a first main surface of the second substrate 21, on the other hand, m A electrodes 22 (see FIG. 2) are arranged at predetermined intervals in parallel with each other and extend along the second direction D2. Thus, one unit luminescent area EU is specified by the aforementioned pair of X and Y electrodes XE and YE and one A electrode intersecting with the X and Y electrodes in orthogonal relations.

Further, on the inside surface of the second substrate 21, (m+1) barrier ribs of the first type 29 are formed in strips in parallel with each other along a second direction D2 orthogonal to the first direction D1, so as to sandwich each of the A electrodes 22. Their top portions (first top portions) 29T are in contact with the surface of the protective layer 18, respectively. Further, on the inside surface of the second substrate 21 except where the barrier ribs of the first type 29 are formed, (n+1) barrier ribs of the second type 50 are formed in strips in parallel with each other along the first direction D1, so as to cross over the A electrodes 22. Their top portions (second top portions) 50T are also in contact with the surface of the protective layer 18, respectively. Namely, the barrier ribs of the first and second types 29 and 50 intersect with each other so that a height h from the inside surface of the second substrate 21 to the second top portions 50T almost agree with a height H from the inside surface of the second substrate 21 to the first top portions 29T (h≈H), or that an imaginary plane surface including the first top portions 29T of the barrier ribs of the first type 29 almost agree with an imaginary plane surface including the second top portions 50T of the barrier ribs of the second type 50. Each of the discharge spaces 30 is basically specified, as shown in FIG. 4, by opposite first and second side surface portions 29W1 and 29W2 of the adjacent barrier ribs of the first type 29; opposite third and fourth side surface portions 50W3 and 50W4 of the adjacent barrier ribs of the second type 50; an area of the inside surface of the first substrate 11 sandwitched by the adjacent barrier ribs of the first type 29; and an area of the inner surface of the second substrate 21 sandwitched by the adjacent barrier ribs of the second type 50. Thus, in this case, the discharge space 30 is generally a rectangular parallelepiped in shape.

Further, the unit luminescent areas EU are sectioned by the size almost corresponding to the rectangle specified by the opposite first and second side surface portions 29W1 and 29W2 of the adjacent barrier ribs of the first type 29, and the opposite third and fourth side surface portions 50W3 and 50W4 of the adjacent barrier ribs of the second type 50.

On an area of the inside surface of the second substrate 21 sandwitched by the parallel and adjacent barrier ribs of the first type 29, the A electrode 22 of a predetermined width is arranged by printing and firing a pattern of a silver paste, and further an U-shaped or box-shaped phosphor 28 is provided so as to cover the opposite first and second side surface portions 29W1 and 29W2 of the adjacent barrier ribs of the first type 29; the opposite third and fourth side surface portions 50W3 and 50 W4 of the adjacent barrier ribs of the second type 50; an area of the inside surface of the second substrate 21 sandwitched by the adjacent barrier ribs of the first type 29: and the A electrode 22, except the first top portions 29T of the adjacent barrier ribs of the first type 29, the second top portions 50T of the adjacent barrier ribs of the second type 50, and their vicinity. Namely, the phosphor 28 is provided so as to wrap up discharge occurring in the discharge space 30 of each unit luminescent area EU.

Figure 5:
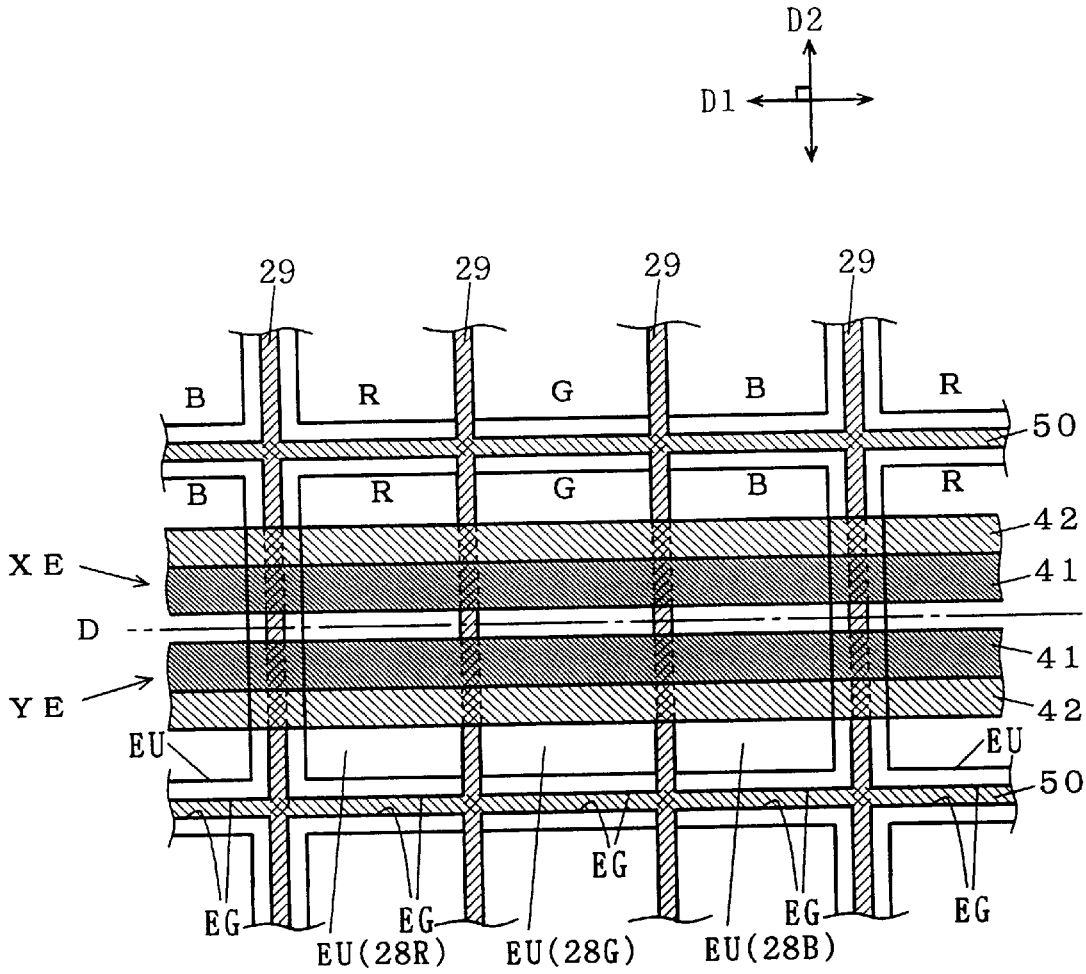
FIG. 5 is a perspective plan view schematically showing arrangement of each electrode and barrier rib and the effect thereof, in the surface discharge type plasma display device according to the first preferred embodiment.
Figure 6:
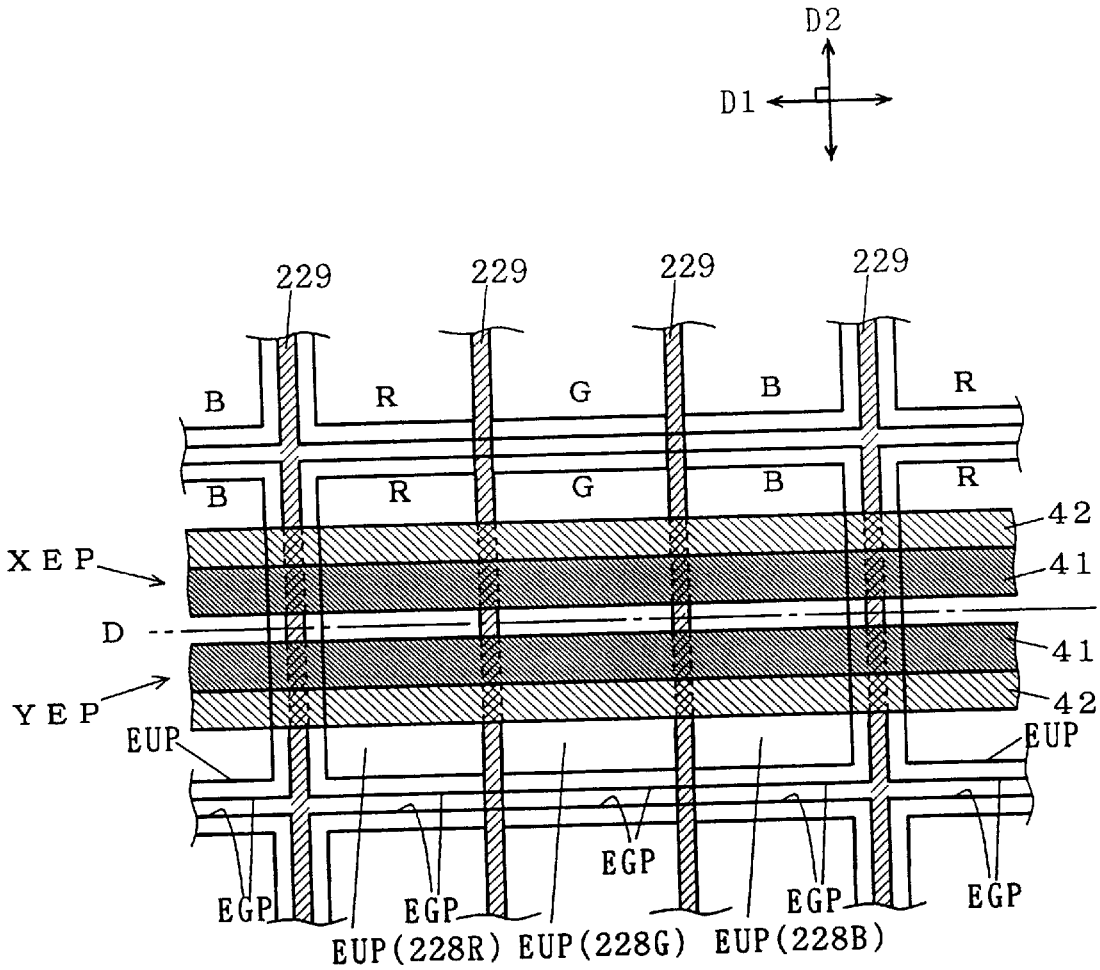
FIG. 6 (PRIOR ART)
FIG. 6 is a perspective plan view schematically showing arrangement of each electrode and barrier rib in the surface discharge type plasma display device according to the first preferred embodiment.
Figure 61:
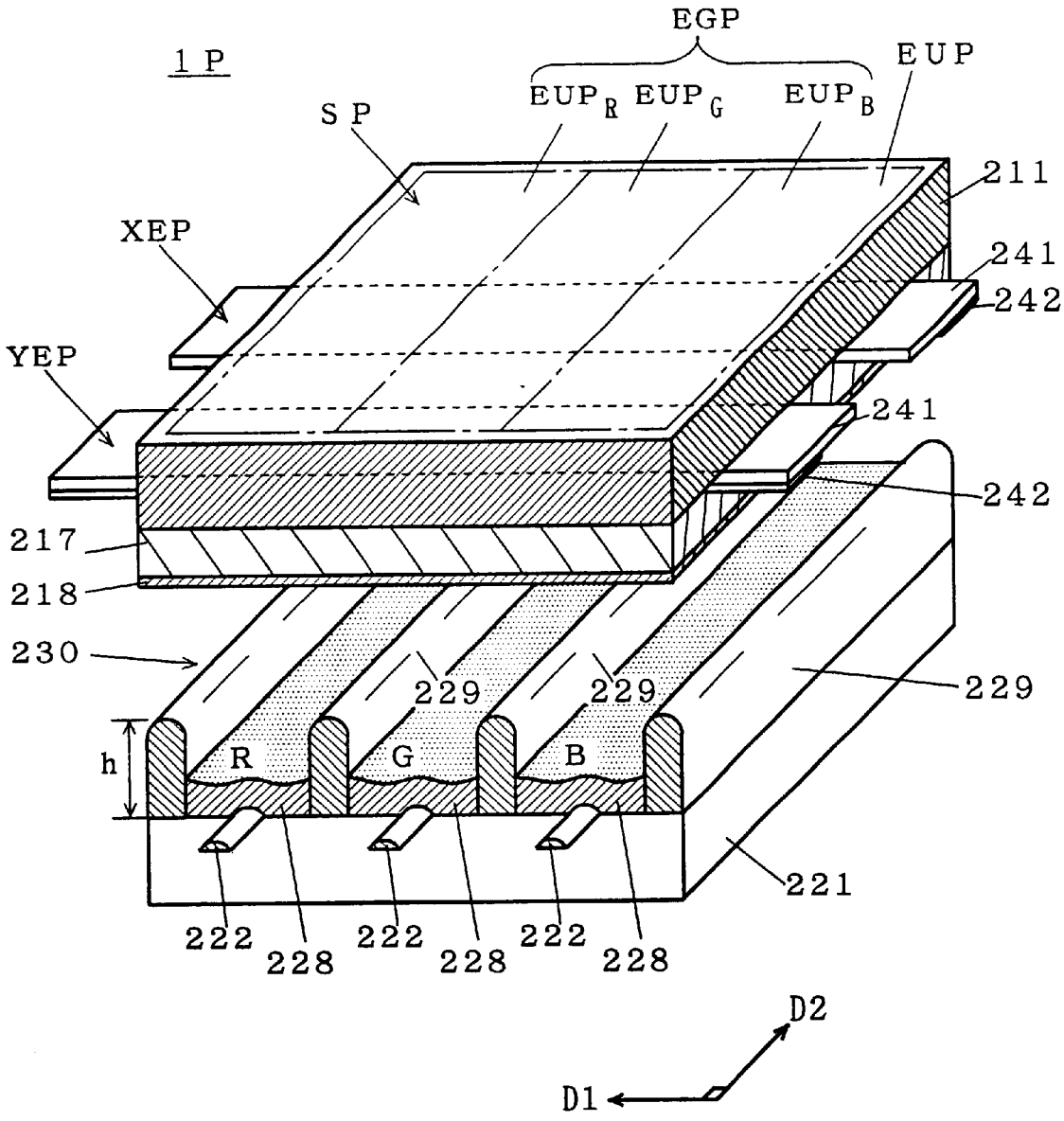
FIG. 61 (PRIOR ART)
FIG. 61 is a perspective view schematically showing a structure of the surface discharge type plasma display panel according to the conventional technique.
Figure 62A:
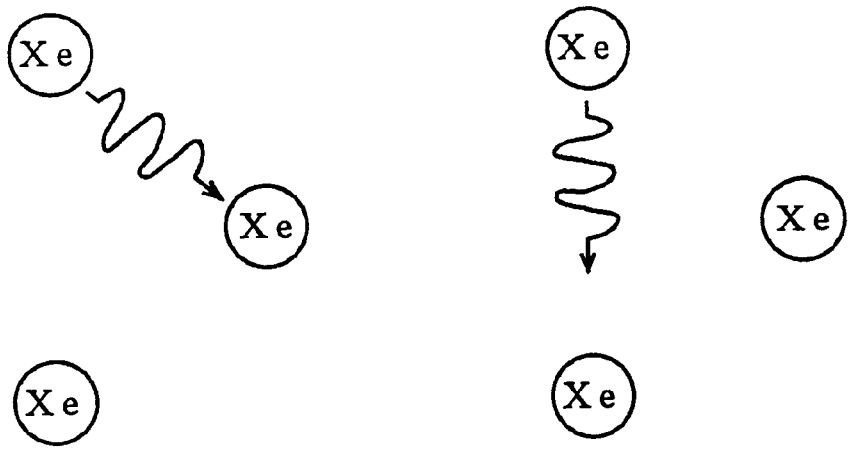
FIGS. 62A and 62B schematically shows self absorption and emission of ultraviolet rays.
Figure 62B:
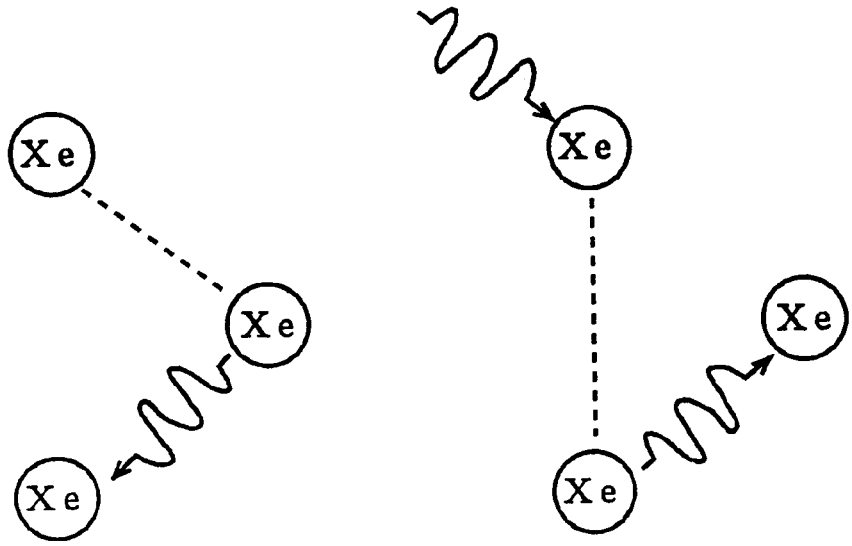

FIGS. 5 and 6 are perspective views schematically showing the outline of the discharge spaces viewed from the upper surfaces of the first substrate 11 in FIG. 4 and the first substrate 211 in FIG. 61, that is, viewed from the display surfaces S and SP, respectively. FIG. 5 roughly shows arrangement of the unit luminescent areas EU, the X electrode XE, the Y electrode YE, the barrier ribs of the first type 29, and the barrier ribs of the second type 50 according to this preferred embodiment; and FIG. 6 roughly shows arrangement of the unit luminescent areas EUP, the X electrode XEP, the Y electrode YEP, and the barrier ribs 229 of the conventional device shown in FIG. 61. In both FIGS. 5 and 6, the barrier ribs of the first type 29, the barrier ribs of the second type 50, and the barrier ribs 229 are schematically indicated by fine oblique hatching. The reference character D indicates the center of a display line.

Similar to the barrier ribs of the first type 29, the barrier ribs of the second type 50 are formed of a low melting glass mixed with a white pigment, and the phosphors 28 adhere to the opposite third and fourth side surface portions 50W3 and 50W4 of each barrier rib of the second type 50. In the conventional device shown in FIG. 6, since the unit luminescent areas EU adjacent to each other with respect to the second direction D2 are not isolated by any barrier rib, the discharge space 230 is continuously formed along the second direction D2. In this preferred embodiment, on the other hand, the discharge space 30 is, as shown in FIG. 5, discontinuously formed along the second direction D2 by the presence of the barrier ribs of the second type 50 with the phosphors 28 adhering thereto.

Figure 7A:
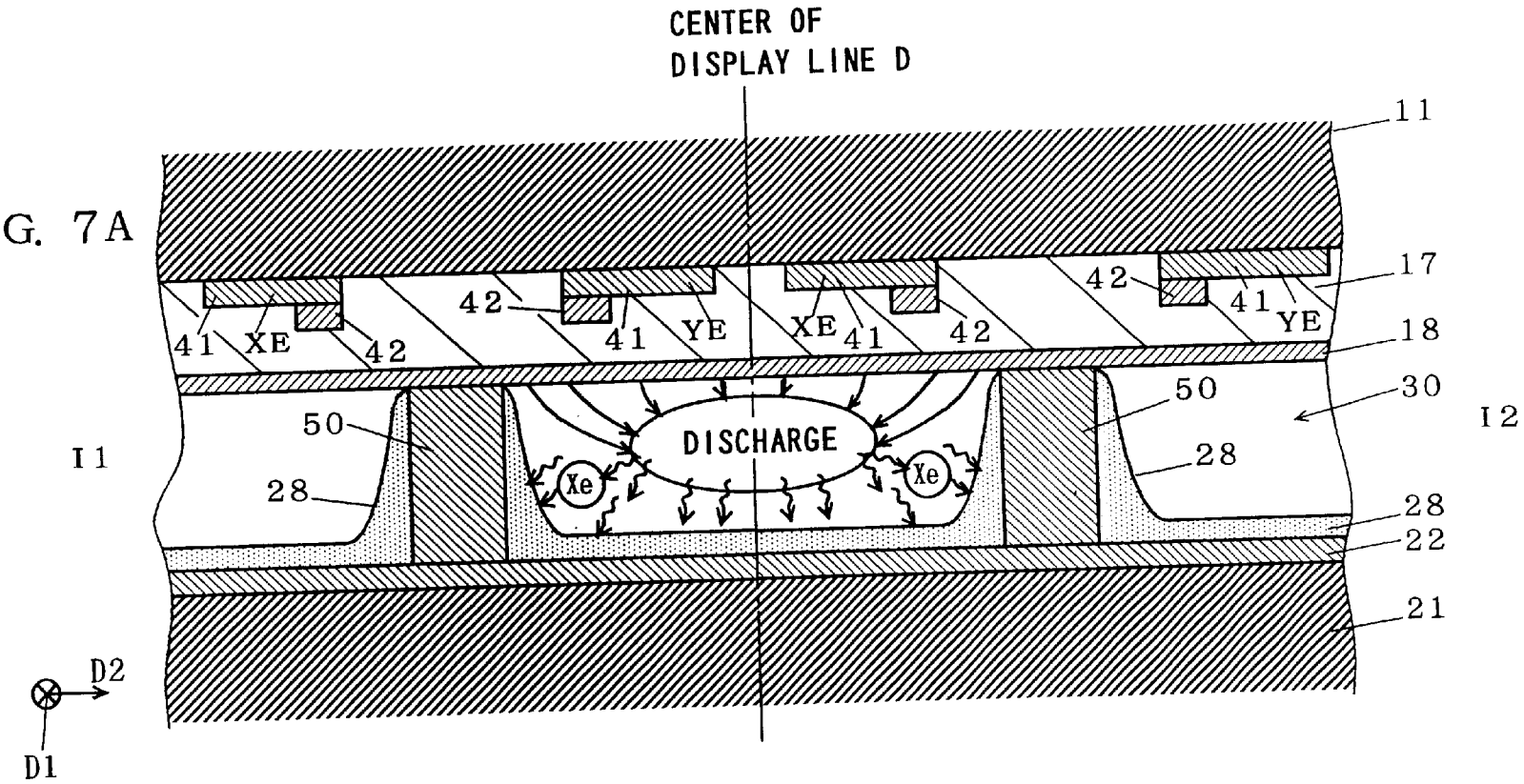
FIG. 7A is a longitudinal sectional view schematically showing arrangement of each electrode and second barrier rib, and the effect thereof, in the surface discharge type plasma display device according to the first preferred embodiment.

The PDP 1A with such a structure of this preferred embodiment gains various advantages, which will be described with reference to FIG. 7A. FIG. 7A is a longitudinal sectional diagram of the PDP 1A taken along a line I1–I2 in FIG. 4, schematically showing the state of self absorption and emission of ultraviolet rays as well as the outline of the sectional structure of the PDP 1A. As can be seen from the illustration in FIG. 7A, each discharge space 30 is almost perfectly closed.

The advantages of the PDP 1A includes:

① Deterioration of the phosphors 28 due to ion bombardment can be prevented (this is one of the strengths of the three electrode, surface discharge type PDP);

② The phosphors 28 adhering to the opposite first and second side surface portions 29W1 and 29W2 of the adjacent barrier ribs of the first type 29, and the opposite third and fourth side surface portions 50W3 and 50W4 of the adjacent barrier ribs of the second type 50, especially the phosphors 28 adhering to the latter, can be irradiated with ultraviolet rays before a loss in intensity of ultraviolet rays is increased with the distance of the propagation or diffusion of ultraviolet rays. Thus, the amount of irradiation of ultraviolet rays to be absorbed by the phosphors 28 will be rapidly increased, so that the amount of ultraviolet rays entering into the phosphors 28 can be increased before the loss of ultraviolet rays increases. This certainly improves luminous efficiency in converting ultraviolet rays into visible light, thereby improving luminance of display light (overcoming the aforementioned conventional problems (1) and (2)).

The PDP 1A of this preferred embodiment further has achieves an advantage which will not be obtained by the conventional device where the phosphors are continuously provided in strips:

③ In the PDP 1A, luminescence emitted from the phosphors 28 is reflected (a) on the surfaces of the phosphors 28 which are white against the visible light so that the visible light is not absorbed thereby; and (b) on the surfaces of the substantially box-shaped barrier ribs (tinged with a bright color such as white). Namely, luminescence is reflected not only on the opposite first and second side surface portions 29W1 and 29W2 of the adjacent barrier ribs of the first type 29, but also on the opposite third and fourth-side surface portions 50W3 and 50w4 of the adjacent barrier ribs of the second type 50, so that the leakage of luminescence to the outside of the unit luminescent area EU concerned can be completely prevented. This effectively suppresses the influence of the leakage of luminescence on color balance, thereby achieving clear image without making a color run and further improving image quality (overcoming the aforementioned conventional problem (3)).

With the adoption of the aforementioned structure, the inventors found about 5 to 20% improvement in luminance available, in comparison with the conventional structure, shown in FIG. 61, having stripe like phosphors but no barrier rib of the second type.

The PDP 1A further has the following advantage:

④ Discharge between cells, occurring between adjacent display lines of adjacent pixels with respect to the second direction D2, can be completely prevented by providing the barrier ribs of the second type 50 of the same height and the same material as the barrier ribs of the first type 29 (overcoming the aforementioned conventional problem (4)).

More specifically, in the surface discharge type plasma display device, discharge occurs between the X and Y electrodes XE and YE arranged on Y first substrate 11. Since this discharge is induced along the inside surface of the first substrate 11, the presence of the barrier ribs of the second type 50 certainly prevents the discharge between cells occurring when the applied voltage is relatively increased or a pitch between electrodes is relatively reduced.

Namely, if the pixels EG adjacent to each other with respect to the second direction D2 are physically and completely isolated by the barrier ribs of the second type 50 provided therebetween, the excited atoms or molecules moving in the second direction D2 will collide with the third and fourth side surface portions 50W3 and 50W4 of the barrier ribs of the second type 50, and return to their ground state. This causes a loss of energy, and perfectly prevents the occurrence of the leakage of discharge to be caused by the intrusion of excited atoms or molecules into adjacent pixels EG. The idea of providing the barrier ribs of the second type 50 makes a positive advantage of a resultant aspect that discharge current becomes hard to flow.

Further, since the applied voltage is increased by certainly suppressing the discharge between cells by the barrier ribs of the second type 50, more reliable occurrence of discharge for display can be expected while reducing the pitch between electrodes. This achieves a plasma display device with fine resolution and high pixel density.

2. Second Preferred Embodiment

In the PDP 1A according to the first preferred embodiment, the height h of the barrier ribs of the second type 50 is set almost equal or equivalent to the height H of the barrier ribs of the first type 29 so as to almost or completely suppress (a) the loss of ultraviolet rays; (b) the leakage of luminescence; and (c) the leakage of discharge.

However, since each unit luminescent area EU and its discharge space in this case are entirely surrounded by the first and second side surface portions 29W1 and 29W2 of the adjacent barrier ribs of the first type 29 and the third and fourth side surface portions 50W3 and 50W4 of the adjacent barrier ribs of the second type 50, the exhaustion and filling of discharge gas may become difficult in manufacturing the plasma display panel.

Namely, the panel manufacture requires the step of exhausting the respective discharge spaces 30 between the stuck first and second substrates 11 and 21 (hereinafter referred to as an exhaustion step); and the step of filling the exhausted discharge spaces 30 with discharge gas (hereinafter referred to as a filling step). Thus, high exhaust resistance results in insufficient completion of exhaustion at the exhaustion step, and residual impurity gas at the following filling step.

Therefore, it becomes necessary to have a space or flow path enough for gas to flow from one of adjacent discharge spaces 30 which are separated from each other by the barrier ribs of the first and second types, to another. This would be realizable if either of the heights of the barrier ribs 29 or 50 is smaller than the other. However, the height H of the barrier ribs of the first type 29 smaller than the height h of the barrier ribs of the second type 50 causes the excited atoms or the like, luminescence, and ultraviolet rays occurring in one unit luminescent area to propagate to unit luminescent areas of different colors adjacent to each other with respect to the first direction D1, so that such a solution is not desirable. This brings about an idea of reducing the height h of the barrier ribs of the second type 50 smaller than the height H of the barrier ribs of the first type 29 ($h<H$) to secure a flow path.

Although the idea of setting a flow path along the second direction D2 resolves the encountering problem of the exhaustion and filling steps, however, we come up against a dilemma that such resolution may spoil the meaning or effect of the idea of providing the barrier ribs of the second type 50 proposed in the first preferred embodiment. Therefore, it becomes necessary to: (A) overcome the aforementioned conventional problems (1) to (4); and (B) achieve fine exhaustion and filling, at the same time. The above objects (A) and (B) are in trade-off relations.

In order to find a compromise between the objects (A) and (B), it should be considered; how to set the exhaust conductance of the flow path along the second direction D2 and how to determine the range of the exhaust conductance. The solution to this is not simply led but requires due consideration.

Not only in manufacturing but also in driving the PDP 1A of the first preferred embodiment, a new problem (C) has arisen especially from the viewpoint of the priming discharge. This point will be now described in detail.

In general, a drive cycle of an AC type PDP consists of erase operation, write operation, and sustain operation. The erase operation of the drive cycle includes priming discharge operation (inducing discharge in each discharge space at the same time across the panel).

To induce the priming discharge, a voltage larger than a sustain voltage to be applied in the sustain operation, usually a little less than two times as large, as the sustain voltage, is applied as a priming pulse between display electrodes for about 10 to 20 $\mu$sec. This causes the priming discharge (pilot discharge) at the same time in each discharge space 30, which makes the following write operation reliable.

In the conventional structure, for example, as shown in FIG. 61, excited atoms, molecules and electrons (hereinafter referred to as a group of excited particles) are diffused in the second direction on the occurrence of the priming discharge. This diffusion facilitates propagation of the priming discharge.

On the other hand, the first preferred embodiment of the present invention has adopted the structure that the barrier ribs of the second type 50 of the same material and height as the barrier ribs of the first type 29 extend along the first direction D1 and intersect with the barrier ribs of the first type 29, and the phosphors 28 adhere to the barrier ribs of the second type 50, for the purpose of further improving luminance or the like. Although achieving the aforementioned object (A), such a structure limits the range of the diffusion of the group of excited particles only within the closed discharge space 30, thereby reducing the effect of the diffusion of the group of excited particles in the second direction, that is, the effect of facilitating the propagation of the priming discharge (Problem (C)).

From this point, also, the height h of the barrier ribs of the second type 50 needs to be smaller than the height H of the barrier ribs of the first type 29. However, since the aforementioned objects (A) and (C) are in tradeoff relations, how to find a compromise between the objects (A) and (C) and how to determine the range of an appropriate difference in height between the barrier ribs 29 and 50 become the points at issue. Obviously, the solution to this is also not simply led, and especially, it is necessary to involve considerations to the structure of a driver for causing a priming pulse (in the preferred embodiments, X-electrode driving circuit 141 in FIG. 1 for applying the priming pulse to the X or common electrode XE). For the time being, suffice it to say that the PDP 1A involves the problem (C) from the viewpoint of the priming discharge. We will first consider how to find a compromise between the problems (A) and (C), and then describe how to overcome the problem (C).

In the second preferred embodiment, the PDP 1A of the first preferred embodiment is improved so as to achieve the aforementioned problem (B) while protecting its own advantage as much as possible. The point of the improvement is that a flow path is provided along the second direction D2 with the barrier ribs of the second type 50 formed smaller in height than the barrier ribs of the first type 29. This is shown in a perspective view of FIG. 8.

Figure 8:
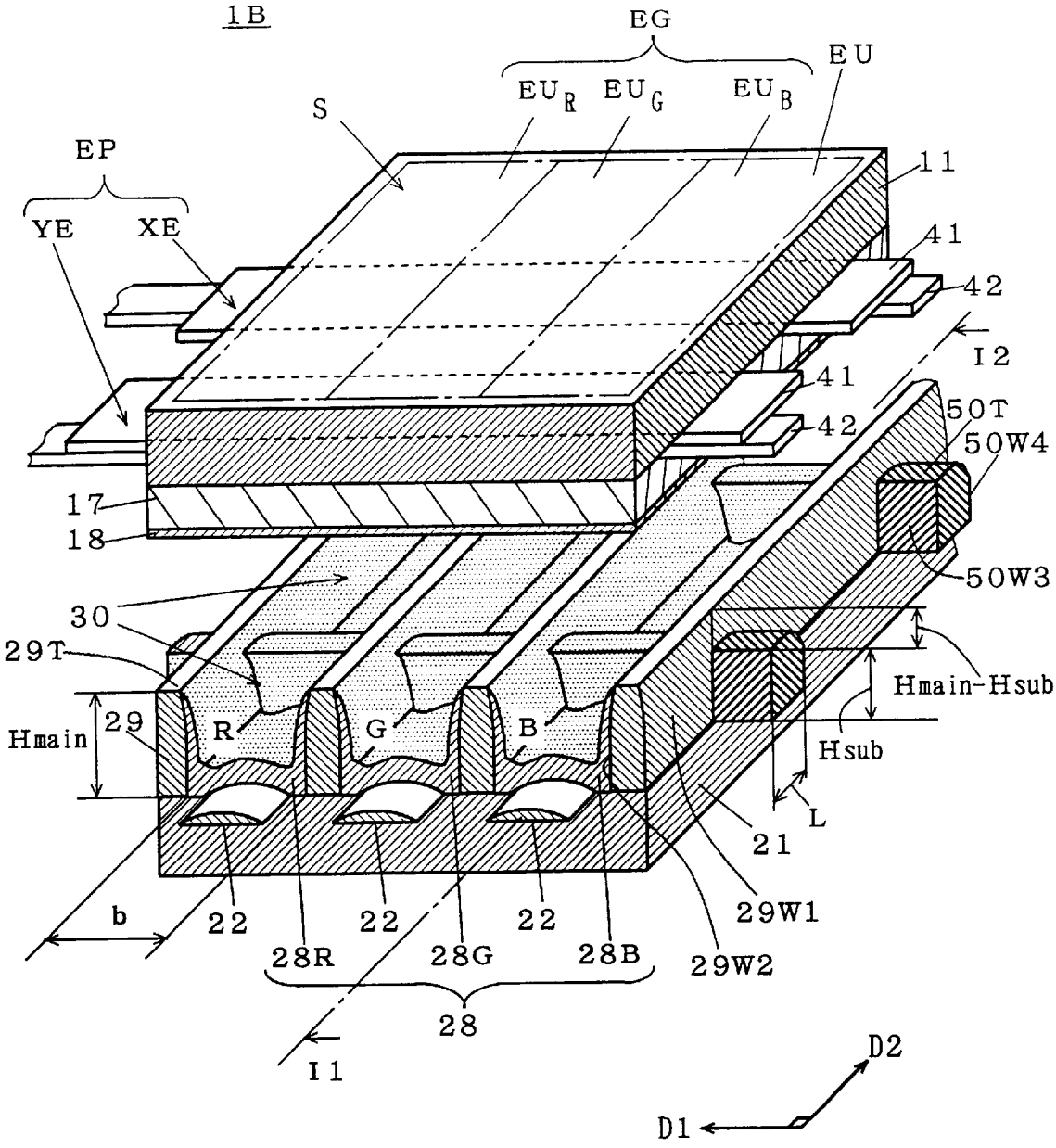
FIG. 8 is a perspective view schematically showing a structure of a surface discharge type plasma display panel according to a second preferred embodiment of the present invention.

FIG. 8 shows the structure of any one pixel EG in FIG. 1 as in FIG. 4, where the same reference characters indicate the same components as those in FIG. 4. In FIG. 8, the reference character Hmain indicates the height of the barrier ribs of the first type 29; and Hsub indicates the height of the barrier ribs of the second type 50. The heights Hmain and Hsub are the distances from the inside surface of the second substrate 21 with the phosphors 28 adhering thereto, to the first and second top portions 29T and 50T of the barrier ribs 29 and 50, respectively.

Figure 9:
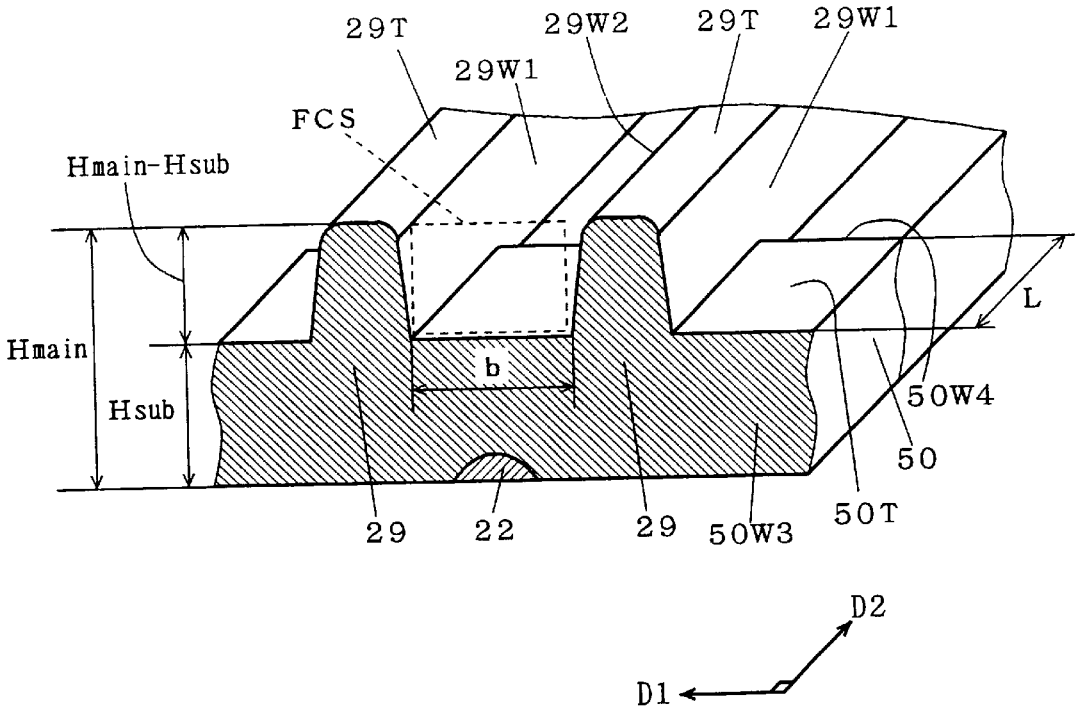
FIG. 9 is an enlarged perspective view schematically showing a flow path and its section in the surface discharge type plasma display panel according to the second preferred embodiment.

FIG. 9 schematically shows an enlarged section of a flow path shown in FIG. 8. The "flow path" is defined as a space specified by parts of the opposite first and second side surface portions 29W1 and 29W2 of the adjacent barrier ribs of the first type 29; the second top portion 50T of the barrier ribs of the second type 50; and the surface of the protective layer 18 abutting on the first top portions 29T of the adjacent barrier ribs of the first type 29 (abutting is a concept of including surface contact and line contact). Of inscribed quadrangles of this flow path of gas (they are rectangles or squares), the one having the maximum area is defined as a flow path section FCS in FIG. 9.

Then, the flow path section FCS of FIG. 9 has an area found by {(length a)×(width b)} which will be described later, and its depth is given by the width L of the barrier ribs of the second type 50.

Ease of exhaustion is expressed by the exhaust conductance C of this flow path. The exhaust conductance C is generally found by the following equation (1):

$$C=\alpha\cdot(a\cdot b)^2/\{(a+b)\cdot L\}=\alpha\cdot\beta \quad (1)$$

where α is a weighing value (which is the value determined by the shape of an exhaust path, and usually constant); a is found by (Hmain−Hsub); b is a distance between the opposite first and second side surface portions of the barrier ribs of the first type 29; L is the width of the barrier ribs of the second type 50; and β is a shape factor given by $(a\cdot b)^2/\{(a+b)\cdot L\}$.

Although expressed by (Hmain−Hsub) in the equation (1), the length a corresponds to a space between the surface of the protective layer 18 on the first substrate 11 and the upper surface of the barrier ribs of the second type 50 in the flow path section FCS at the exhaustion and filling steps. Each of dimensions a, b, L is expressed by mm, so that the unit of the shape factor β is expressed by $mm^2$.

The degree of vacuum obtained at the exhaustion step increases as increasing exhaust conductance C, while decreasing as the exhaust conductance C decreases. Accordingly, in order to reduce the amount of residual impurity gas, high degree of vacuum needs to be secured. Similarly, at the filling step of discharge gas, higher exhaust conductance C brings gas pressure to a more sufficient level.

Namely, as the second height Hsub of the barrier ribs of the second type 50 becomes smaller than the first height Hmain of the barrier ribs of the first type 29, the length a increases, and thereby the shape factor β increases. Thus, high exhaust conductance C can be obtained. This facilitates the exhaustion and filling steps, and also suppresses the amount of residual impurity gas, thereby achieving a highly reliable PDP 1B.

However, as previously described, the effect brought with the barrier ribs of the second type 50 is lessened as the difference in height (Hmain−Hsub) increases. Thus, the point at issue here is how to effectively protect the advantage brought with the barrier ribs of the second type 50.

Then, we need to consider which of the aforementioned conventional problems (1) to (4) to be stressed. As to the problem (1) regarding the luminous efficiency due to the repetition of the self absorption and radiation of ultraviolet rays, counteraction to the effect of the first preferred embodiment may be suppressed as small as possible by absorbing ultraviolet rays by the phosphors 28 adhering to the second top portion 50T of the barrier ribs of the second type 50 formed smaller in height than the barrier ribs of the first type 29. As to the problem (2) regarding the luminous efficiency due to the absorption of ultraviolet rays by the protective layer 18, the increase in loss associated with the increase in difference in height may be suppressed as small as possible by controlling the width L of the barrier ribs of the second type 50 or having the phosphors 28 adhering to the second top portion 50T of the barrier ribs of the second type 50 absorb ultraviolet rays. As to the problem (4) regarding the leakage of discharge, counteraction to the effect of suppressing the leakage of discharge may be suppressed as small as possible by increasing the width L of the barrier ribs of the second type 50 so that the excited atoms or the like will more frequently collide with the barrier ribs of the second type 50. However, as to the problem (3) regarding the leakage of luminescence, since the effect of the first preferred embodiment is obtained by reflecting visible light to the inside of the closed discharge space 30 by the barrier ribs of the second type 50 and the phosphors 28 adhering to the barrier ribs of the second type 50, the PDP 1B with the structure as shown in FIG. 8 will reduce such an effect.

Therefore, the first thing to be considered is how to suppress reduction in luminance as small as possible when the heights of the barrier ribs 29 and 50 are different (Hmain−Hsub). This requires that an available range of the difference in height (Hmain−Hsub) between the barrier ribs 29 and 50 be first determined on the basis of a correlation between the luminance of display light and the exhaust conductance.

Various considerations have been given by the inventors by preparing various samples of the PDP 1B of different size with the structure shown in FIG. 8 and testing characteristics of the shape factor β for each sample. As a result, it is found that the shape factor β of not less than $1.5\times10^{-4}$ (expressed simply as 1.5 E−4)$mm^2$ brings about a reproducible fine exhaustion and filling state enough to stabilize a discharge state: the shape factor β closer to $1.5\times10^{-4}$ $mm^2$ suppresses decrease in luminance of display light as small as possible; and the shape factor β of less than $1.5\times10^{-4}$ $mm^2$ increases the influence of the residual impurity gas, thereby causing more variations in discharge voltage and more discharge failure (for example, no discharge, or no persistency in discharge). Namely, the shape factor β of not less than $1.5\times10^{-4}$ $mm^2$ insures a reproducible fine exhaustion and filling state, thereby achieving the PDP 1B having a stable discharge state.

Figure 10:
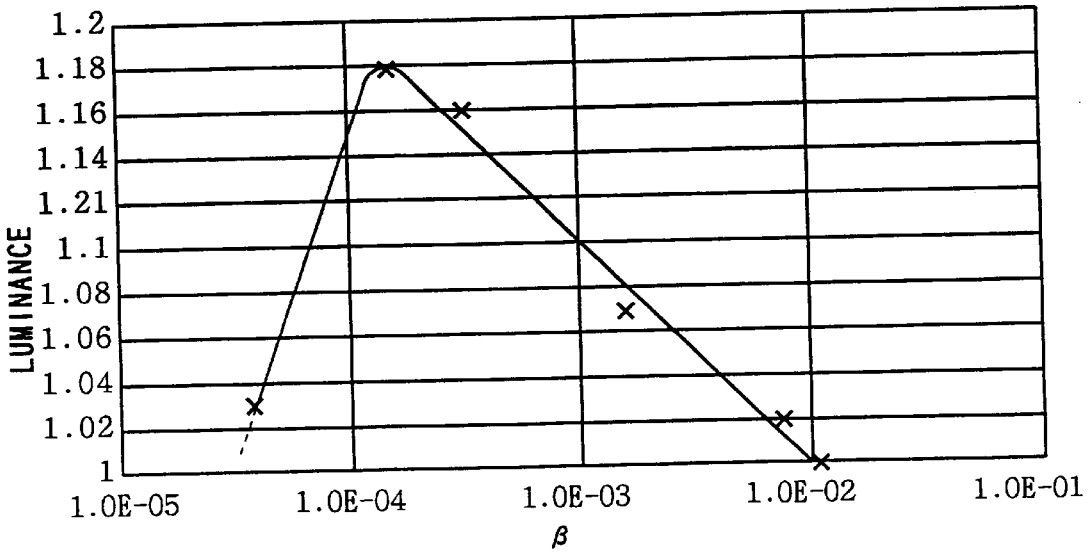
FIG. 10 shows a correlation between a shape factor and luminance in the surface discharge type plasma display panel according to the second preferred embodiment, on the basis of a test result.

FIG. 10 shows a characteristic curve obtained from the measured data as described above. Namely, FIG. 10 to is an example showing a correlation between the shape factor β and the luminance of display light (luminance across the panel).

In FIG. 10, the horizontal axis indicates the value of logarithm of the shape factor β; and the vertical axis indicates the degree (ratio) of luminance across the surface of the PDP 1B with reference to the luminance across the surface of the PDP with no barrier rib of the second type 50. Thus, when the shape factor β=0, the luminance becomes 1.

With reference to FIG. 10, for the shape factor a of less than $1.5\times10^{-4}$ $mm^2$, since it is difficult to conduct appropriate exhaustion and filling of discharge gas at the exhaustion and filling steps as previously described, the discharge state will be deteriorated. Further, as the shape factor β increases more than its maximum value, $1.5\times10^{-4}$ $mm^2$, the degree of luminance progressively decreases. As a consequence, the inventors have found that the luminance will reach its maximum with the shape factor β of $1.5\times10^{-4}$ $mm^2$.

Figure 11:
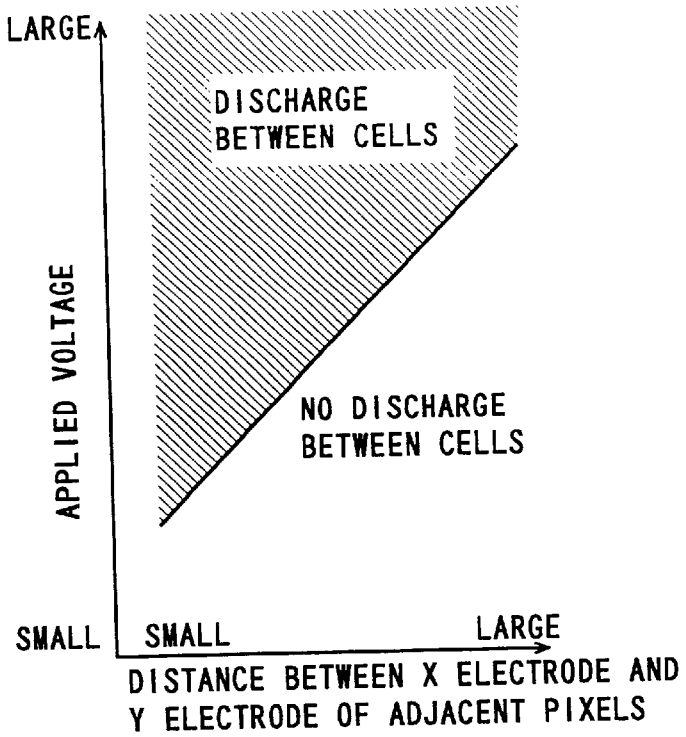
FIG. 11 schematically shows an effect of leakage of discharge in relation to a gap between both electrodes and an applied voltage.
Figure 12:
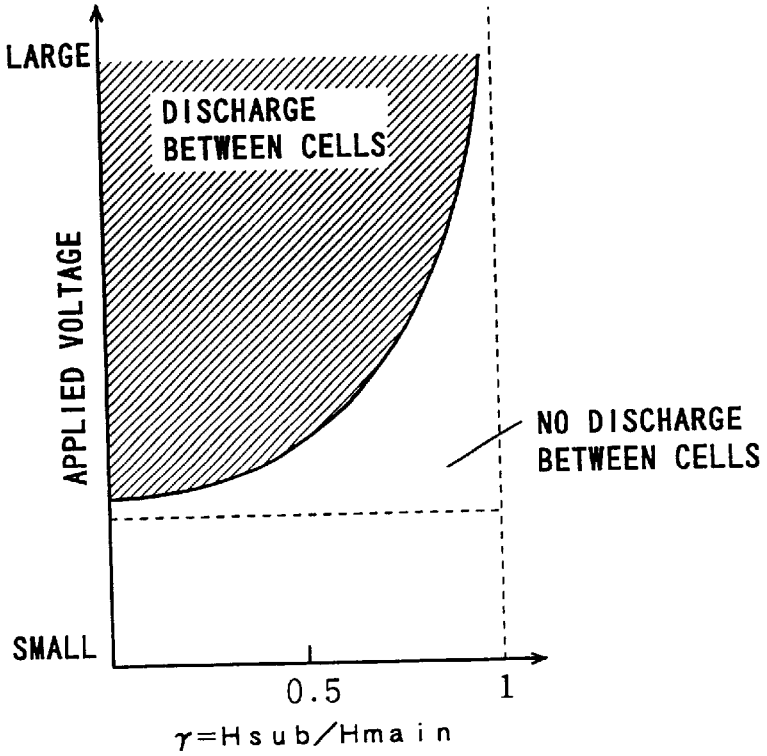
FIG. 12 schematically shows the effect of leakage of discharge in relation to the ratio of heights of both barrier ribs and the applied voltage.

FIGS. 11 and 12 illustrates the occurrence of the discharge between cells. Especially in FIG. 12, the horizontal axis indicates a parameter γ given as the ratio of heights of barrier ribs Hsub/Hmain (height of barrier ribs of the second type/height of barrier ribs of the first type). FIG. 11 shows a characteristic curve without barrier rib of the second type 50.

With reference to FIG. 11, as the distance (gap) between the adjacent X and Y electrodes XE and YE of the adjacent pixels increases, the applied voltage, at which the discharge between cells occurs, proportionally increases. Thus, when the pixel density is increased, for example, a PDP resistant to the discharge between cells may be achieved by reducing the applied voltage together with the distance (gap) between the X and Y electrodes XE and YE. If the applied voltage is reduced, however, it will be difficult to have a large voltage margin for driving the PDP 1B, which makes various driving difficult. Thus, a high-resolution plasma display device is hardly achieved in actuality. Namely, this method is not practical for the achievement of high resolution.

On the other hand, FIG. 12 shows a characteristic curve with the barrier ribs of the second type 50. As the parameter γ increases (difference in height decreases), the applied voltage at which the discharge between cells occurs, increases. Since the X and Y electrodes XE and YE of the adjacent pixels are almost spatially cut off when the parameter γ is 1 as is the case with the PDP 1A of the first preferred embodiment, the applied voltage to induce the discharge between cells becomes extremely high. Namely, in this case, no discharge is induced between cells.

Thus, when the PDP 1B is manufactured through the manufacturing process including the aforementioned exhaustion and filling steps, the second height Hsub of the barrier ribs of the second type 50 should be set as high as possible so as to secure the shape factor β of not less than $1.5\times10^{-4}$ $mm^2$. This achieves the PDP 1B (a) improving luminance; (b) securing the voltage margin of a sufficient level for the applied voltage (determined by the applied voltage at which the discharge occurs between cells); and (c) sufficiently preventing the discharge between cells.

Figure 7B:
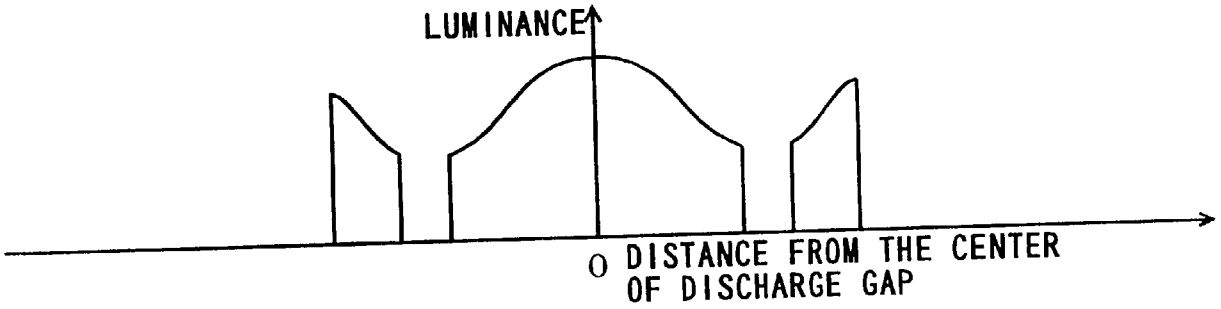
FIG. 7B shows luminance distribution with respect to FIG. 7A.
Figures 13A, 13B:
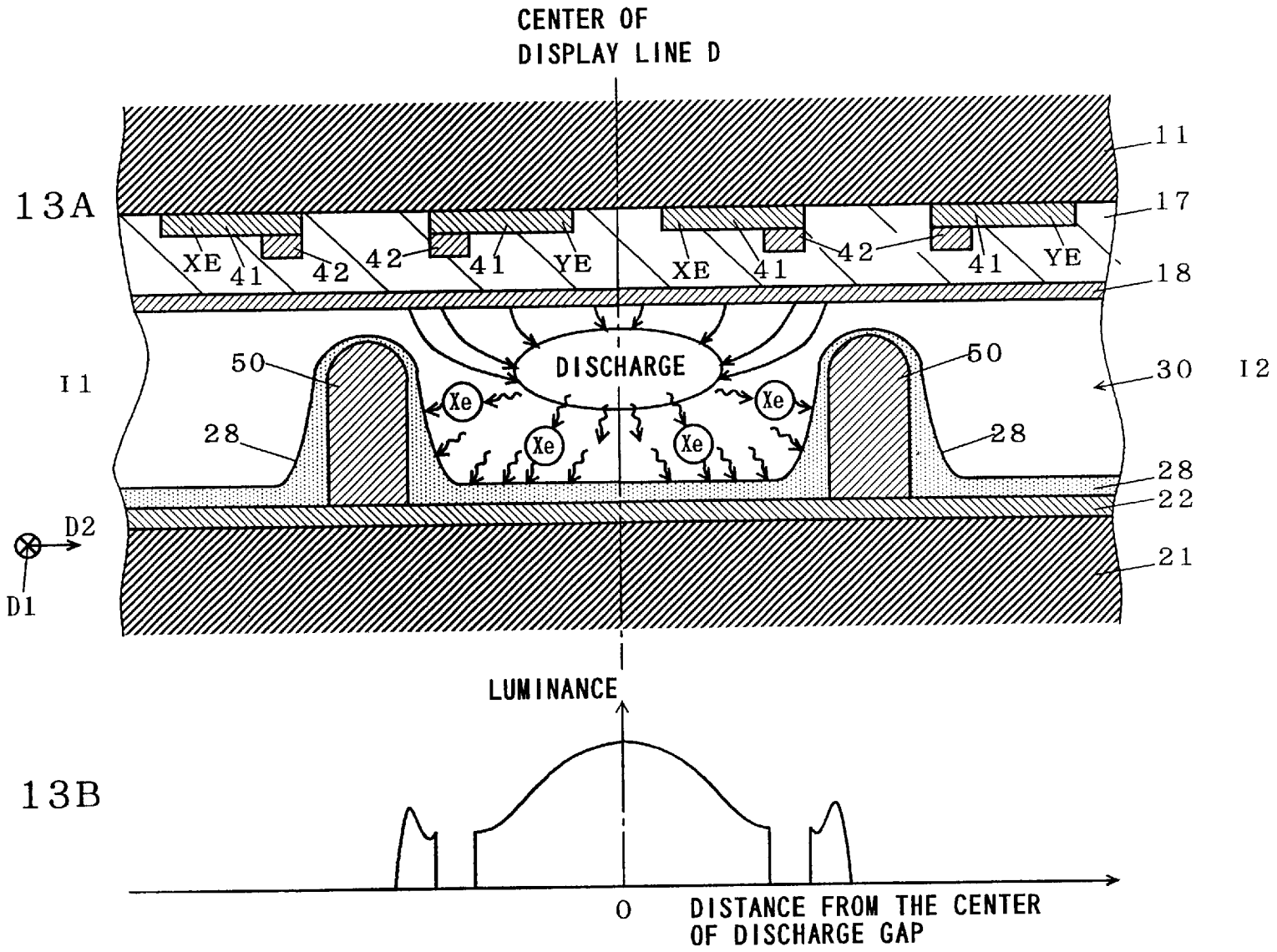
FIG. 13A is a longitudinal sectional view schematically showing arrangement of each electrode and the second barrier ribs, and the effect thereof, in the surface discharge type plasma display panel according to the second preferred embodiment.
FIG. 13B shows a distribution of luminance with respect to FIG. 13A.

For ease of understanding, these points are schematically shown in FIGS. 13A and 13B in a similar way to FIGS. 7A and 7B.

An available maximum value of the shape factor β is obtained when the second height Hsub is zero, and expressed by:

$$(H\text{main}\cdot b)^2/\{(H\text{main}+b)\cdot L\}$$

Thus, the range of the appropriate shape factor β satisfies the following inequality:

$$1.5\times10^{-4}\ \text{mm}^2 \leq \beta < (H\text{main}\cdot b)^2/\{(H\text{main}+b)\cdot L\}$$

Although a panel is finally completed by sticking the first and second substrates 11 and 21 together and sealing the peripheral portions of each substrate with the low melting point glass or the like (for instance, a flit glass) as described in the first preferred embodiment, such sealing of the plasma display panel PDP 1B having the aforementioned structure may be performed in an atmosphere of a predetermined discharge gas pressure.

When the PDP 1B is achieved as shown in FIG. 8 with the height Hsub set so that the shape factor β satisfies the aforementioned inequality, the following effects can be achieved:

(i) The exhaust conductance C set to a value of not less than a predetermined value, that is, $1.5\times10^{-4}$ $mm^2$, brings about a fine discharge state, while the exhaust conductance C close to the predetermined value brings about the highest luminance. Besides, the aforementioned effects No) and (c) are also achieved.

(ii) To form the phosphors 28, a screen printing is generally employed in the aspect of cost. If the barrier ribs of the first and second types 29 and 50 are the same in height in coating the phosphor paste by this screen printing along the second direction D2, since each of the second top portions T50 of the barrier ribs of the second type 50 lies in the way of coating as an obstacle, the phosphor paste will adhere to each of the second top portions 50T. Then, after the completion of the coating, if the steps of drying and firing the phosphor in such a state is performed, the unnecessary phosphor pastes adhering to the second top portions 50T of the barrier ribs of the second type 50 will be dried and fired together. This increases the barrier ribs of the second type 50 substantially larger in height than the barrier ribs of the first type 29 with no phosphor 28 adhering to their top portions 29T. If the height of the barrier fibs of the second type 50 becomes substantially larger than that of the barrier ribs of the first type 29, the discharge occurring in an unit luminescent area emitting red light (R), for example, will spread to its adjacent unit luminescent areas emitting light of different colors (green (G) or blue (B)). This changes a state of wall charges in those adjacent unit luminescent areas (discharge interference), thereby hindering a normal display.

To avoid this, the height Hsub of the barrier ribs of the second type 50 is previously set smaller, as in the PDP 1B shown in FIG. 8. The substantial increment of the height Hsub which may be made after the phosphors 28 are formed is offset by the difference in height (Hmain−Hsub). This prevents the aforementioned problem from happening.

Further, the shape of the flow path section FCS at the exhaustion and filling steps, for specifying the exhaust conductance C, is not limited to the example shown in FIG. 9 but variously formed according to the manufacturing process. FIGS. 14 to 20 show several examples of the shape for each formation process.

Figure 14:
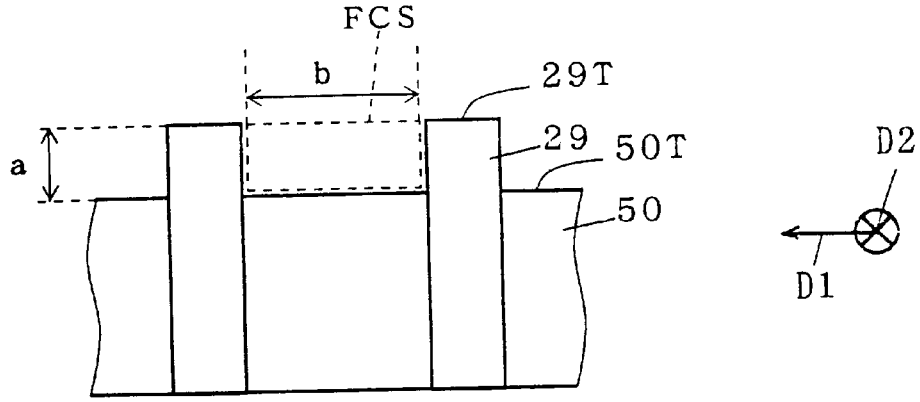
FIGS. 14 through 20 are longitudinal sectional views each schematically showing an example of a section of a flow path in the surface discharge type plasma display panel of the second preferred embodiment.

(a) FIG. 14 shows an example of the shape of the flow path section FCS when the barrier ribs 29 and 50 are formed through a manufacturing process which will be described later in a seventh preferred embodiment.

Figure 15:
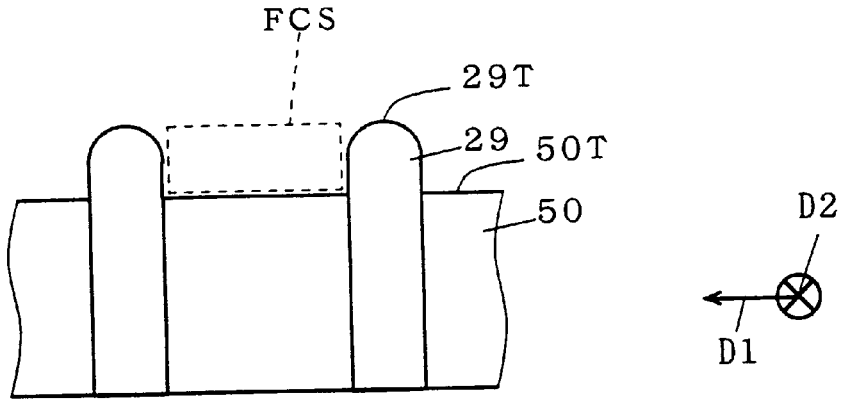

(b) FIG. 15 shows another example of the shape of the flow path section FCS with the first top portions 29T of the barrier ribs of the first type 29 rounded in inverted U-shape when the barrier ribs 29 and 50 are formed through multiple screen printing.

Figure 16:
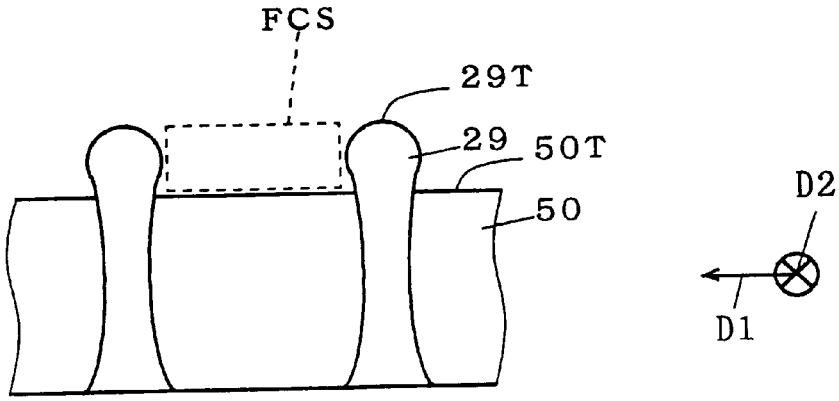

(c) FIG. 16 shows another example of the shape of the flow path section FCS with the barrier ribs of the first type 29 having a Ω-shaped section when the barrier ribs 29 and 50 are formed through multiple screen printing.

Figure 17:
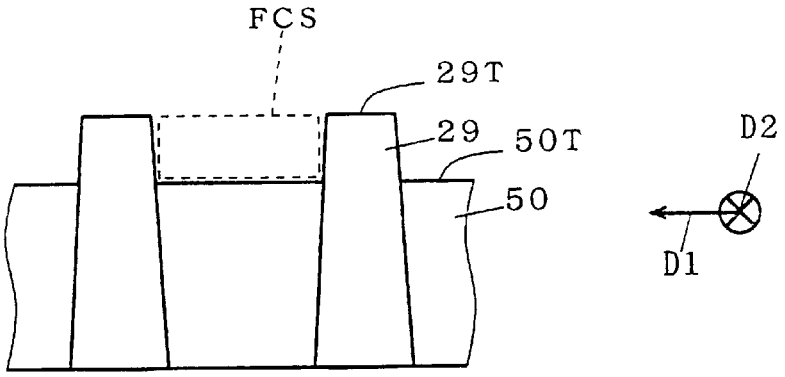

(d) FIG. 17 shows another example of the shape of the flow path section FCS with the barrier ribs of the first type 29 having trapezoid-shaped section and the second top portions 50T of the barrier ribs of the second type 50 having a linear surface, when the barrier ribs 29 and 50 are formed by a sand blast method which will be described later in a sixth preferred embodiment.

Figure 18:
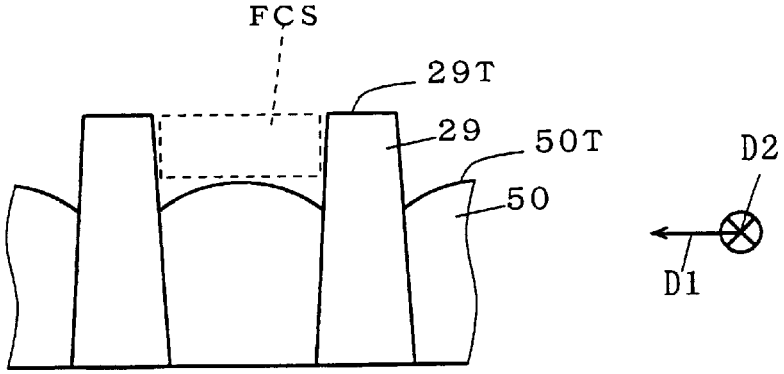

(e) FIG. 18 shows another example of the shape of the flow path section FCS with the second top portions 50T of the barrier ribs of the second type 50 having a convex surface curved outwards in the center, when the barrier ribs 29 and 50 are formed by means of sand blast method as in the case (d).

Figure 19:
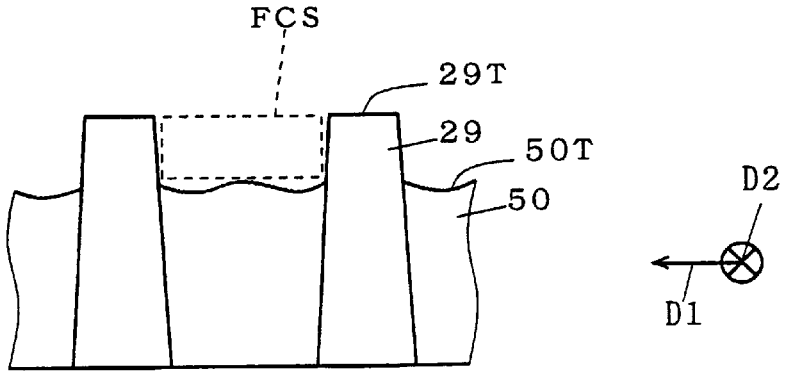

(f) FIG. 19 shows another example of the shape of the flow path section FCS with the second top portions 50T of the barrier ribs of the second type 50 having a corrugated surface, when the barrier ribs 29 and 50 are formed by the sand blast method as in the case (d).

Figure 20:
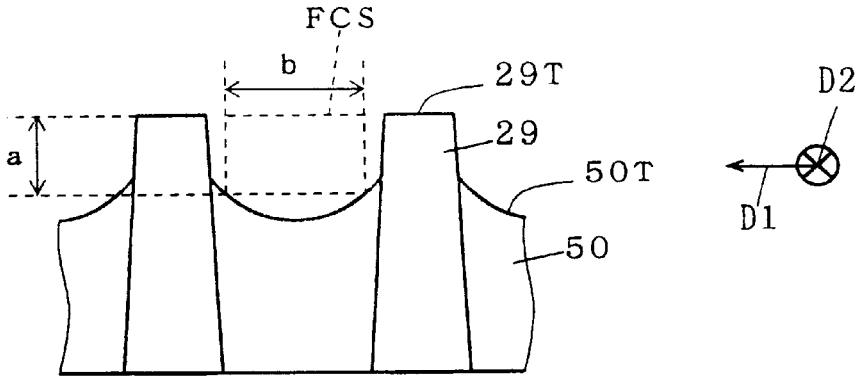

(g) FIG. 20 shows another example of the shape of the flow path section FCS with the second top portions 50T of the barrier ribs of the second type 50 having a concave surface curved inwards in the center, when the barrier ribs 29 and 50 are formed by the sand blast method as in the case (d).

In the cases (a) to (f), the length a of the flow path section FCS is found by (Hmain−Hsub) where the dimension Hsub is the maximum height of the barrier ribs of the second type 50. In the case (g), however, if the length a is defined by Hmain−Hsub), a slight discrepancy will be detected between the length a of the inscribed quadrangle having the maximum area and the value defined. This discrepancy, however, does not matter practically (within a tolerable range).

In the cases (a) to (g), since the sectional shape FCS formed according to the shapes of the barrier ribs of the first and second types 29 and 50 is preferably defined as a rectangle or square, or more practically as a space approximately in the shape of a rectangle or square, each of dimensions a, b, and L for the shape factor β may be decided with consideration for this point.

In this case, when the area of the maximum rectangle or square (generally defined as a quadrangle) inscribed in the flow path, as indicated by broken lines in FIGS. 14 to 20, is not less than $1.5\times10^{-4}$ $mm^2$, a similar effect as described with reference to FIG. 10 can be obtained.

Now, we will consider how to determine the height Hsub of the barrier ribs of the second type 50 to overcome the aforementioned problem (C).

The first top portions 29T of the barrier ribs of the first type 50 are formed almost in contact with the protective layer 18 in order to insure the isolation of the discharge occurring in each of the adjacent unit luminescent areas of different colors. Thus, the group of excited particles will not spread among the unit luminescent areas adjacent to each other with respect to the first direction D1.

If the group of excited particles has existed in the discharge space 30 since before gas discharge occurs, the probability of the occurrence of gas discharge will be sharply increased, and the gas discharge will spread in a short time. Thus, at a time when the priming discharge is induced in each discharge space 30, it is effective to form the barrier ribs of the second type 50 smaller in height than the barrier ribs of the first type 29 so as to facilitate the diffusion of the group of excited particles in the second direction D2.

Thus, in the PDP 1B according to the second preferred embodiment of the present invention, the barrier ribs of the second type 50 is formed smaller in height than the barrier ribs of the first type 29 as shown in FIG. 8. This permits the diffusion of the group of excited particles in the second direction D2, thereby improving luminance and insuring the occurrence of the priming discharge.

The problem here is how to determine the range of the difference in height (Hmain−Hsub) between the barrier ribs of the first and second types.

With consideration through examination, the inventors have found it effective to form both of the barrier ribs of the first and second types on the condition given by the following equation (2):

$$\text{When } K=a\cdot b/(p\cdot L),$$

$$K\geqq 0.03\ \mu\text{m/Torr} \qquad (2)$$

where a is found by (Hmain−Hsub); b is the distance between the opposite first and second side surface portions of the barrier ribs of the first type 29; L is the width of the barrier rib of the second type 50; and p is gas pressure.

K of the equation (2) is a parameter for determining ease of occurrence of the discharge, depending on the shape of the flow path. We hereinafter referred this parameter K as a discharge shape factor.

Although defined as (Hmain−Hsub) in the equation (2) of the discharge shape factor K for simplicity, a is a distance from the protective layer 18 on the first substrate 11 in the discharge space 30 to the upper surface of the barrier ribs of the second type 50. Each of dimensions a, b, and L is expressed by μm; and p is expressed by Torr, so that the discharge shape factor K is expressed by μm/Torr.

Figure 21:
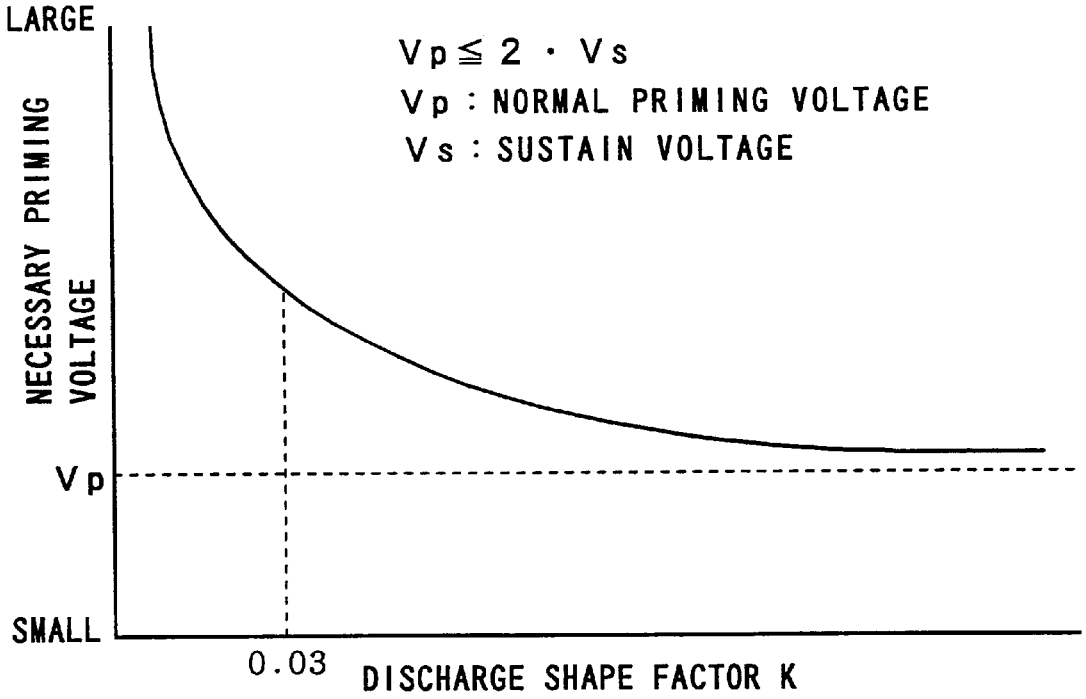
FIG. 21 shows a correlation between a discharge shape factor and substantially necessary priming voltage in the surface discharge type plasma display panel according to the second preferred embodiment

FIG. 21 shows the minimum applied voltage necessary for the priming discharge (hereinafter referred to as a priming voltage), at which the priming discharge will certainly occur in all the discharge spaces in the PDP 1B, with relation to the discharge shape factor K. The vertical axis indicates the priming voltage; and the horizontal axis indicates the discharge shape factor K,.

With reference to FIG. 21, when the discharge shape factor K is not less than 0.03 μm/Torr, the priming voltage necessary for this device can be set to be almost within the range of a normal priming voltage Vp (usually not more than twice as much as a sustain voltage Vs) as obtained in the conventional structure shown in FIG. 61. However, when the discharge shape factor K becomes less than 0.03 μm/Torr, the priming voltage necessary for this device rapidly increases. Such rapid increase in necessary priming voltage causes a problem of circuit structure which will be described later, and a problem that a big flow of discharge current occurs in any local one out of all discharge spaces, thereby threatening the stability in performance of the discharge spaces. We will now describe this in detail.

The state where the discharge shape factor K is 0.03 μm/Torr, corresponds to an inflection point of the Vp-K curve in FIG. 21. The necessary priming voltage for the discharge shape factor K of 0.03 μm/Torr is about twice as large as a normal sustain voltage Vs (for example, about a hundred and dozens V), that is, about 300 V.

Thus, in an area corresponding to the discharge shape factor K of less than 0.03 μm/Torr, that is, an area requiring the priming voltage of, for example, more than 300 V, the necessary priming voltage rapidly increases as shown in FIG. 21, causing problems as follows:

(I) Since the effect of the priming discharge is significantly affected by the condition of the diffusion of ions or electrons, too high priming voltage may cause (a) increase in dark luminance; (b) easy occurrence of discharge (in this case, for example, emission of orange light by Ne) between portions on an extension of electrodes outside the display areas within the panel (for example, where the phosphors are not coated). Further, (c) metal atoms constituting metal terminals of a flexible printed circuit board (hereinafter referred to as a FPC) for connecting the panel and the external drivers may be diffused into insulators of the FPC between the metal terminals, so that the insulators of the FPC become conductive (in extreme case, a short may occur therebetween). Thus, stability in operation or longevity of the PDP will be deteriorated.

(II) Since a breakdown voltage of normal FET elements is about 500 V, if the priming voltage necessary for each driving circuit 141, 142 or the like shown in FIG. 1 exceeds about 300 V, a voltage 1.5 times as large as the necessary priming voltage will not be expected as a safety factor. From this point, the necessary priming voltage needs to be about less than 300 V.

(III) Further, a safety factor for the breakdown voltage (usually about 500 V) of the dielectric layer 17 in FIG. 4 will not be expected as well.

(IV) Since the FET elements having the breakdown voltage of more than 500V are expensive, the use of such elements increases manufacturing cost.

Accordingly, the discharge shape factor K of not less than 0.03 μm/Torr makes it possible to achieve the plasma display device resolving the aforementioned problems (I) to (IV) and achieving stable operation and high endurance.

In the equation (2), only if the discharge shape factor K is not less than 0.03 μm/Torr, any combination of the measurements a, b, p, and L is possible to the extent that the measurement a ranges from 200 to 300 μm; b from 10 to 20

μm; p from 300 to 600 Torr (which is pressure of Ne—Xe gas (Penning gas) including 1 to 15 mol % of Xe); and L from 50 to 500 μm. In this case, the priming voltage is stabilized, which leads to a fine write operation following the priming discharge while improving luminance.

The value of each of measurements a, b, and L except the measurement p for the discharge shape factor K may be decided with consideration for the fact that the sectional shape FCS of the flow path formed according to the shapes of the barrier ribs of the first and second types 29 and 50, is preferably specified as a rectangle or square, or more practically as a space approximately in the shape of a rectangle or square. Namely, they may be decided in the similar way to the aforementioned exhaust conductance C.

3. Third Preferred Embodiment

Figure 66:
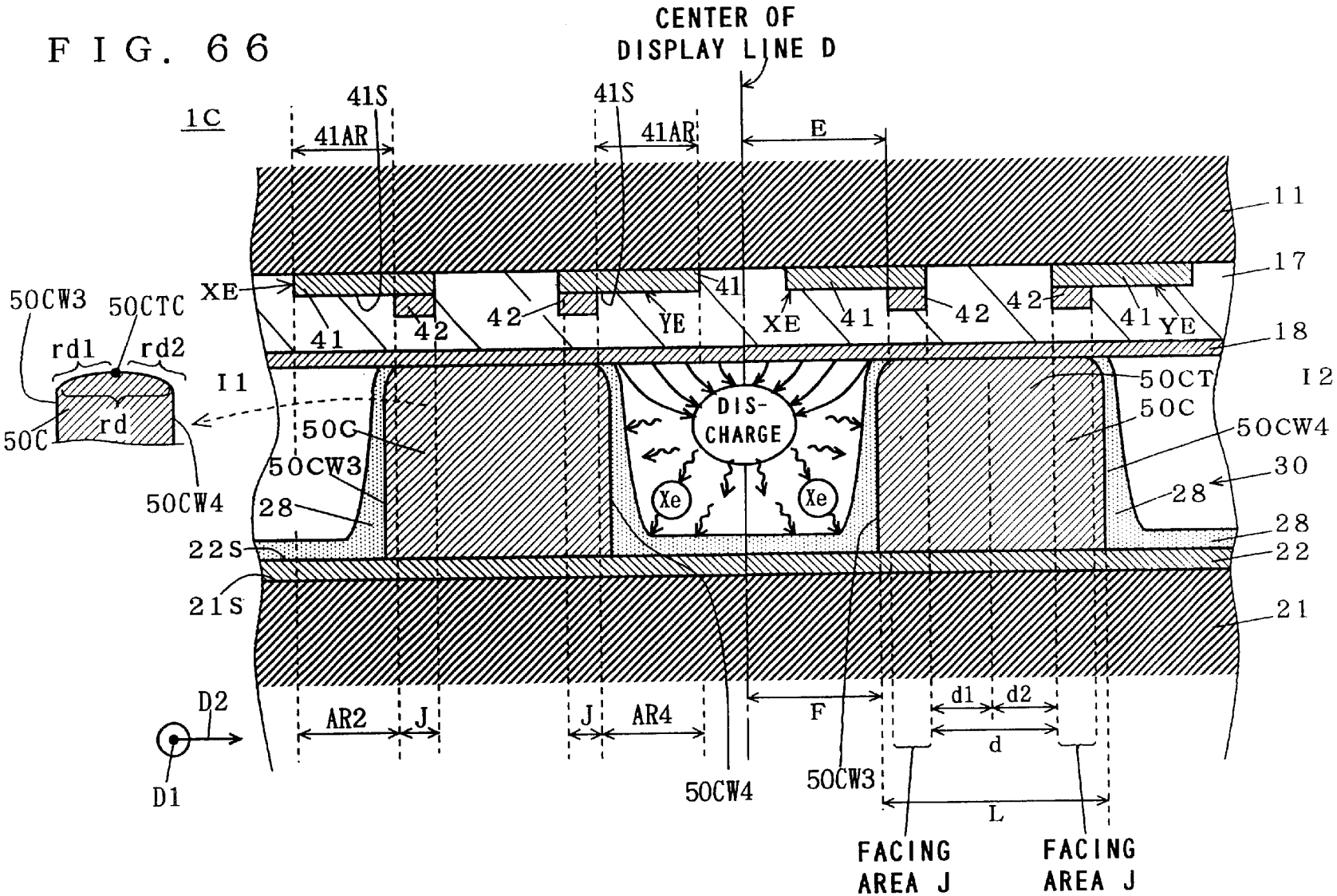
FIGS. 66 to 80 are longitudinal sectional views showing modifications.

A third preferred embodiment of the present invention is a modification of the aforementioned first and second preferred embodiments, focusing on the arrangement of the barrier ribs of the second type 50. For convenience of description we will describe a modification of the PDP 1B of the second preferred embodiment. This modification is of course applicable to the PDP 1A of the first preferred embodiment, and the same effect which will be described later, will be obtained (see FIG. 66).

Figures 22A, 22B:
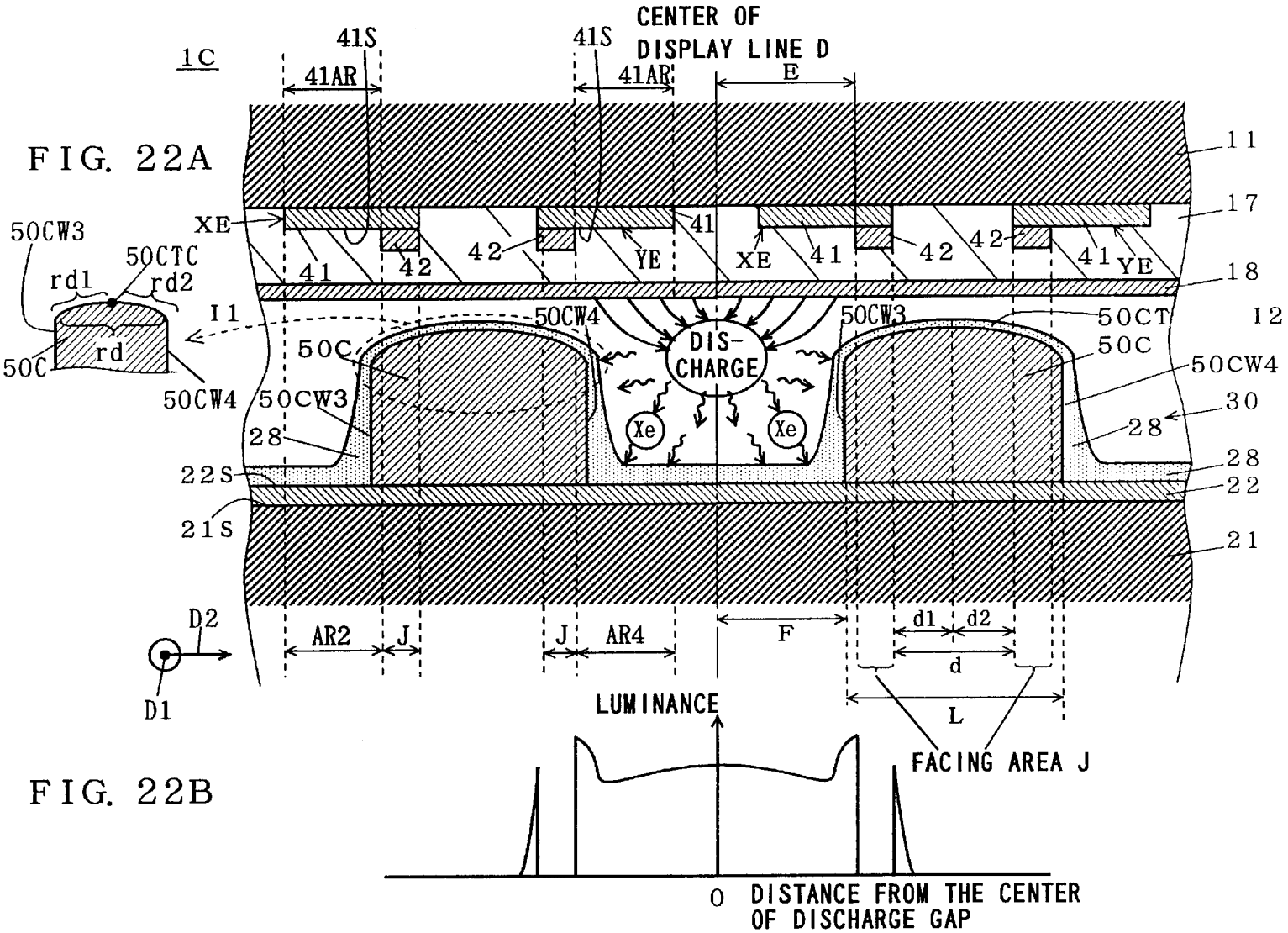
FIG. 22A is a longitudinal sectional view schematically showing arrangement of each electrode and the second barrier ribs, and the effect thereof, in a surface discharge type plasma display panel according to a third preferred embodiment of the present invention.
FIG. 22B shows a distribution of luminance with respect to FIG. 22A.

FIG. 22A is a longitudinal sectional view showing the outline of a sectional structure of a PDP IC according to the third preferred embodiment (a section is orthogonal to the first direction D1 along the center of the A electrode 22, that is, taken along the line I1–I2 in FIG. 8). In FIG. 22, the same reference numerals or characters indicates the same components as those in FIG. 13.

In this preferred embodiment, the arrangement of barrier ribs of the second type 50C differs from that of the barrier ribs of the second type 50 in FIG. 13. The barrier ribs of the second type 50C are provided (a) right under respective metal electrodes (or bus electrodes) 42 of an X electrode XE of a display line D and a Y electrode YE of a different adjacent display line (along the second direction D2), on an opposing surface 21S of the second substrate 21 and on an upper surface 22S of the A electrode 22 (along the first direction D1); or (b) right under respective metal electrodes 42 of a Y electrode YE of the display line D and an X electrode XE of a different adjacent display line (along the second direction D2), on the opposing surface 21S of the second substrate 21 and on the upper surface 22S of the A electrode 22 (along the first direction D1). FIG. 22 illustrates a case having both of (a) and (b).

In other words, a third side surface portion 50CW3 of the barrier rib of the second type 50C is provided on a second area AR2 of the opposing surface 21S of the second substrate 21 and the upper surface 22S of the A electrode 22, facing an area 41AR (or a surface 41S) of the transparent electrode 41 of the X electrode XE of the display line D on which the metal electrode 42 is not formed. Out of a ridge rd of a second top portion 50CT of the barrier rib of the second type 50C, a first ridge portion rd1 from the boundary with the third side surface portion 50CW3 to the top of the ridge 50CTC, faces the X electrode XE of the display line D and a gap d (more specifically a first gap d1) between the X electrode XE of the display line D and the Y electrode YE of the adjacent display line.

A fourth side surface portion 50CW4 of the barrier rib of the second type 50C is provided on a fourth area AR4 of the opposing surface 21S of the second substrate 21 and the upper surface 22S of the A electrode 22, facing the area 41AR (or the surface 41S) of the transparent electrode 41 of the Y electrode YE of the display line D on which the metal electrode 42 is not formed. Out of the ridge rd of the second top portion 50CT of the barrier rib of the second type 50C, a second ridge portion rd2 from the boundary with the fourth side surface portion 50CW4 to the top of the ridge 50CTC faces the Y electrode YE of the display line D and a gap d (more specifically a second gap d2) between the Y electrode YE of the display line D and the X electrode XE of the adjacent display line.

Accordingly, the phosphors 28 adhering to the third and fourth side surface portions 50CW3 and 50CW4 protrude in the discharge space for the display line D specified between a portion of the protective layer 18 and a portion of the opposing surface 21S of the second substrate 21 which face the respective areas 41AR of the transparent electrodes 41, on which the metal electrodes 42 are not formed, of the X and Y electrodes XE and YE.

We will now describe why the width L of the barrier ribs of the second type 50C on the opposing surface 21S of the second substrate 21 and the upper surface 22S of the A electrode 22 is enlarged beyond the range given by the gap d (=d1+d2 where d1=d2), so as to face the X and Y electrodes XE and YE of the different display lines on both sides of the gap d.

Figures 63A, 63B:
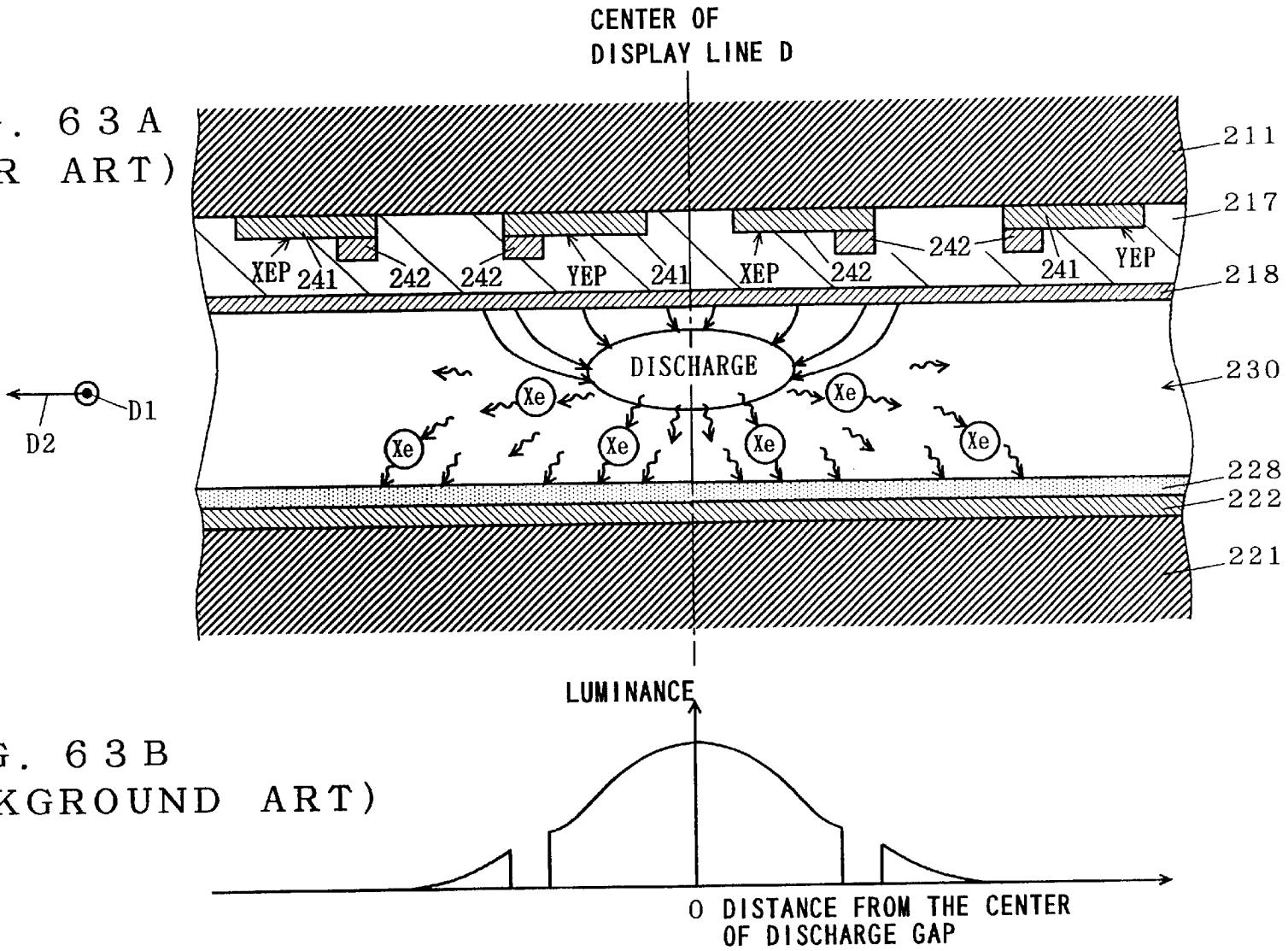
FIG. 63A (PRIOR ART)
FIG. 63B (BACKGROUND ART)
FIG. 63A is a longitudinal sectional view schematically showing arrangement of each electrode and barrier rib in the surface discharge type plasma display panel according to the conventional technique.
FIG. 63B shows a distribution of luminance with respect to FIG. 63A.
Figure 64:
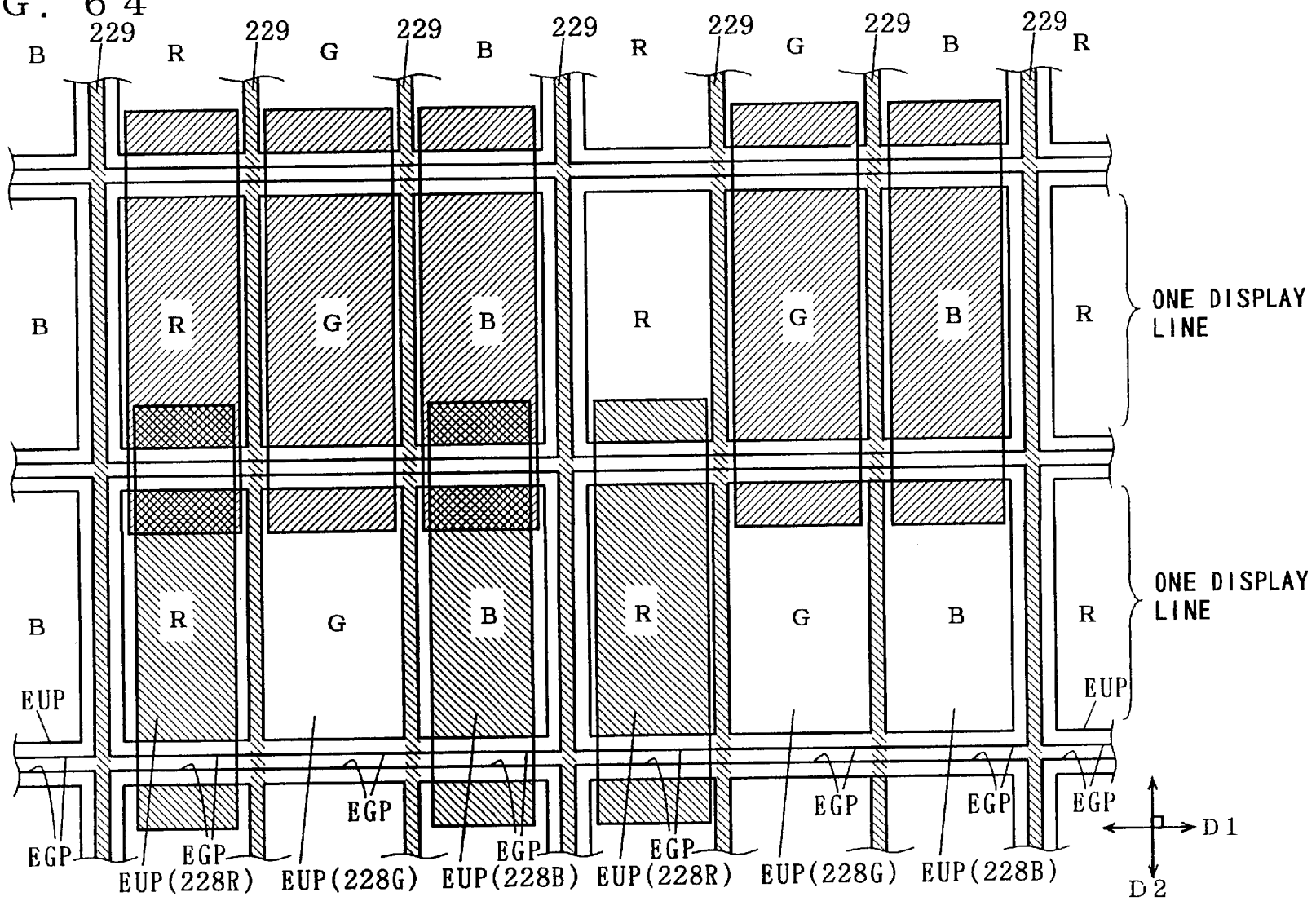
FIGS. 64 and 65 are perspective plan views schematically showing problems of the conventional technique.
Figure 65:
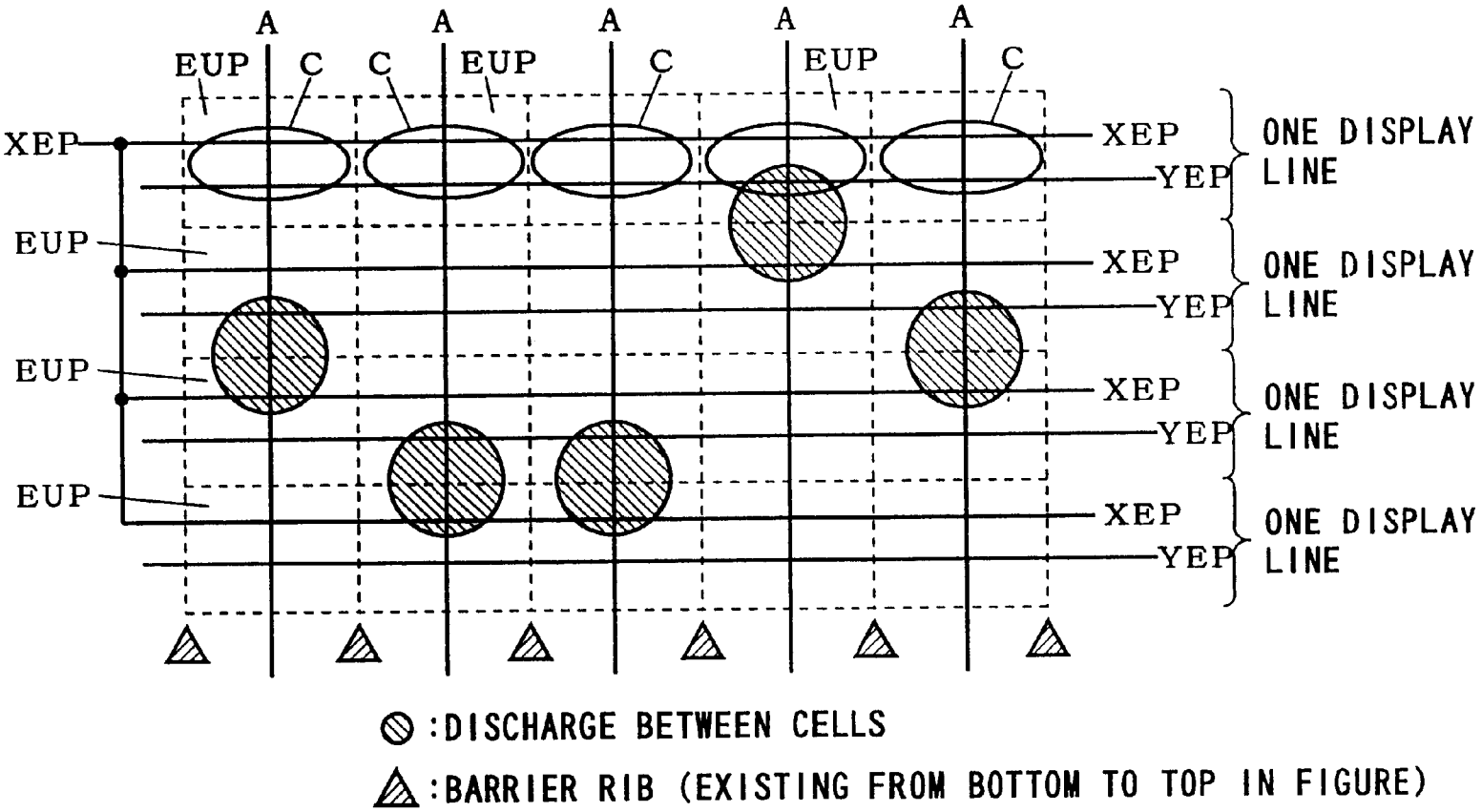

Discharge occurring between the X and Y electrodes XE and YE spreads beyond the physical arrangement of the X and Y electrodes XE and YE. Namely, the discharge between the X and Y electrodes XE and YE occurs not only between the transparent electrodes 41 of the X and Y electrodes XE and YE but also in a portion of the discharge space 30 which is right under the metal electrodes 42 thereof via discharge gas ions being in the discharge space 30 (see FIGS. 7 and 63).

However, luminescence caused by the discharge occurring right under the metal electrodes 42 does not reach the display surface S because of the presence of the optically opaque metal electrodes 42 over the surface. Thus, the luminescence become the unnecessary light. Namely, electric power supplied for the discharge occurring in the discharge space 30 being right under the metal electrode 42 is considered as a substantial loss of electricity. This power loss will be suppressed by preventing the occurrence of discharge in the discharge space 30 being right under the metal electrode 42, that is, in a space facing the metal electrodes 42, between the protective layer 18 and the second top portion 50CT.

In this preferred embodiment, as shown in FIG. 22A, the width L of the barrier rib of the second type 50C is enlarged so as to face the respective metal electrodes 42 of (a) the X electrode XE of the display line D and the Y electrode YE of the adjacent display line; or (b) the Y electrode YE of the display line D and the X electrode XE of the adjacent display line. Thus, excited atoms or molecules collide with this enlarged barrier rib of the second type 50C, and return to their ground state. This causes a loss of energy, thereby suppressing the flow of discharge current. Namely, discharge will hardly occur in the discharge space 30 being right under the metal electrodes 42, which suppresses an empty loss of electricity. As a gap between the second top portion 50CT of the barrier rib of the second type 50C and the surface of the protective layer 18 just above the second top portion 50CT decreases, that is, the height of the barrier rib of the second type 50C increases, the number of collisions is increased, which further suppresses the flow of discharge current.

In the following description, an area (first area) of the opposing surface 21S of the second substrate 21 and the upper surface 22S of the A electrode 22, facing the metal electrode 4A of the X electrode XE, is called a facing area J. Further, an area (third area) of the opposing surface 21S of the second substrate 21 and the upper surface 22S of the A electrode 22, facing the metal electrode 42 of the Y electrode YE, is also called the facing area J.

Namely, as shown in FIG. 22A, when the inequality E≧F is satisfied where E is the shortest distance from the center of the display line D to the metal electrode 42; and F is the shortest distance from the center of the display line D to the side surface portions 50CW3 and 50CW4 of the barrier rib of the second type 50C, the occurrence of discharge right under the metal electrodes 42 in the discharge space 30 can be certainly prevented as described above. In other words, when the width L of the barrier rib of the second type 50C includes the facing areas J, the discharge in a space facing the metal electrodes 42 between the protective layer 18 and the second top portion 50CT of the barrier rib of the second type 50C can be certainly suppressed as described above.

Further, since the phosphors 28 adhering to the third and fourth side surface portions 50CW3 and 50CW4 of the adjacent barrier ribs of the second type 50C protrude in a space specified by the distance F as previously described, a traveling distance of ultraviolet rays to the phosphors 28 is reduced. This speeds up absorption of ultraviolet rays, thereby improving luminous efficiency.

Figure 67:
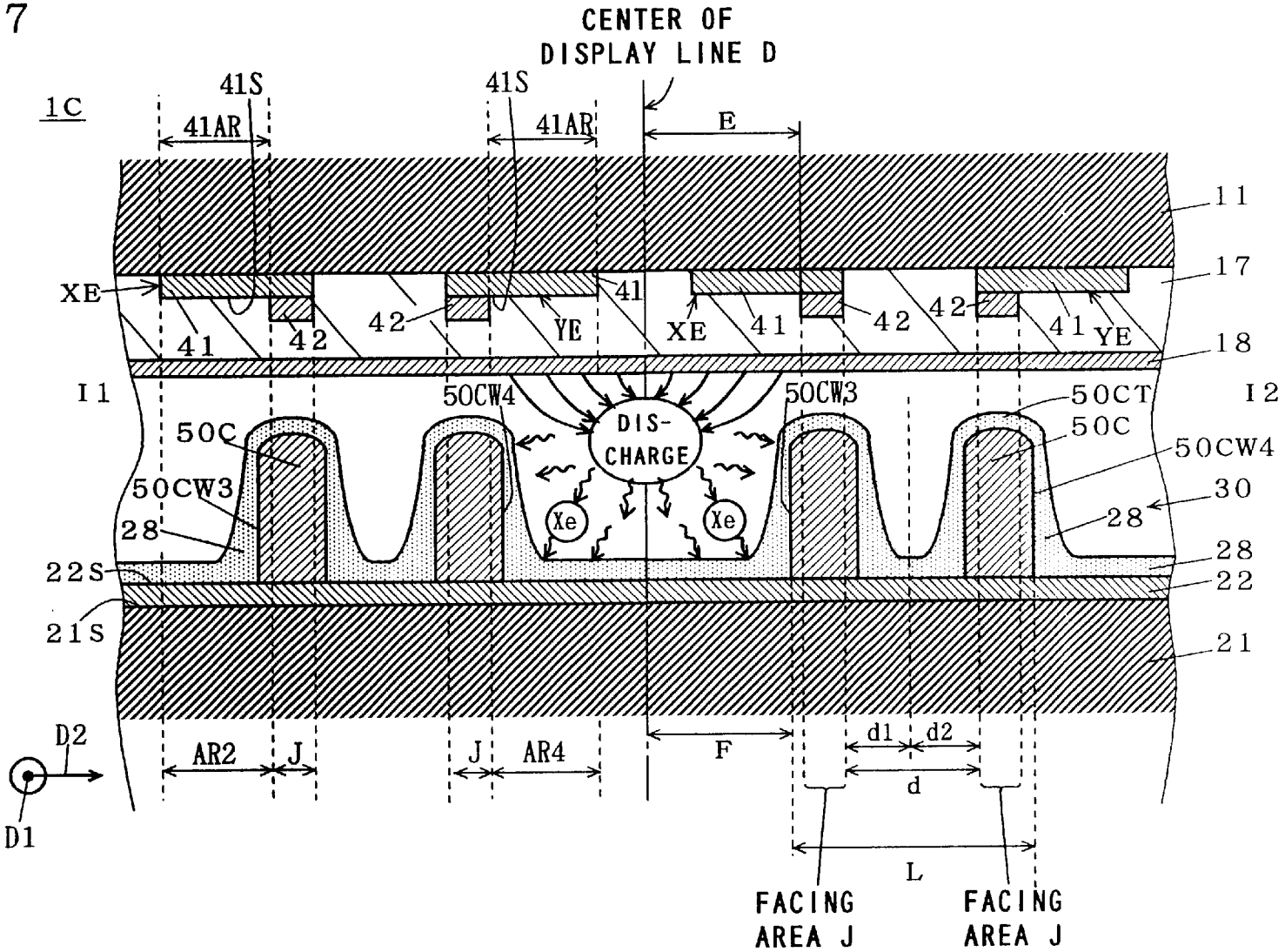

While one barrier rib of the second type 50C is provided on the areas of the opposing surface 21S of the second substrate 21 and the upper surface 22S of the A electrode 22, facing both of the adjacent metal electrodes 42 in FIG. 22A, the barrier rib of the second type 50 may be provided for each facing area J (see FIG. 67). In that case, the same effect may be obtained.

Figure 68:
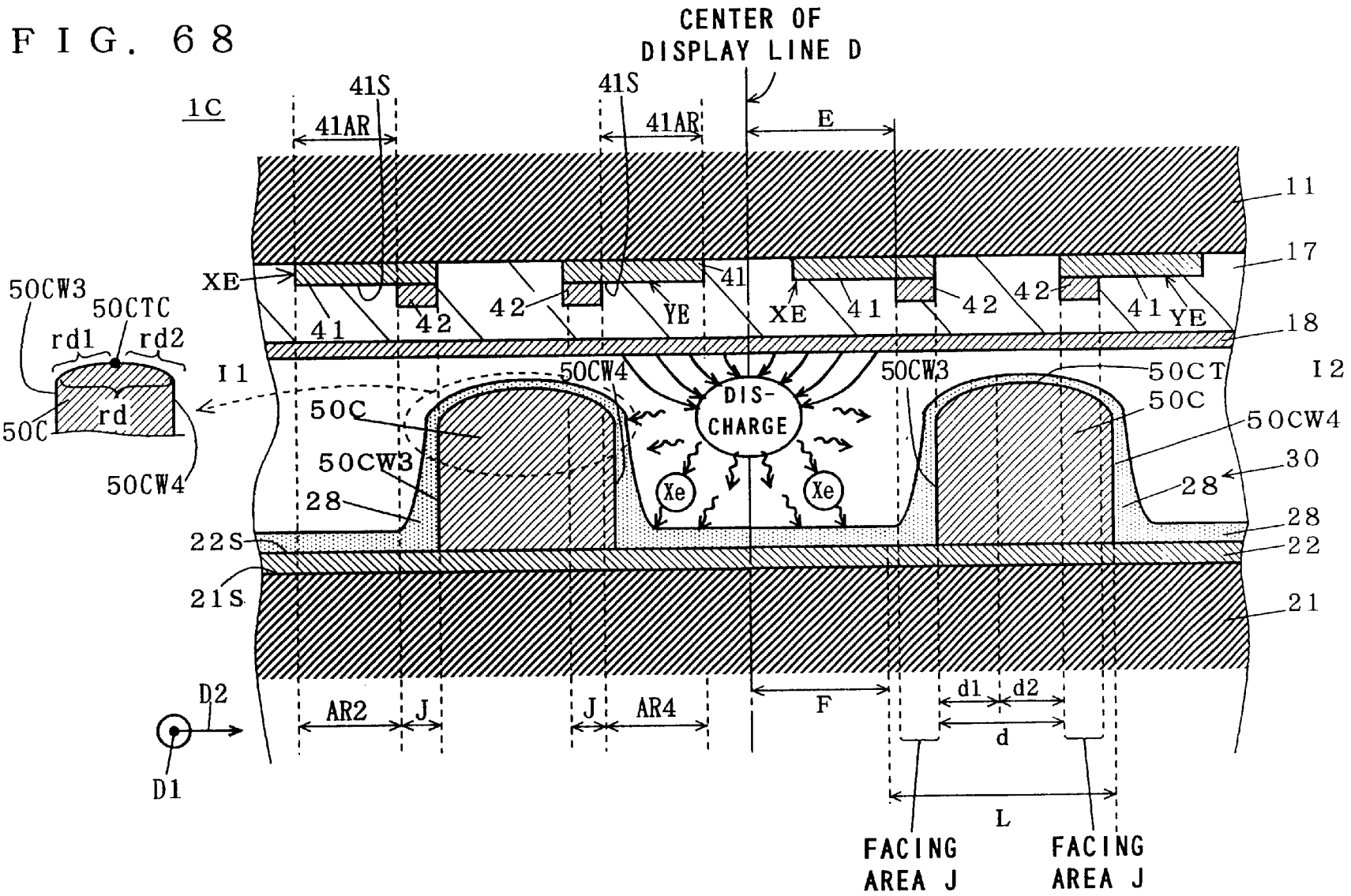
Figure 69:
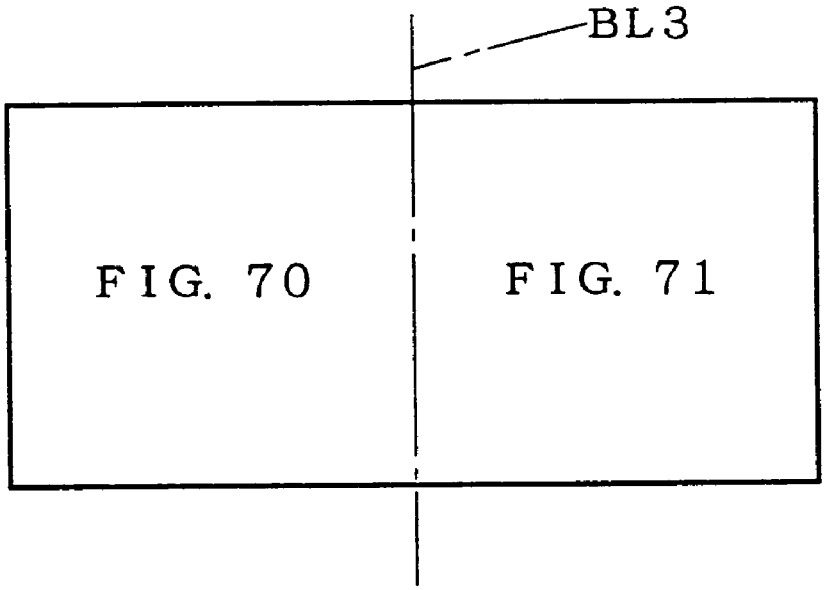
Figure 70:
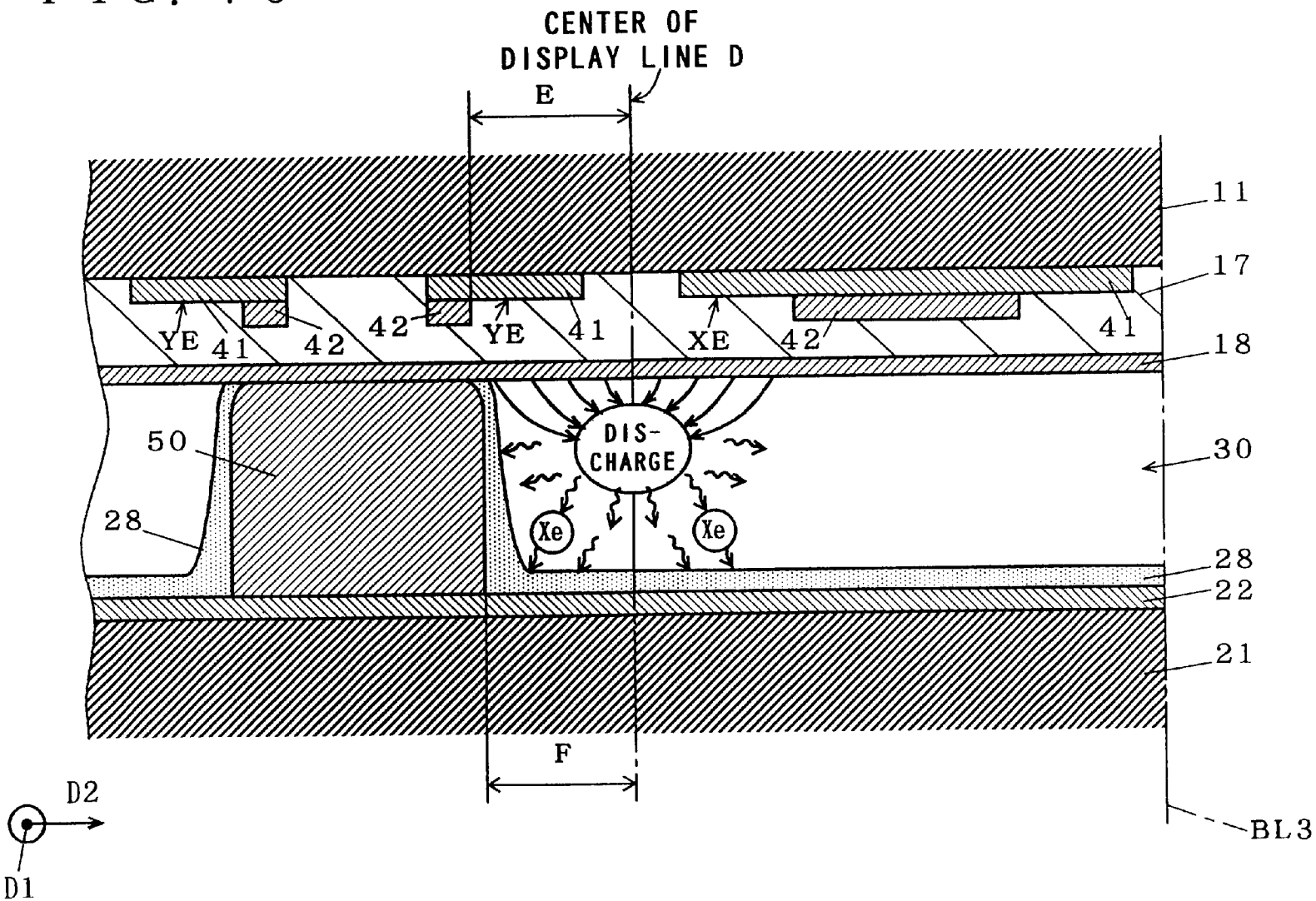
Figure 71:
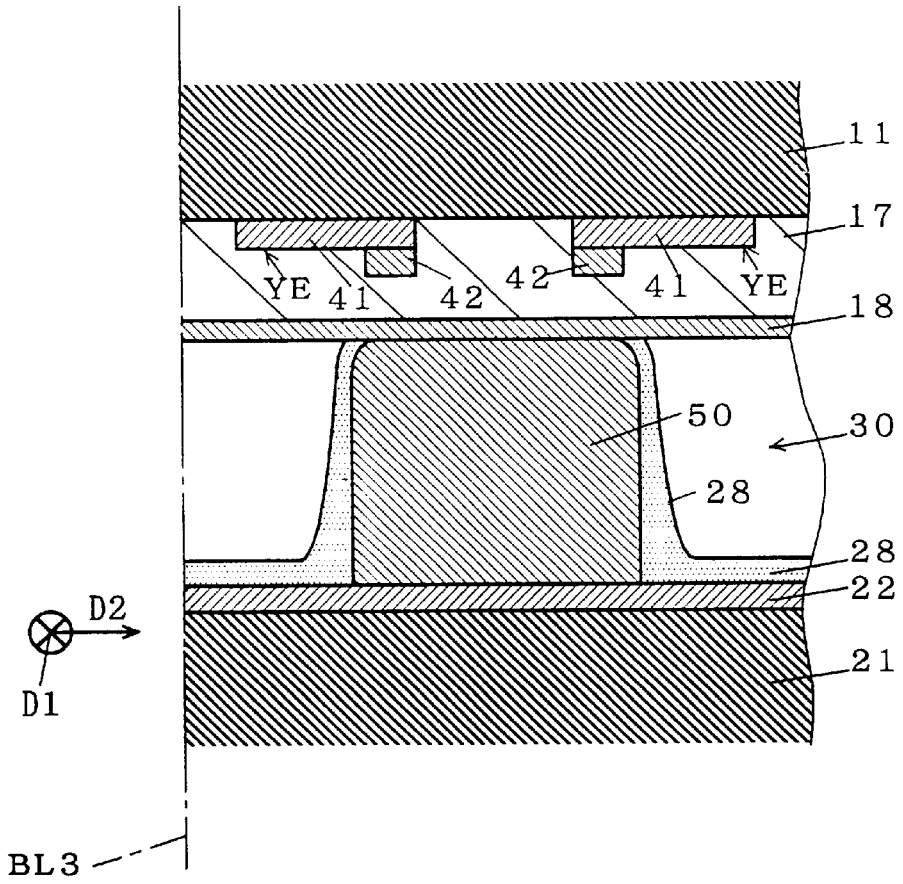
Figure 72:
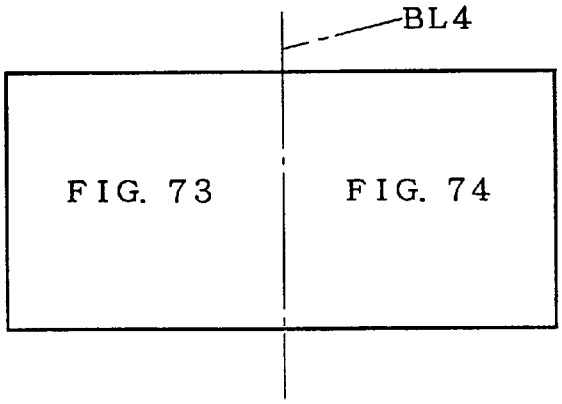
Figure 73:
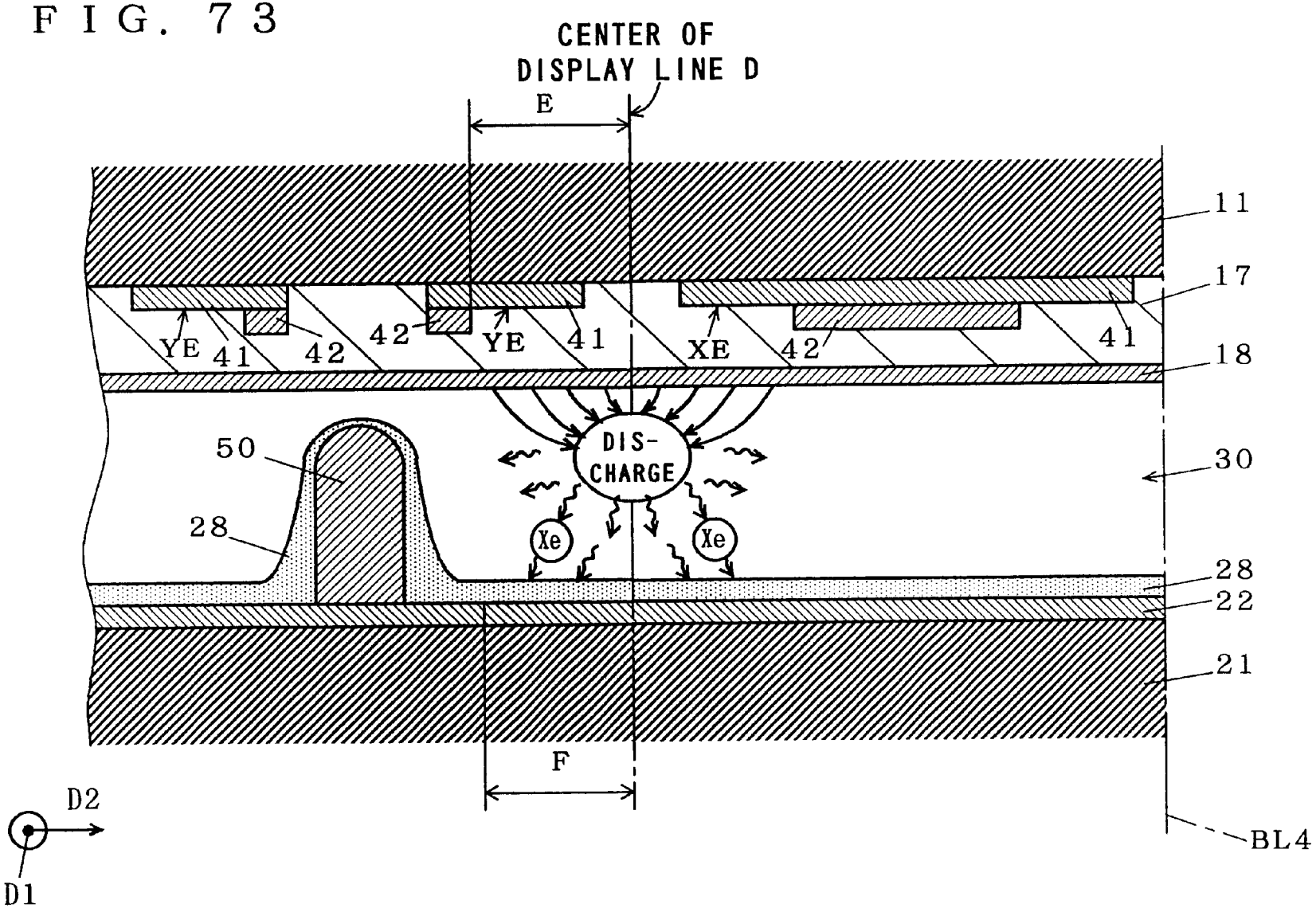
Figure 74:
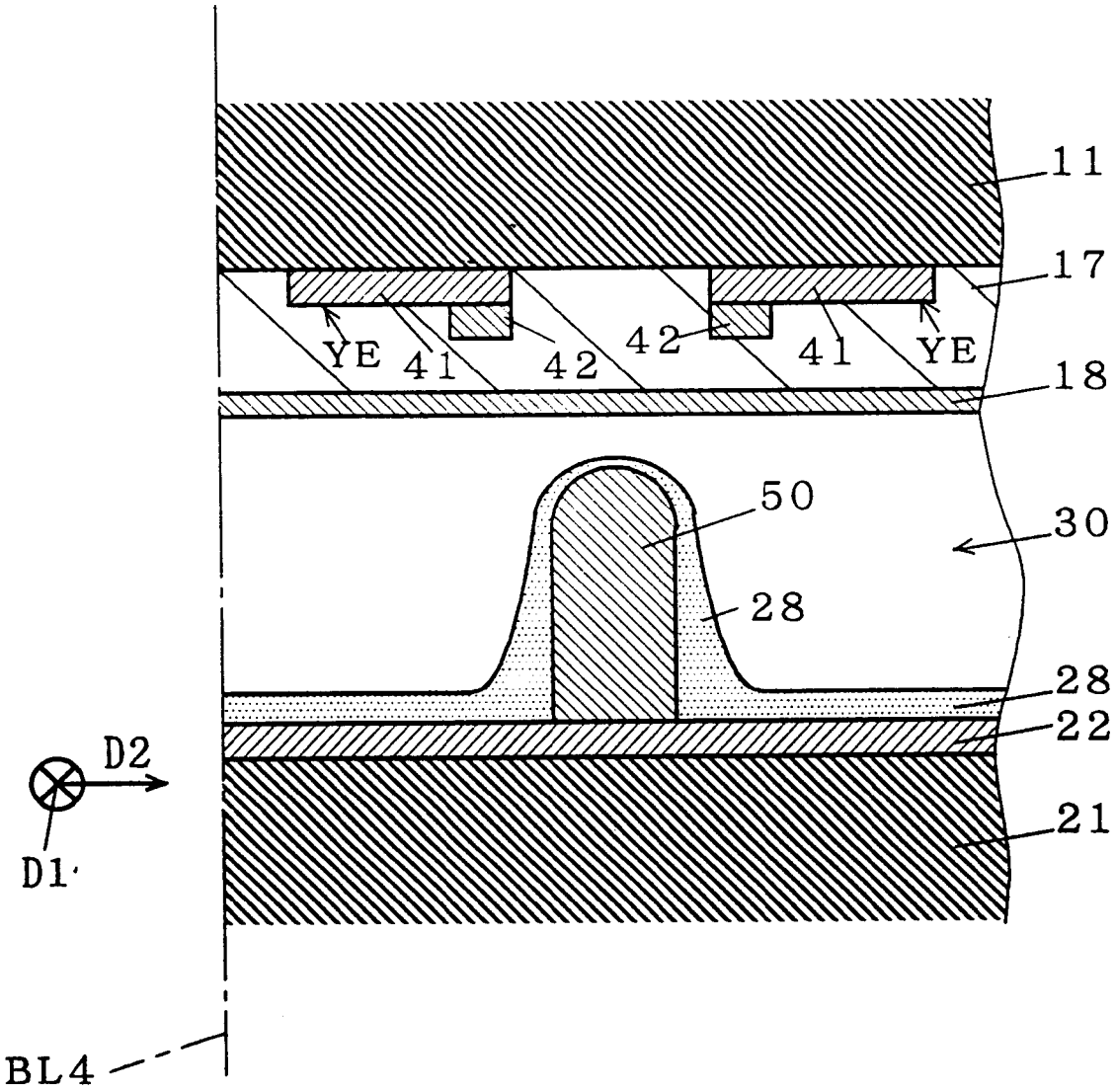
Figure 75:
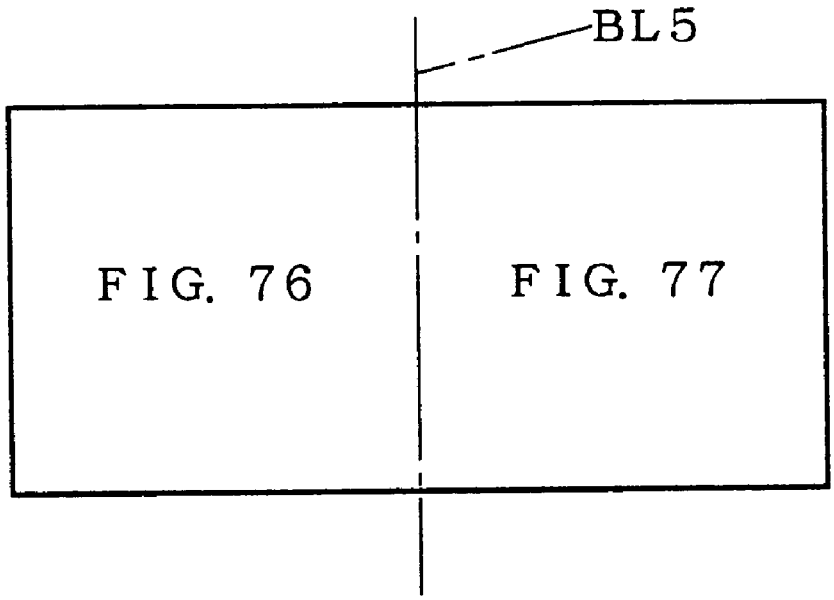
Figure 76:
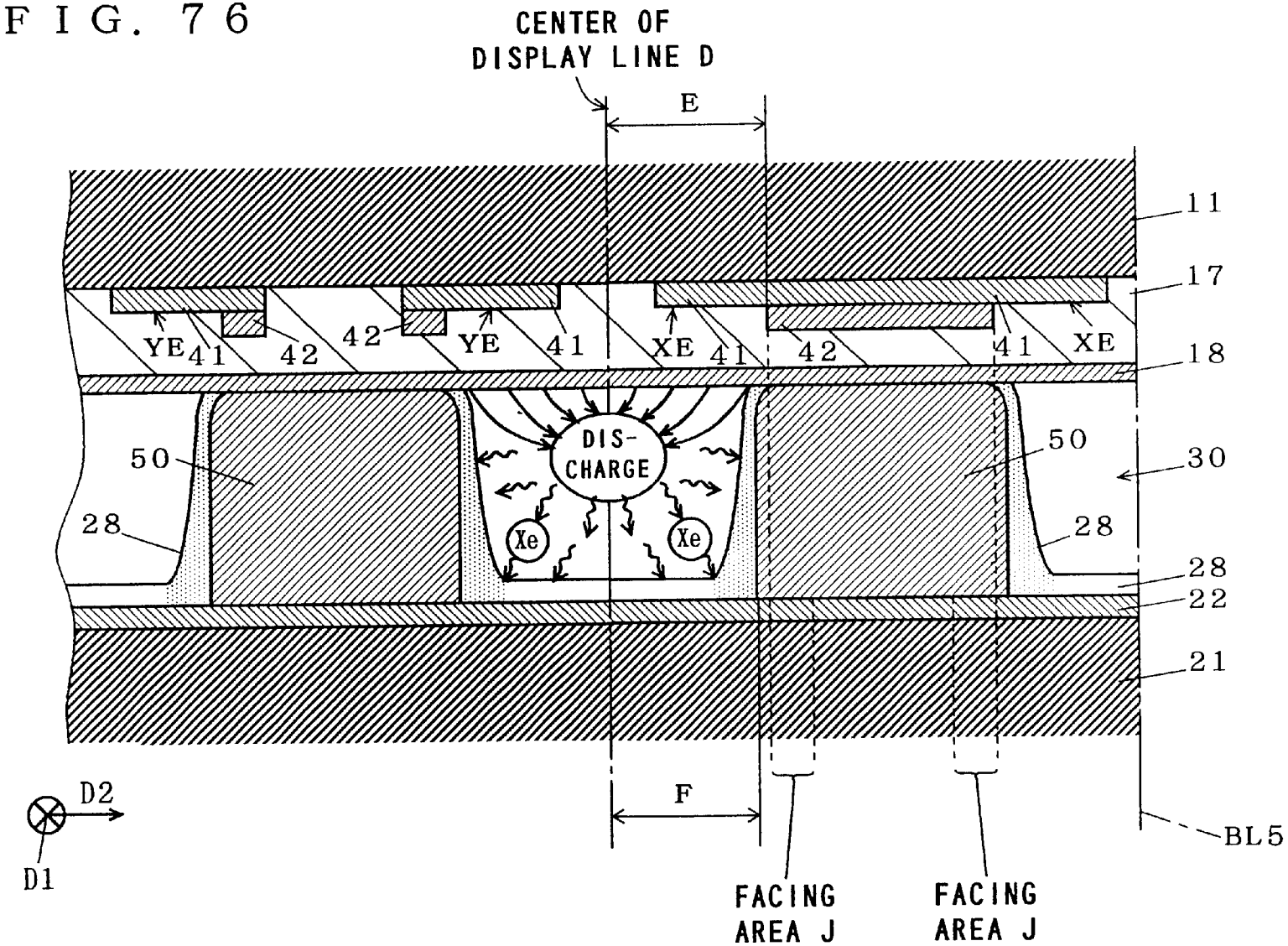
Figure 77:
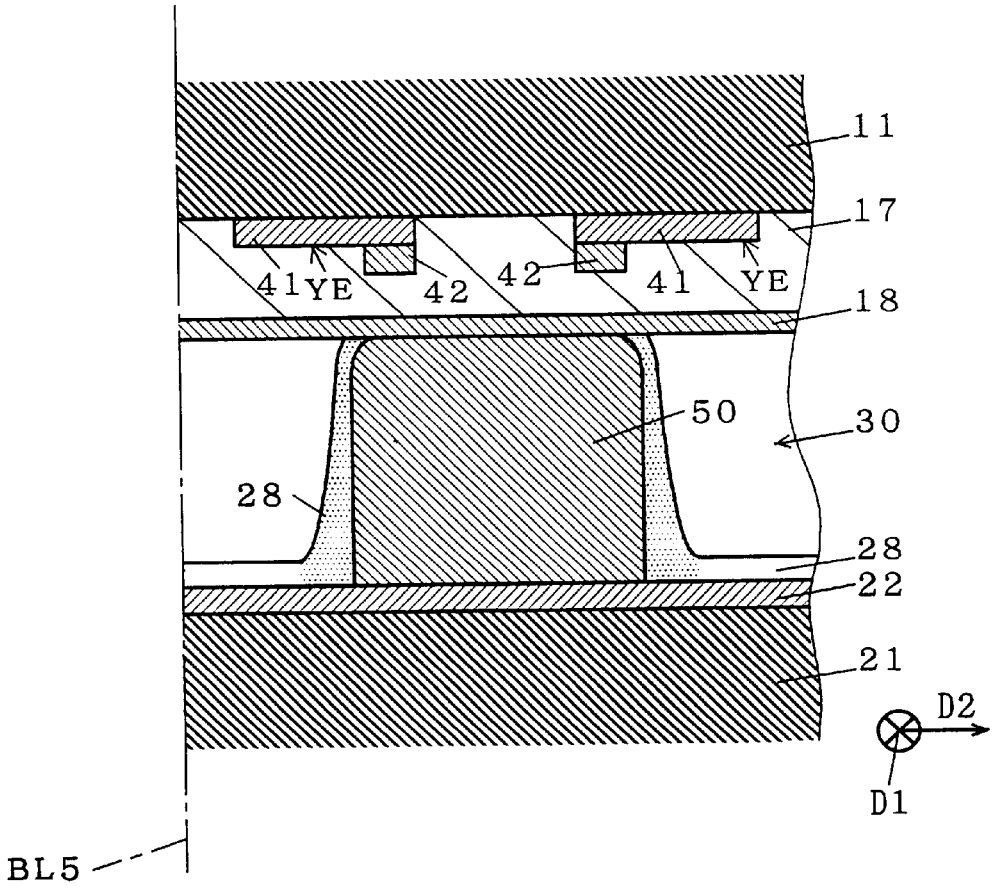
Figure 78:
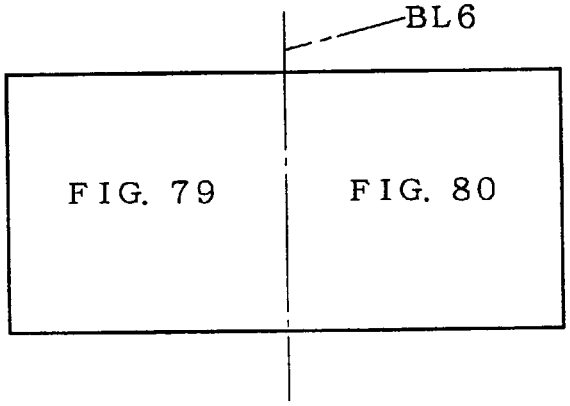
Figure 79:
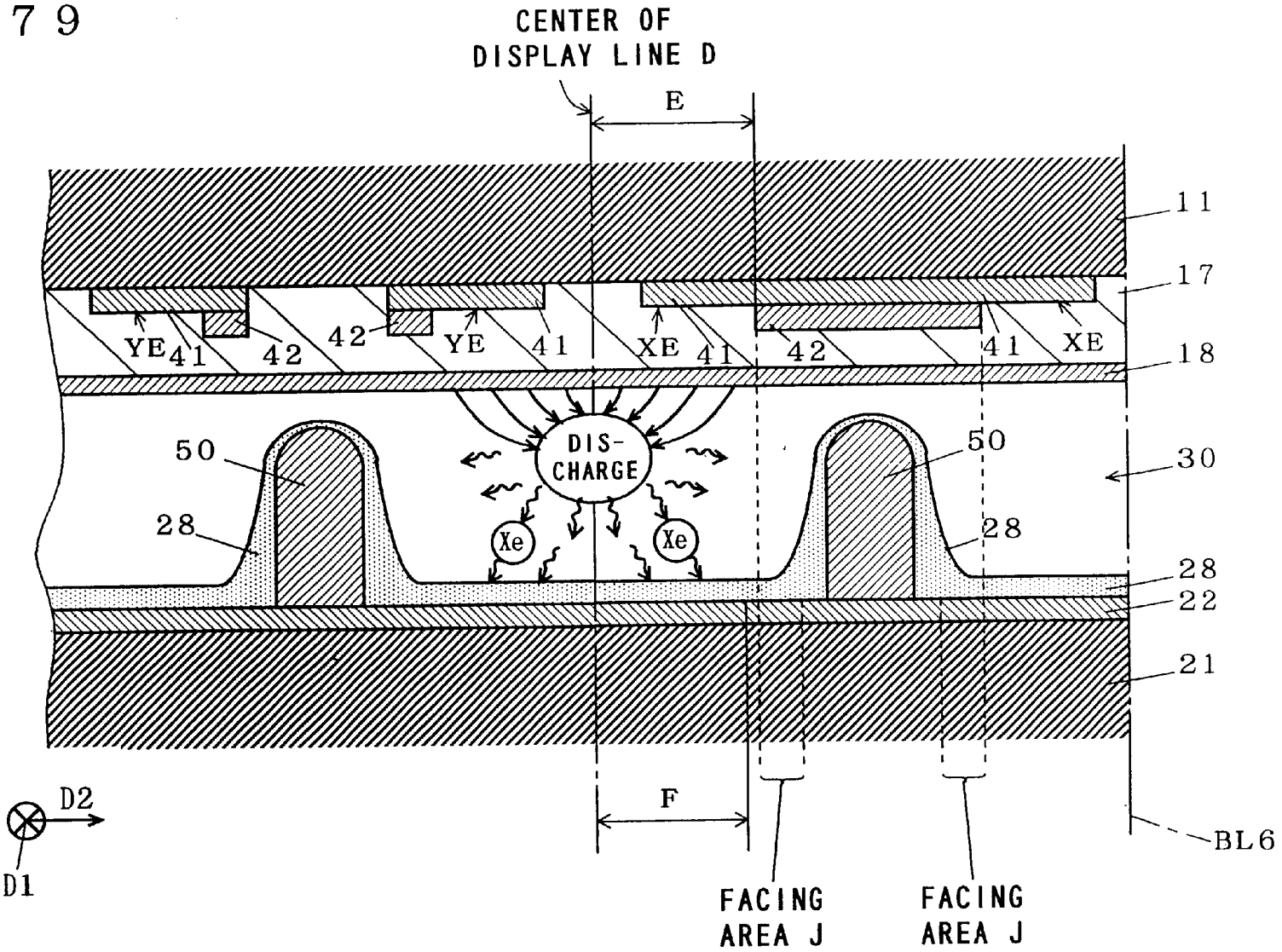
Figure 80:
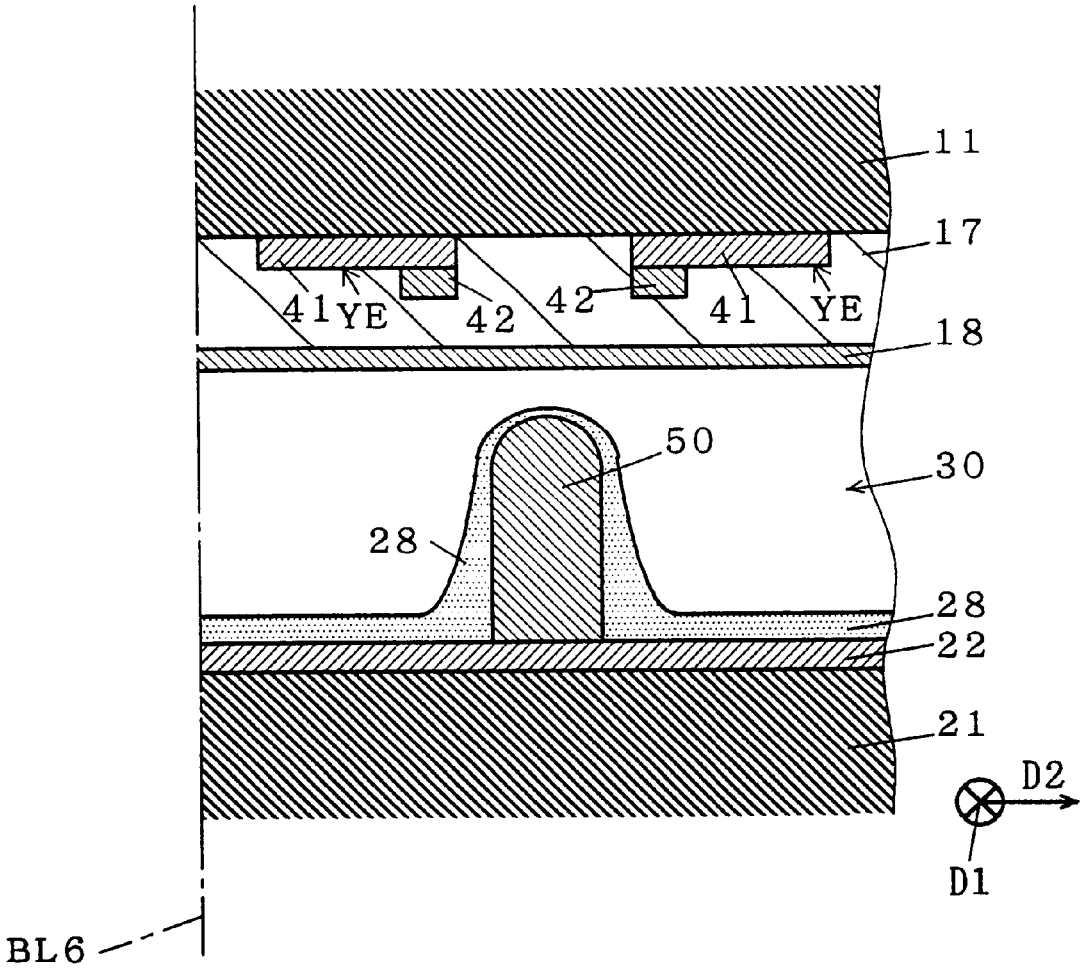

Further, only either of the third or fourth side surface portion 50CW3 or 50CW4 of the barrier rib of the second type 50C may be formed as described above, and the other may be formed not to include the facing area J as the side surface portion of the barrier rib of the second type 50 in FIG. 13A (see FIG. 68). In this case, the same effect may be obtained at the one of the side surface portion including the facing are J.

In the PDP having a structure as described above, gas discharge does not occur right under the metal electrodes 42, more specifically, on the portion of the surface of the protective layer 18 facing the metal electrodes 42, and gas discharge only occurs between the transparent electrodes 41 except where the metal electrodes 42 are formed. This somewhat reduces luminance (see FIG. 22B), but substantially improves luminous efficiency (that is, (light output/introduced power)) since the discharge current does not flow into the metal electrodes 42. Further, by increasing the width L of the barrier rib of the second type 50C larger than the width of the barrier rib of the second type 50 in FIG. 13A, an alignment margin in sticking the first and second substrates 11 and 21 together can be increased.

4. Modifications Common to First to Third Preferred Embodiments 4-1. First Modification While the phosphors 28 are formed on the second substrate 21 and the A electrodes 22 in the first to third preferred embodiments, alternatively, an underlying layer including glass components or the like may be formed on the second substrate 21. Then, the respective A electrodes 22 may be formed on the surface of the underlying layer, and further the phosphors may be formed thereon. In this case, the underlying layer and the second substrate 21 can be defined as the "second substrate", and the surface of the underlying layer as the "opposing surface of the second substrate".

The essential thing is to form the phosphors 28 on a surface facing the X and Y electrodes XE and YE in a direction from the first substrate 11 to the second substrate 21. As long as this is satisfied, the same effect as described in the first to third preferred embodiments can be obtained.

Further, the upper surface of the respective A electrodes 22 formed on the second substrate 21 may be covered by an insulator. Although the barrier ribs of the first and second types and the phosphors are formed on the insulator in this case, still the same effect as previously described can be obtained. In this case, the second substrate 21 and the insulator is considered as the "second substrate" including the A electrodes 22, and the surface of the insulator as the "opposing surface of the second substrate".

Taking the arrangement of the A electrodes 22 described in the first to third preferred embodiments and this modification into consideration, it is said that the second substrate comprises a plurality of A electrodes 22 each of which is arranged along the second direction so as to be positioned between the adjacent barrier ribs of the first type.

4-2. Second Modification

While the barrier ribs of the first type 29 extend along the second direction D2 and the barrier ribs of the second type 50 extend along the first direction D1 in the first to third preferred embodiments, this arrangement relation may be reversed. Namely, the barrier ribs of the first type 29 may extend along the first direction D1, and the barrier ribs of the second type 50 may extend along the second direction D2 to be orthogonal to the barrier ribs of the first type 29. However, the arrangement of the X, Y, and A electrodes XE, YE, and 22 should be the same as in the first to third preferred embodiments. Namely, the X and Y electrodes XE and YE extend along the first direction D1, and the A electrodes 22 extend along the second direction D2. The arrangement of the phosphors 28 of the same color adhering to such barrier ribs of the first and second types 29 and 50 must be reversed from the second direction D2 to the first direction D1, in accordance with the reversed positions of both barrier ribs 29 and 50.

Figure 23:
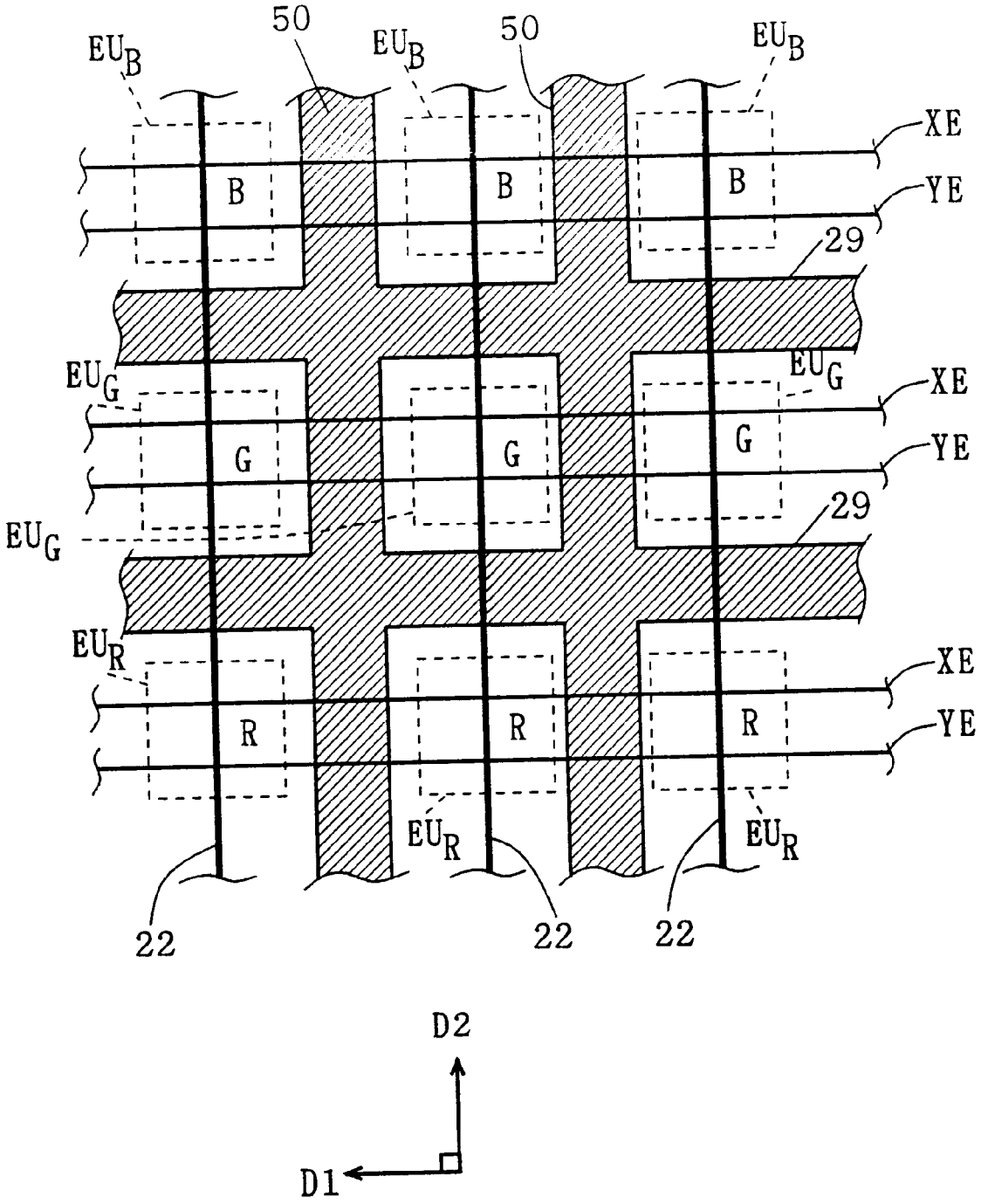
FIG. 23 is a perspective plan view schematically showing arrangement of each electrode and barrier rib in the surface discharge type plasma display panel according to a modification of the first to third preferred embodiments.

FIG. 23 is a perspective plan view schematically showing a structure of this modification.

In this modification shown in FIG. 23, since the display lines extend in parallel with each other along the second direction D2, the address pulses to be sequentially applied to the respective A electrodes 22 are generated at the write process of the PDP on the basis of image data for the same color of sequentially adjacent different pixels. Thus, in the case of FIG. 23, when the shape of a screen is a rectangle, the number of scanning lines is increased, which lengthens a writing period.

4-3. Third Modification

In the first to third preferred embodiments, two barrier ribs of the second type 50(50C) of the same material, shape and size are provided facing each other on both sides of any unit luminescent area EU. By the way, at each location, each of the barrier ribs of the second type 50 achieves the aforementioned effects: (1) improvement in luminous efficiency (reduction in loss of ultraviolet rays); (2) reduction of the leakage of luminescence; and (3) suppression of the leakage of discharge.

Figure 24:
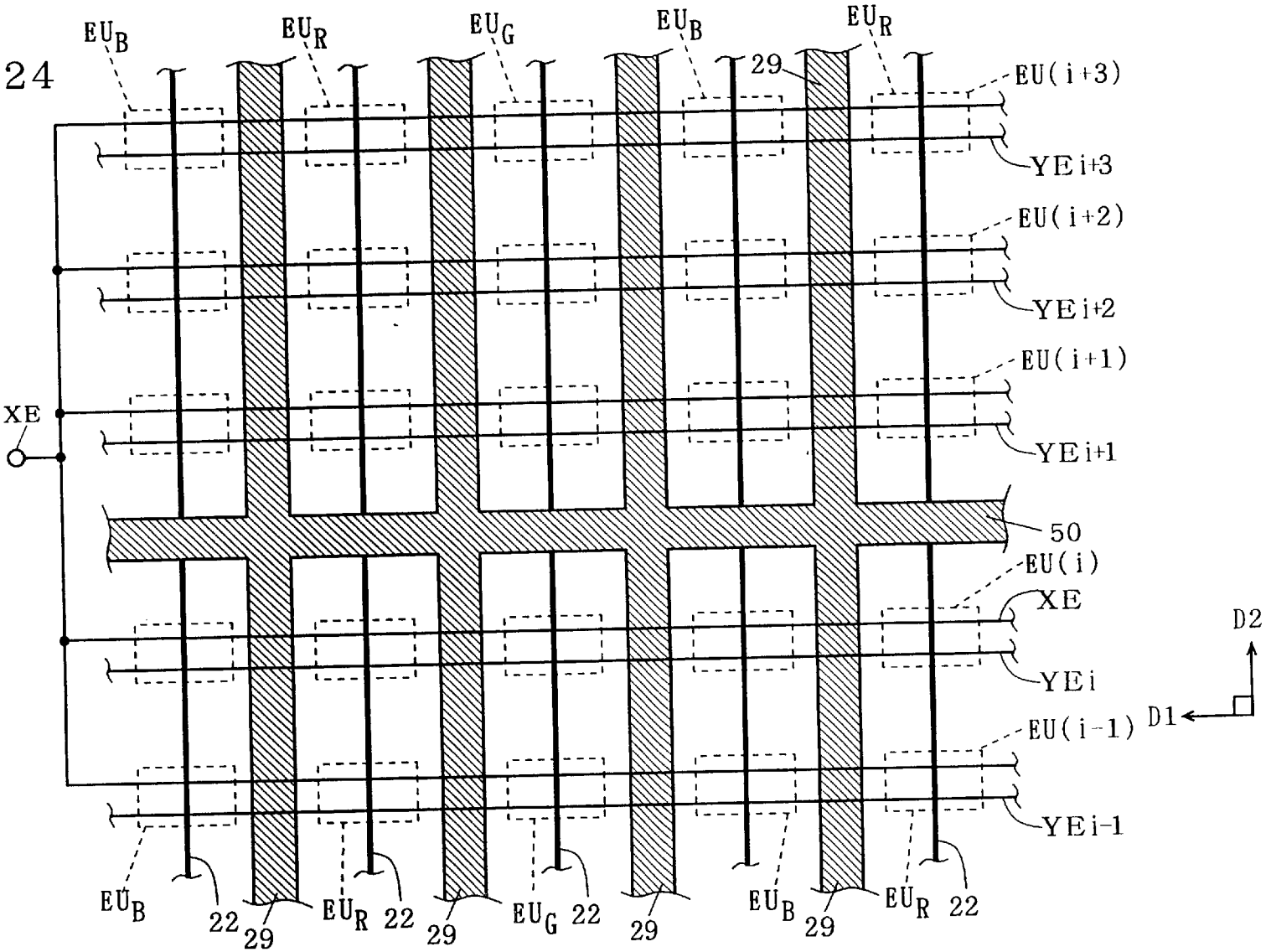
FIG. 24 is a perspective plan view schematically showing arrangement of each electrode and barrier rib in the surface discharge type plasma display panel according to another modification of the first to third preferred embodiments.

Therefore, if at least one barrier rib of the second type 50 is provided only on one side of any unit luminescent area EU, more advantages will be obtained than the conventional structure shown in FIG. 61. From this point of view, FIG. 24 is a perspective plan view schematically showing a modification that one barrier rib of the second type 50 is provided so as to be orthogonal to a plurality of barrier ribs of the first type 29.

In FIG,. 24, only one barrier rib of the second type 50 extends along the first direction D1 between an unit luminescent area EU(i) and an unit luminescent area EU(i+1) adjacent to the unit luminescent area EU(i) with respect to the second direction D2, so as to isolate these areas EU(i) , EU(i+1). In this case, the following effect can be sequentially obtained in the adjacent unit luminescent areas EU(i) and EU(i+1), when the barrier rib of the second type 50 is provided on the basis of the following respective conditions:

(1) The barrier rib of the second type 50 of any desired shape and size is provided. Then, excited atoms or the like moving toward the barrier rib of the second type 50 will collide with the barrier rib of the second type 50 and lose their energy. This completely prevents (when Hsub=Hmain) or sufficiently reduces (when Hsub<Hmain) the occurrence of the leakage of discharge.

(2) The barrier rib of the second type 50 is made of a material capable of reflecting visible light, for example, the same material as the barrier rib of the first type 29. In this case, visible light which has traveled in the vicinity of the barrier rib of the second type 50 can be reflected at the side surface portion of the barrier rib of the second type 50. This perfectly prevents (when Hsub=Hmain) or sufficiently suppresses (Hsub<Hmain) the leakage of luminescence.

(3) The phosphors 28 are adhered to the third and fourth side surface portions 50CW3 and 50CW4 of the barrier rib of the second type 50 and further to the second top portion 50T thereof, when Hsub<Hmain. In this case, light which has propagated in the vicinity of the barrier rib of the second type 50 can be reflected at the surface of the phosphors 28. Therefore, the phosphors 28 contribute the reduction of the leakage of luminescence. Further, since the phosphors 28 more speedily absorb ultraviolet rays in the vicinity of the barrier rib of the second type 50, a loss of ultraviolet rays can be reduced.

Here, the Japanese Patent Laid-Open Gazette No. 8-152865P (or the European Patent Publication No. EP-0704834-A1) has disclosed a lattice of barrier ribs of the same height in FIG. 6 and the column (0003) (in FIGS. 1A and 1B). However, no phosphor is provided on those barrier ribs, and the objects raised in the present invention cannot be recognized in the reference at all. Namely, the matter described in the present invention is neither pointed out nor described. Therefore, it can be said that the barrier ribs disclosed in the reference are substantially different from the barrier ribs of the first and second types 29 and 50 (50C) according to the first to third preferred embodiments of the present invention. Still more, the structure shown in FIG. 24 of the present invention cannot be led from the structure of the reference shown in its FIG. 6.

From this point, the PDP of the present invention shown in FIG. 24 is more advantageous than the structure of the reference shown in its FIG. 6.

4-4. Fourth Modification

Figure 25:
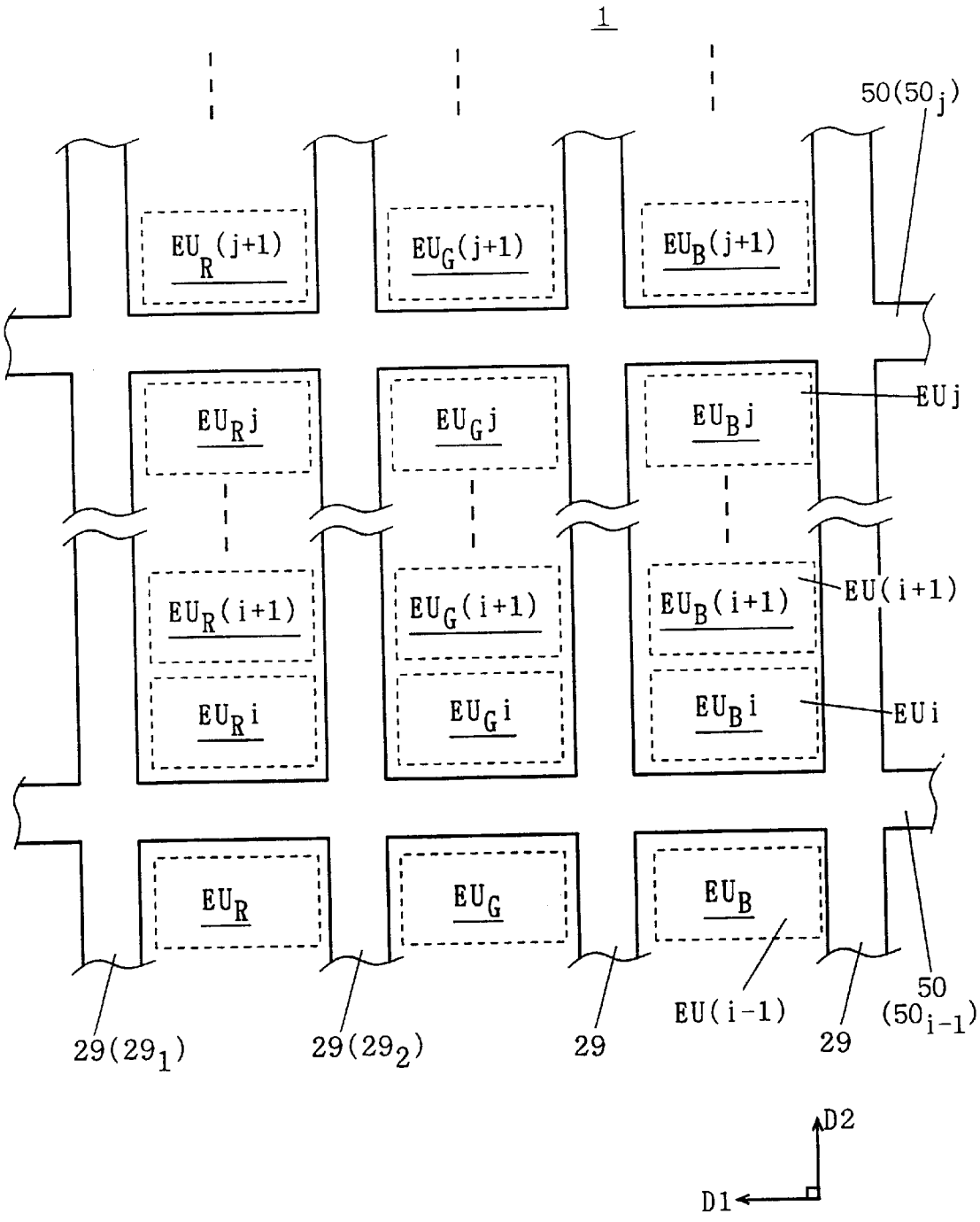
FIG. 25 is a perspective plan view schematically showing arrangement of each electrode and barrier rib in the surface discharge type plasma display panel according to a further modification of the first to third preferred embodiments.
Figure 26:
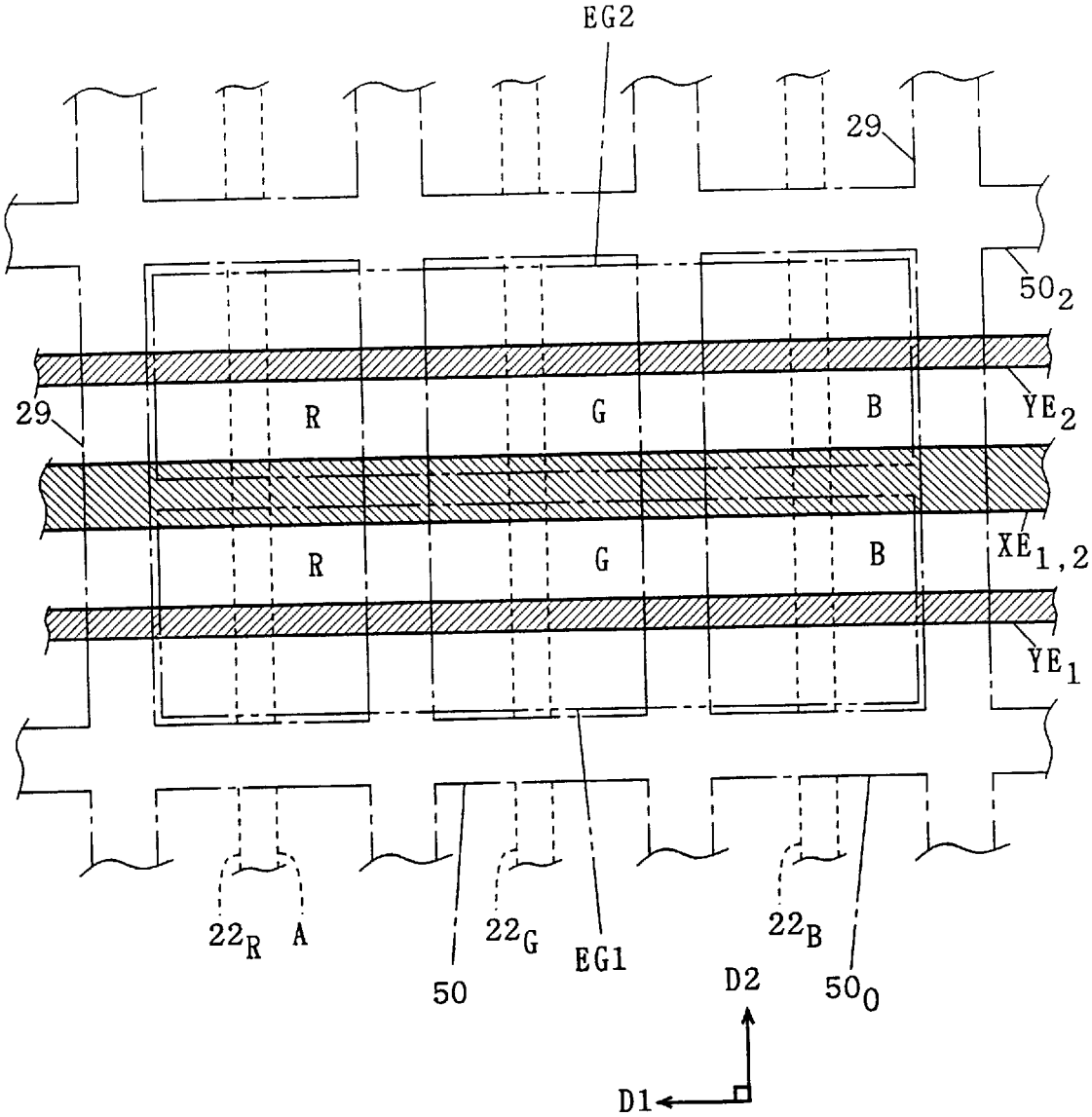
FIG. 26 is a perspective plan view schematically showing arrangement of each electrode and barrier rib in the surface discharge type plasma display panel according to a further modification of the first to third preferred embodiments.
Figure 27:
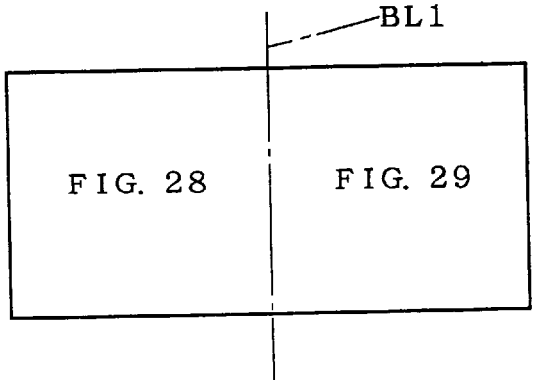
FIG. 27 shows a relationship between FIGS. 28 and 29.
Figure 28:
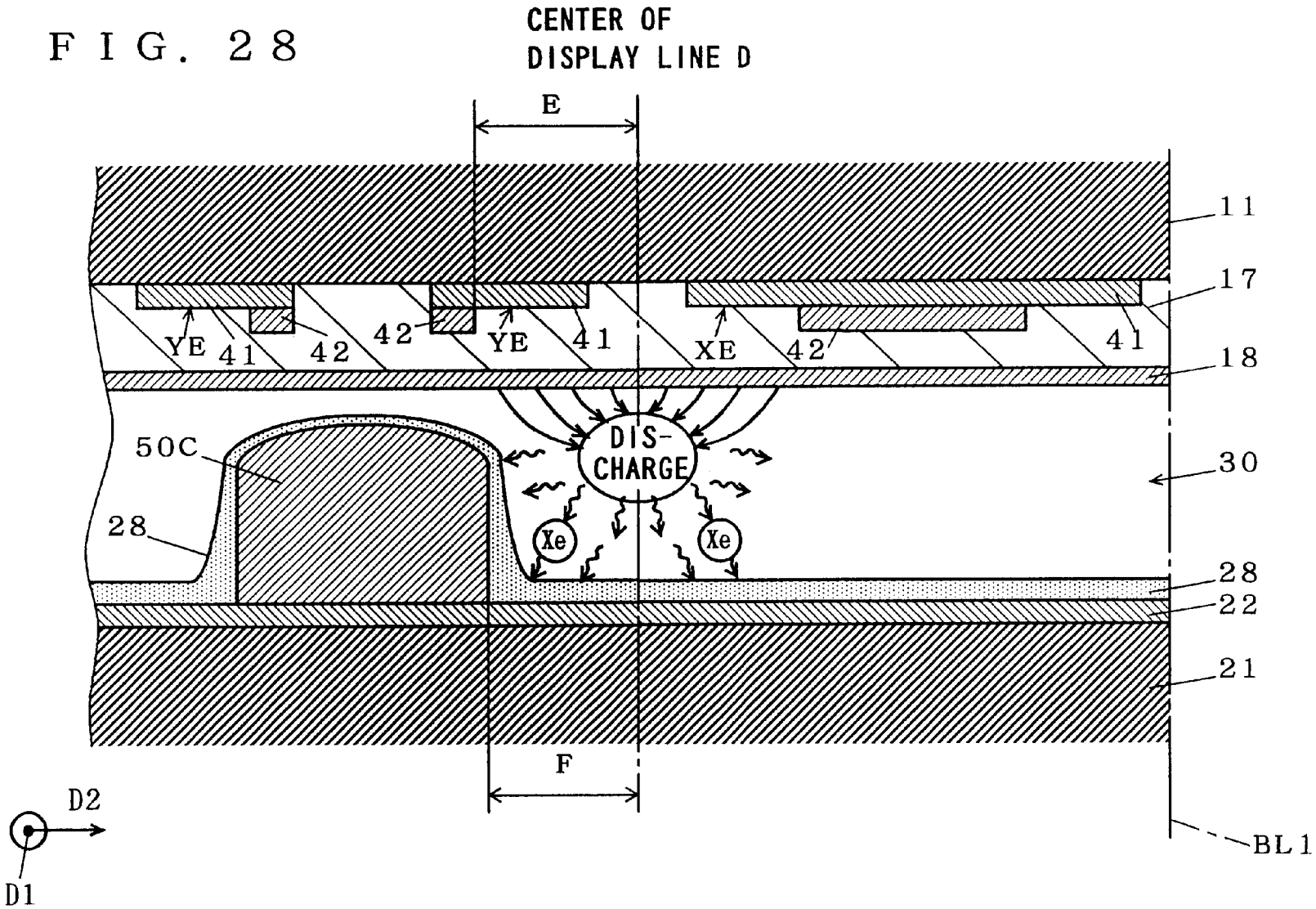
FIGS. 28 and 29 are longitudinal sectional views schematically showing arrangement of each electrode and the second barrier ribs, and the effect thereof, in the surface discharge type plasma display panel according to the modification shown in FIG. 26.
Figure 29:
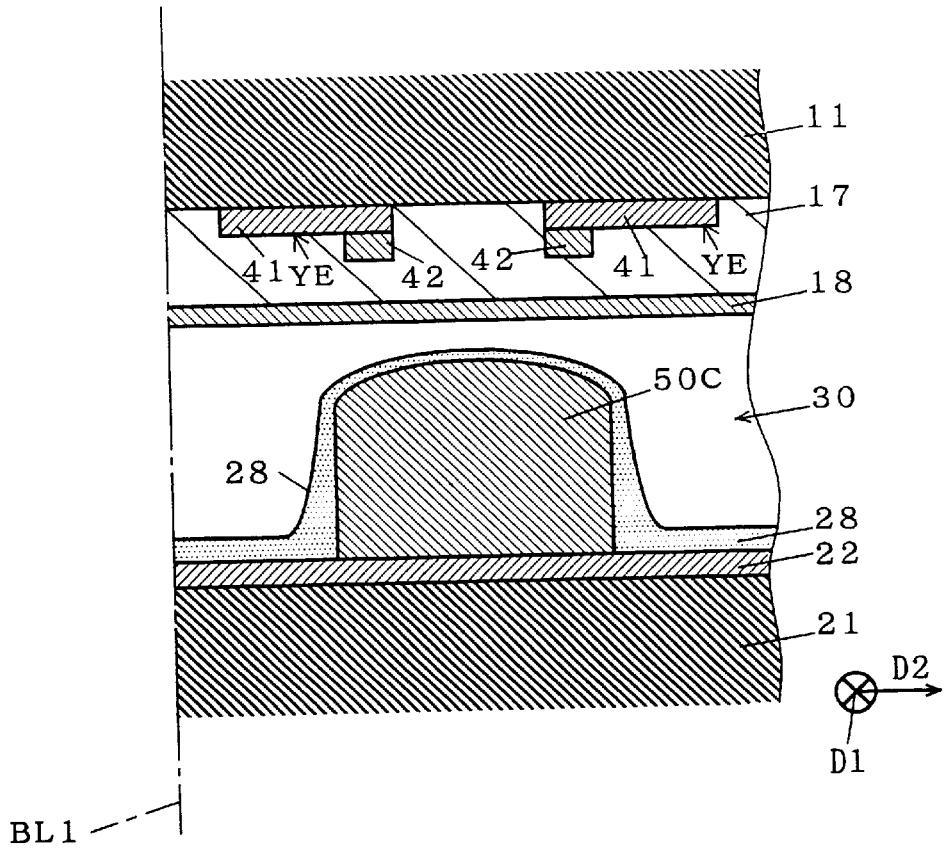

As schematically shown in a plan view of FIG. 25, another barrier rib of the second type 50($\mathbf{50}_j$) may be provided between the jth unit luminescent area $EU_j$ which is counted toward the second direction D2 from the ith unit luminescent area $EU_i$ on one side of the barrier rib of the second type 50($\mathbf{50}_{i-1}$), and its adjacent unit luminescent area $EU_{(j+1)}$, so as to have any desired number of unit luminescent areas EU in an area surrounded by the adjacent barrier ribs of the first type 29 ($\mathbf{29}_1$, $\mathbf{29}_2$) and the adjacent barrier ribs of the second type 50. In this case, the other of barrier rib of the second type 50($\mathbf{50}_j$) may or may not be of the same material, shape, and size as the one of barrier rib of the second type 50($\mathbf{50}_{i-1}$). Further, the phosphors 28 may or may not be provided on the side surface portions or the like of the other of barrier rib of the second type $\mathbf{50}_j$. In any case, the aforementioned effects (1) to (3) of the third modification can be achieved in both of the unit luminescent areas $EU_j$ and $EU_{(j+1)}$ isolated by the other of barrier rib of the second type $\mathbf{50}_j$.

When the barrier ribs of the second type 50 are provided at predetermined intervals on only one side of one unit luminescent area EU (when two barrier ribs $\mathbf{50}_{(i-1)}$ and $\mathbf{50}_j$ as shown in FIG. 25 are repeatedly provided along the second direction D2) as shown in FIG. 25, improvement in luminance can be obtained in areas between the unit luminescent areas $EU_{(i-1)}$ and $EU_i$ and between the unit luminescent areas $EU_j$ and $EU_{(j+1)}$, but cannot be obtained in other areas from the unit luminescent areas $EU_{(i+1)}$ to $EU_{(j-1)}$ as compared with the unit luminescent area $EU_{(j+1)}$. Therefore, this reduces the actual physical characteristic effect brought with the structures of the first to third preferred embodiments. However, since the total number of barrier ribs of the second type 50 is reduced as compared with the first to third preferred embodiments, an advantage is given in the aspect of process. Namely, since the unit luminescent area becomes smaller as increasing pixel density, a problem about limitation of size can be more easily overcome by providing the barrier rib of the second type for every desired number of unit luminescent areas. This problem should be, of course, considered in correlation with the characteristics of the PDP such as luminance.

4-5. Fifth Modification

FIGS. 26 to 29 shows a case where j=2 in the fourth modification, and the X electrode XE is common to each unit luminescent area of the pixels EG1 and EG2 adjacent to each other with respect to the second direction D2. The reference character BL1 in FIGS. 27 to 29 indicates a boundary line.

In this case, the barrier rib of the second type 50 is provided for every two pixels. Thus, the effect brought with the barrier rib of the second type 50 can be achieved at each location thereof, and further, the X electrode XE common to the adjacent two pixels gives a physical advantage in increasing the pixel density. Besides, the occurrence of discharge between the X and Y electrodes XE and YE of the adjacent pixels associated with the increase in voltage as shown in FIGS. 4 or 22A can be avoided in this modification shown in FIGS. 26 to 29 (and a sixth modification shown in FIGS. 30 to 32, which will be described later). Further, this modification also permits an increase in aligdment margin when the substrates 11 and 21 are stuck together as compared with the first to third preferred embodiments.

FIGS. 69 to 73 show the other modifications as references in conjunction with the structure of FIGS. 26 to 29.

4-6. Sixth Modification

Figure 30:
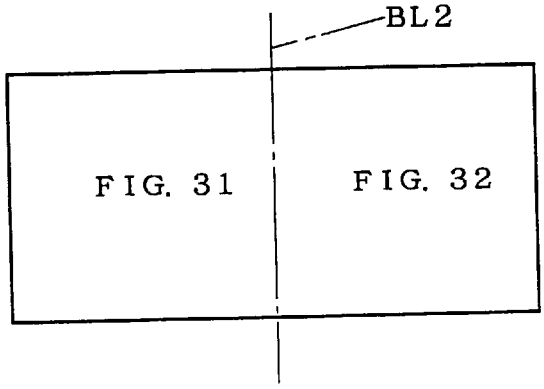
FIG. 30 shows a relationship between FIGS. 31 and 32.
Figure 31:
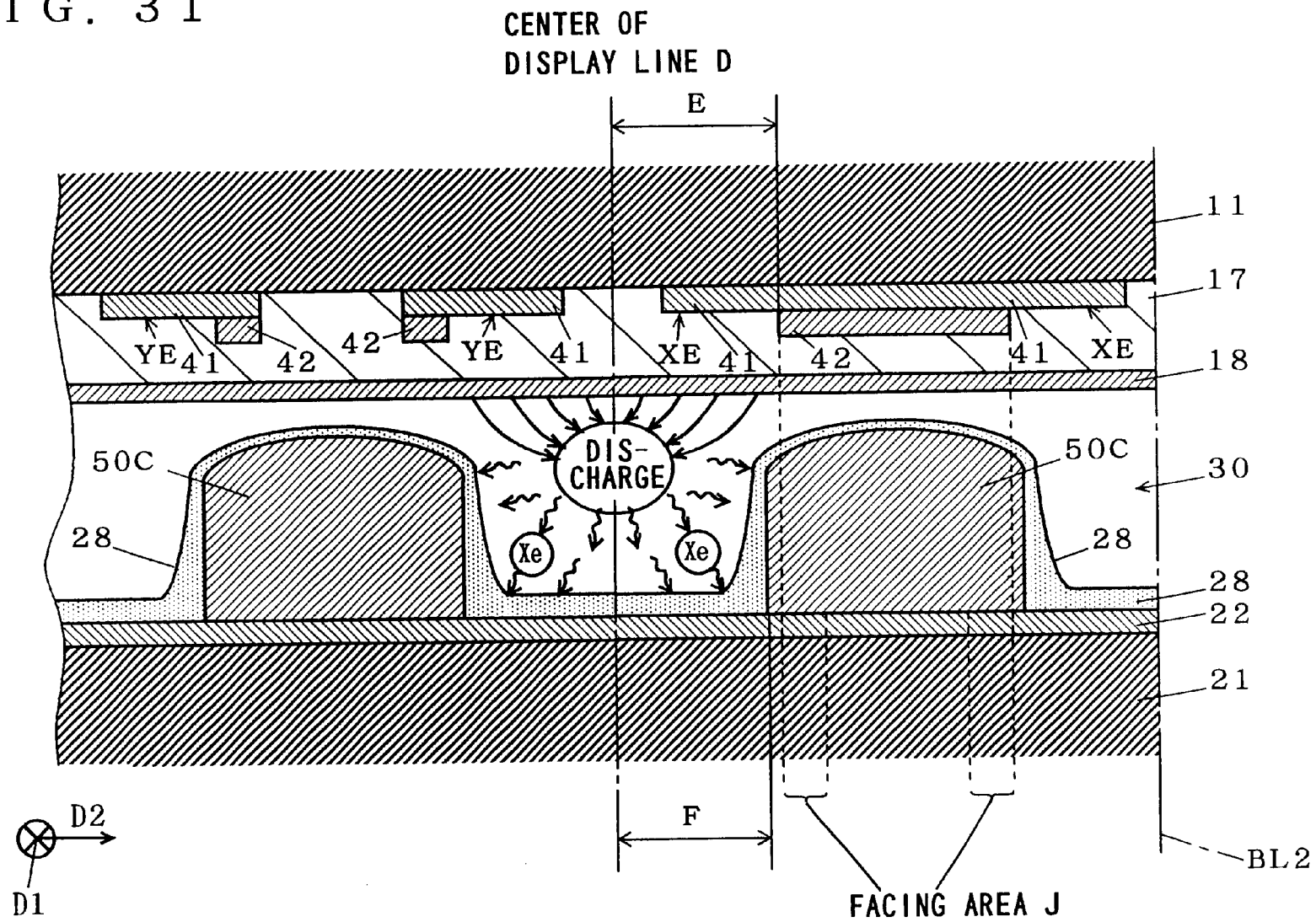
FIGS. 31 and 32 are longitudinal sectional-view schematically showing arrangement of each electrode and the second barrier ribs, and the effect thereof, in the surface discharge type plasma display panel according to further modification of the modification shown in FIGS. 28 and 29.
Figure 32:
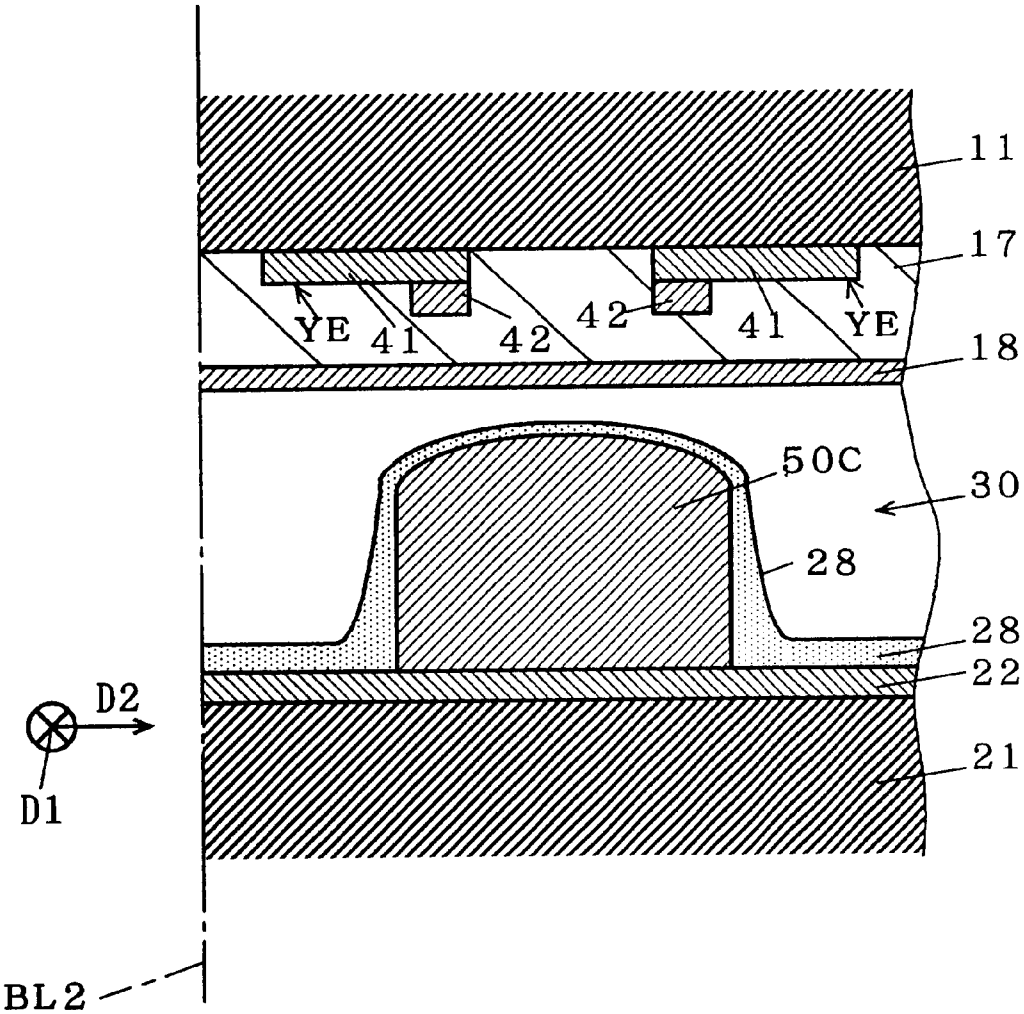

FIGS. 30 to 32 shows a modification of the fifth modification with another barrier rib of the second type 50 further provided right under the X electrode XE common to the two pixels. This case corresponds to a case where i=1 in FIG. 25, and the X electrode XE is provided for every two pixels.

The reference character BL2 in FIGS. 30 to 32 indicates a boundary line.

By further providing the barrier rib of the second type 50 right under the X electrode XE common to two pixels, the leakage of discharge which may occur between the X electrode XE of one of the pixels which both have the common X electrode XE and the Y electrode YE of the other can be prevented.

Further, FIGS. 75 to 80 show the other modifications in conjunction with the first to third preferred embodiments.

4-7. Seventh Modification

Figure 33:
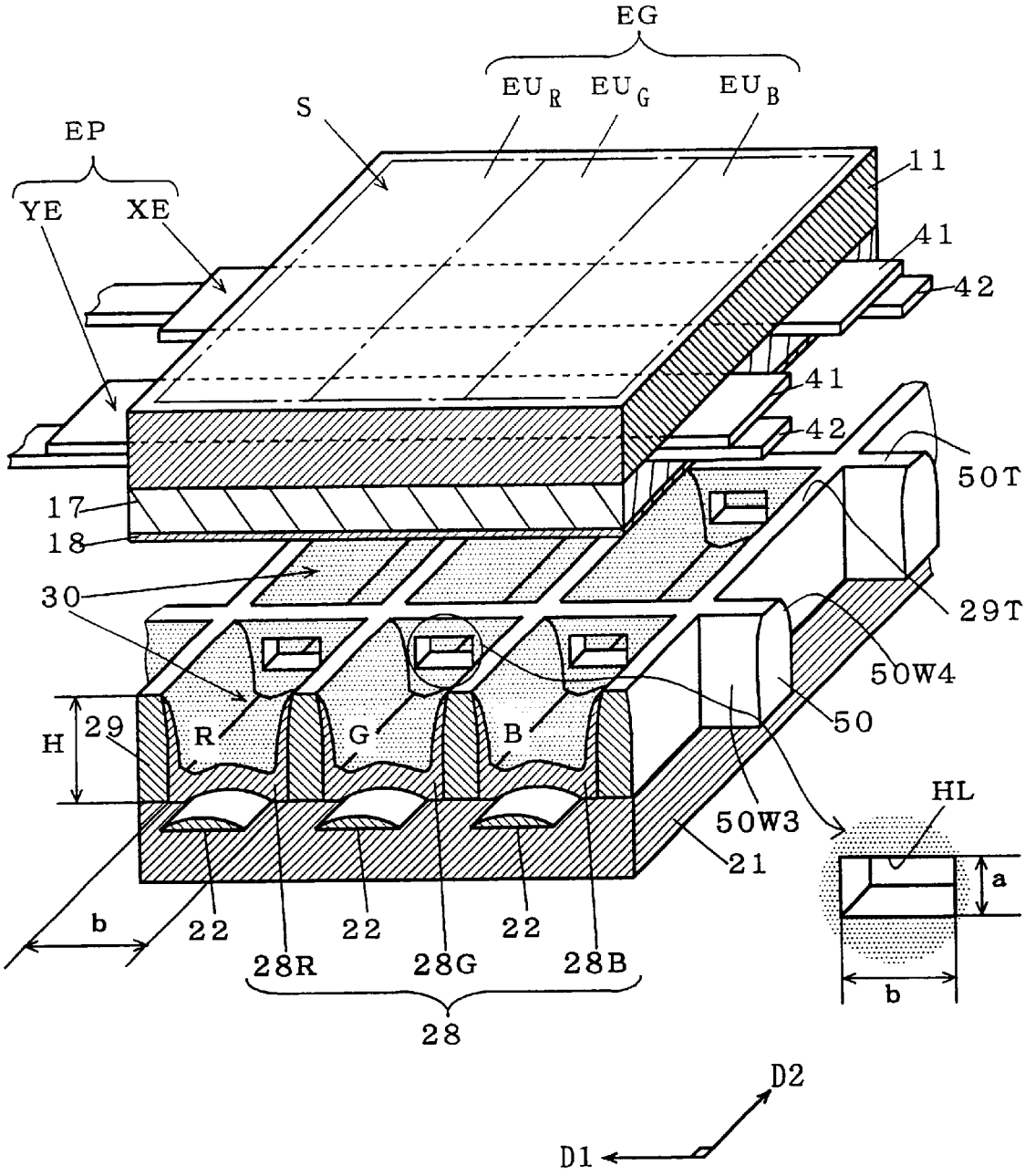
FIG. 33 is a perspective view of a structure of the surface discharge type plasma display panel according to a further modification of the first preferred embodiment.

FIG. 33 is a perspective view showing one pixel of a PDP which is a combination of the PDP 1A of the first preferred embodiment shown in FIG. 4 and the idea of the second preferred embodiment. In FIG. 33, flow path holes each having a sectional area given by (length a×width b) are formed so as to go through the third and fourth side surface portions 50W3 and 50W4 of the barrier ribs of the second type 50 which have the same height as the barrier ribs of the first type 29. Each of the dimensions a, b, and L is also decided on the basis of a correlation between the shape factor β described in the second preferred embodiment and the luminance of display light.

4-8. Eighth Modification

The height Hsub of each of the barrier ribs of the second type 50 may differ from each other and in this case, the effect of improving luminance is changed correspondingly. Small change in luminance (about ±10%) does not matter practically; rather it gives an advantage in the aspect of process (exhaustion and filling steps). In this modification, for example, the height Hsub of each barrier rib of the second type 50 may be increased gradually from the one on the side of the exhaust port of the PDP, so that the shape factor β correspondingly changes into 1.5 E−4 $mm^{-2}$.

Further, in general, a plurality of dummy unit luminescent areas are provided on both edge portions of the panel surface of the PDP, with relation to the coating of the phosphor paste. Thus, the barrier ribs of the second type 50 provided for those dummy unit luminescent areas and the actual unit luminescent areas EU adjacent to the dummv unit luminescent areas, may be formed to have almost the same height as the barrier ribs of the first type 29 (Hsub≈Hmain).

4-9. Ninth Modification

Figure 34:
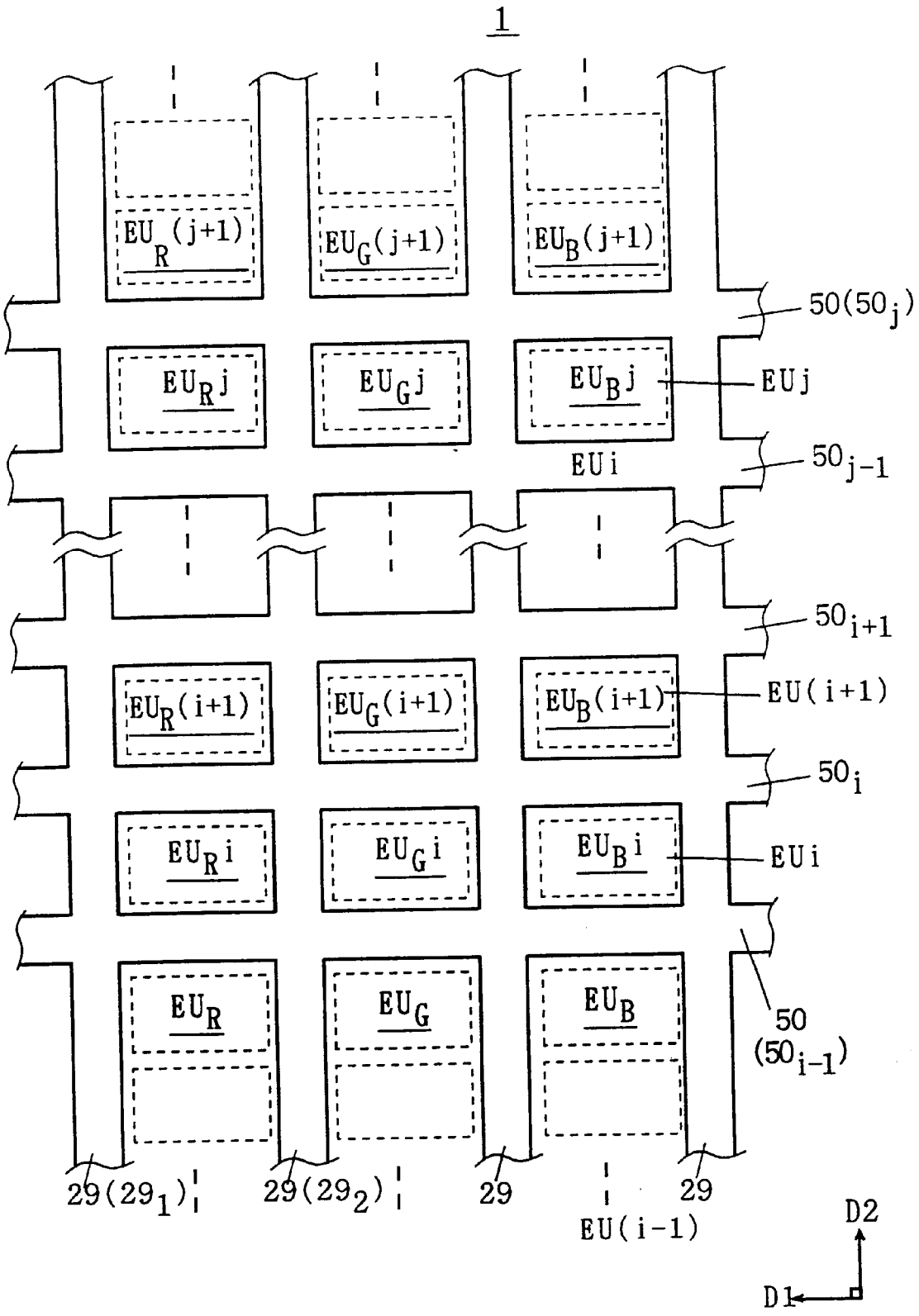
FIG. 34 is a perspective plan view showing an example of a ninth modification of the first to third preferred embodiments.

It is also possible to consider a modification that each of any desired number of adjacent display lines, out of all the display lines in the PDP, are surrounded by two barrier ribs of the second type along the first direction; and the other display lines are not surrounded by the barrier ribs of the second type. FIG. 34 is a perspective plan view schematically showing such an example.

In the modification shown in FIG. 34, the effect brought with the barrier ribs of the second type 50, that is, improvement in luminance or the like, can be obtained in the unit luminescent areas $EU_i$ to $EU_j$ surrounded by the two barrier ribs of the first type 50. However, the barrier ribs of the second type 50 are not provided in other unit luminescent areas peripheral to the unit luminescent areas $EU_i$ to $EU_j$.

When we consider those peripheral unit luminescent areas not surrounded by the barrier ribs of the second type shown in FIG. 34, as the dummy unit luminescent area described in the eighth modification, the effect brought with the barrier ribs of the second type can be obtained in all of the actual unit luminescent areas.

Further, the unit luminescent areas $EU_i$ to $EU_j$ shown in FIG. 34 may be repeatedly arranged at predetermined intervals.

4-10. Tenth Modification

Figure 81:
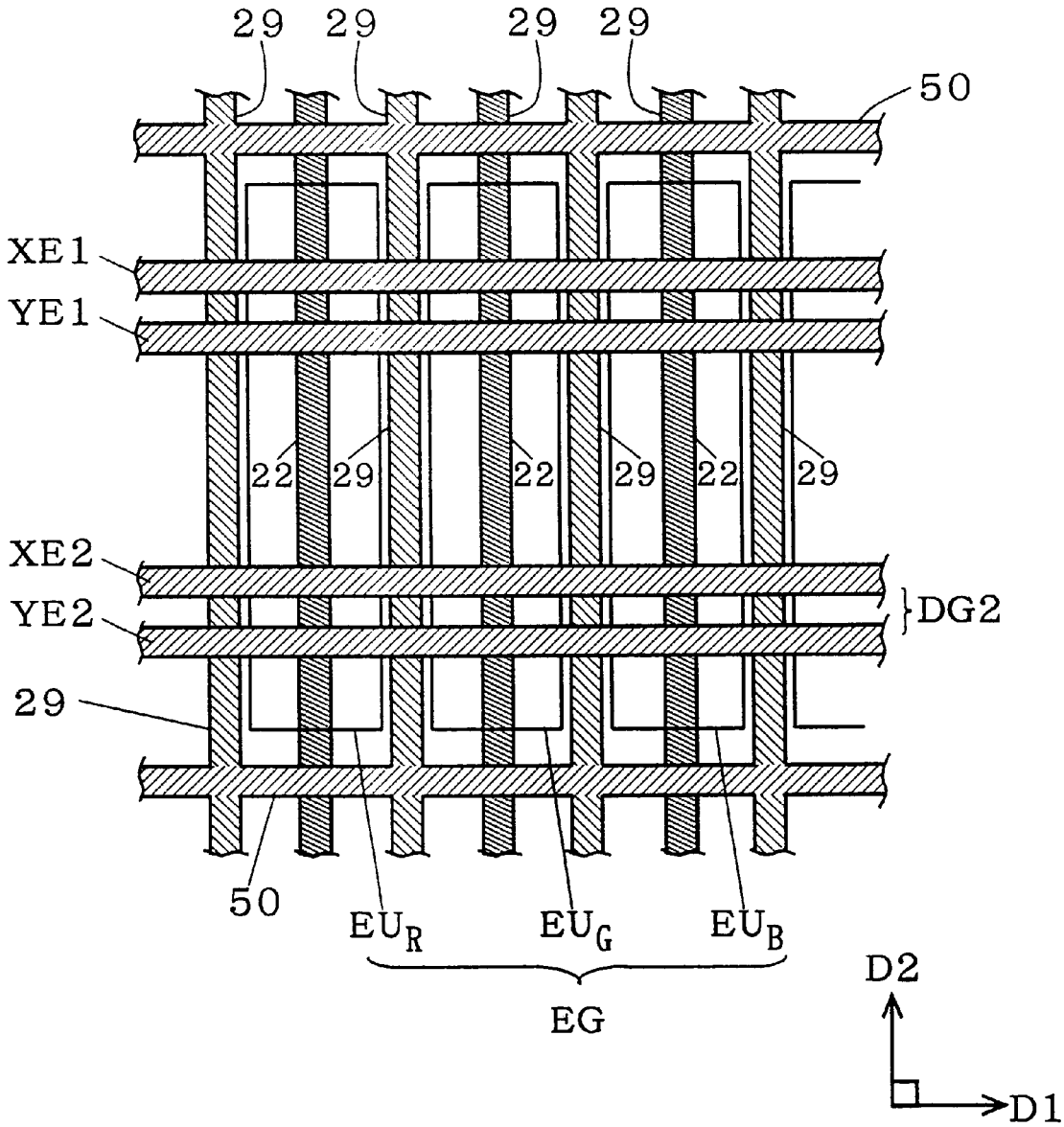
FIG. 81 shows a perspective plan view showing an example of a tenth modification of the first to third preferred embodiments.

FIG. 81 shows the case where when a plurality of pairs of electrodes (in this case, (XE1, YE1) and (XE2, YE2)) are provided in one pixel EG in parallel with each other along one display line, the barrier ribs of the second type are provided on both sides of the pixel EG along the second direction to be a partition between the pixels adjacent to each other with respect to the second direction. In this manner, a plurality of display electrodes (XE1, YE1, . . . , XEn, YEn) provided in one pixel EG achieve multilevel graduation display.

5. Fourth Preferred Embodiment

We will now describe a method for manufacturing the PDP 1A of the first preferred embodiment, and especially a first method for forming the barrier ribs of the first and second types 29 and 50 of completely or almost the same material and the same height so as to intersect with each other in a lattice arrangement on the second substrate 21 as shown in FIG. 4. In the description, the same reference numerals or characters as those in FIG. 4 are used.

Figure 35:
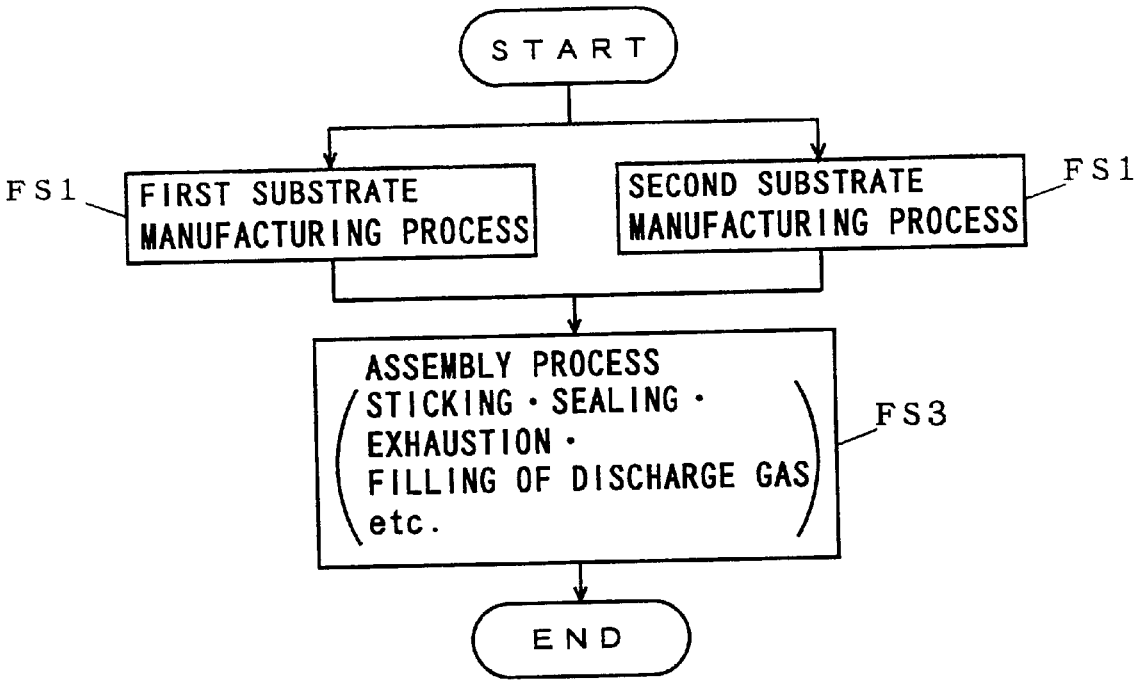
FIG. 35 is a flow chart of a manufacturing process common to the manufacturing method of the surface discharge type plasma display panel according to fourth to seventh preferred embodiments of the present invention.

FIG. 35 is a flow chart showing the outline of the manufacturing process of the PDP 1A. This manufacturing process roughly consists of three processes: a manufacturing process FS1 of the first substrate 11 or front panel; a manufacturing process FS2 of the second substrate 21 or rear panel; and an assembly process FS3. Of these three processes, the processes FS1 and FS3 are well-known and thus not essential to this preferred embodiment. Characterizing this preferred embodiment is the process FS2, especially the method for forming barrier ribs. This method roughly includes the following steps of: (a) preparing the second substrate comprising a plurality of A electrodes 22, which may be the one as indicated by the reference numeral 21 in FIG. 4 or the one as described in the first modification; a mask having a reticulated pattern defined by a first gap b between the barrier ribs of the first type 29 arranged in parallel with each other as shown in FIG. 4 and a second gap between the adjacent barrier ribs of the second type 50; and a low melting point glass paste to be a base material for these barrier ribs; and (b) forming the barrier ribs of the first and second types 29 and 50 on the second substrate 21 at the same time, on the basis of the mask. The "mask" of this preferred embodiment corresponds to, for example, a DFR which will be described later. In other fifth or seventh preferred embodiments of the present invention, the "mask" includes a mask used in a lithography process such as a glass mask, as well as the DFR. The method for forming the barrier ribs further includes the step of We will now give a detailed description of the method for forming the barrier ribs in the process FS2. The phosphors 28 and the A electrode 22 are formed by well-known methods.

The process shown in FIG. 35 is common to other fifth to seventh preferred embodiments.

Figure 36:
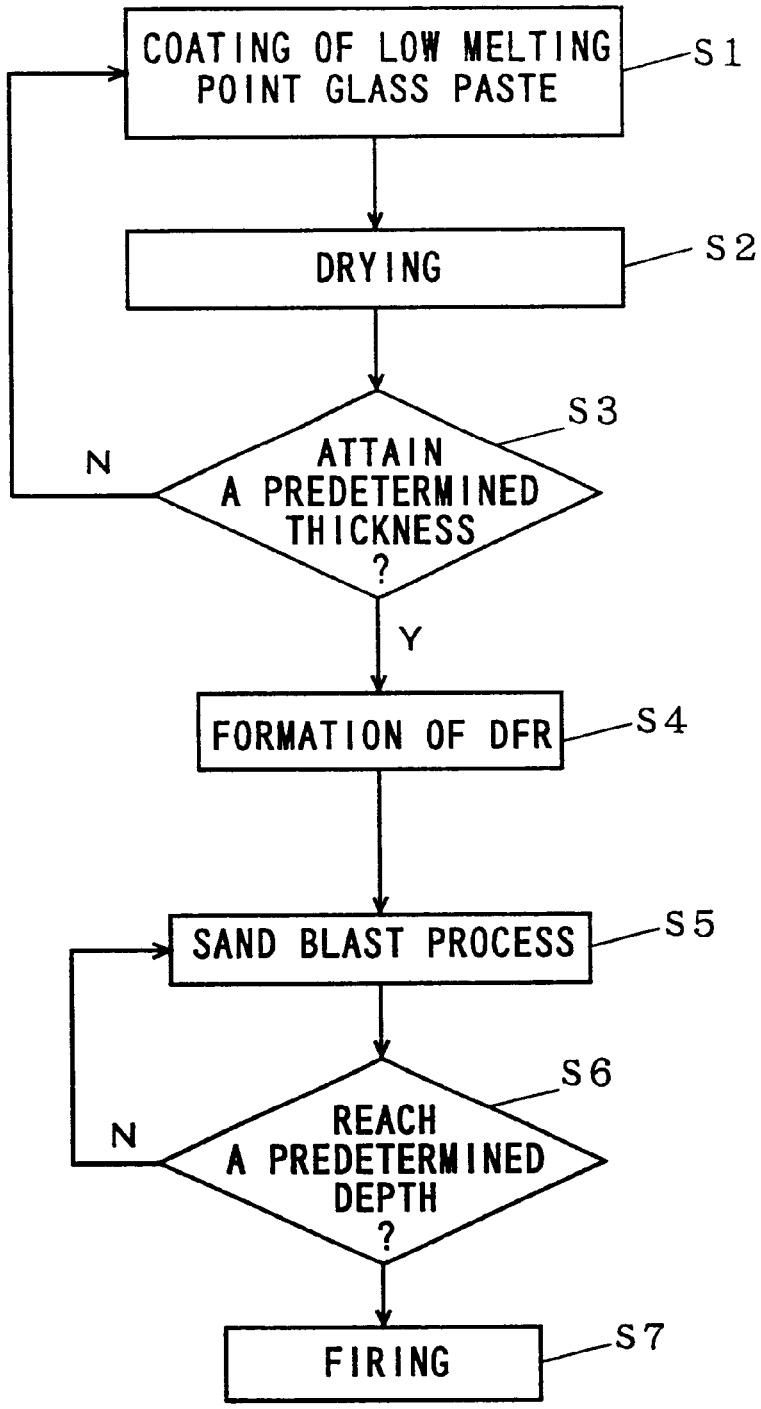
FIG. 36 is a flow chart of the manufacturing process of both barrier ribs according to the fourth preferred embodiment.

FIG. 36 is a flow chart illustrating the formation of the barrier ribs of the second type 50. FIGS. 37 to 42 are longitudinal sectional views of the rear panel for the PDP including the second substrate 21 in manufacture, viewed from the second direction D2 in FIG. 4. FIGS. 37 to 42 correspond to steps S1, S3, and S4 to S7 in FIG. 36, respectively.

Figure 37:
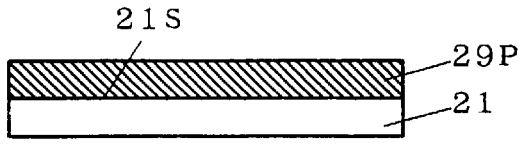
FIGS. 37 to 42 are longitudinal sectional views showing the manufacturing process of both barrier ribs according to the fourth preferred embodiment.
Figure 38:
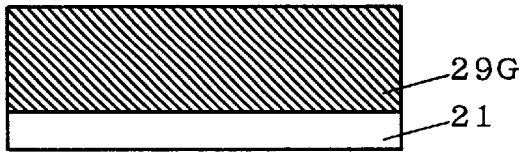

In FIG. 36, S1 is a step of coating a low melting point glass paste 29P on the whole inside surface 21S of the second substrate 21 (see FIG. 37); S2 is a step of drying the coated low melting point glass paste 29P; and S3 is a step of determining whether the low melting point glass paste 29G dried after the coating attains a predetermined thickness (corresponding to the height H in FIG. 4) (see FIG. 38). If the low melting point glass paste 29G attains a predetermined thickness, the process proceeds to a step S4; while if not, the process returns to the step S1.

Figure 39A:
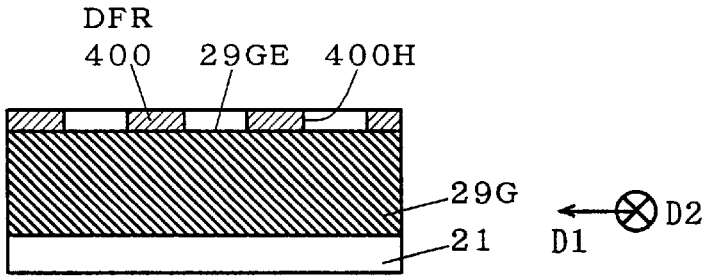
Figure 39B:
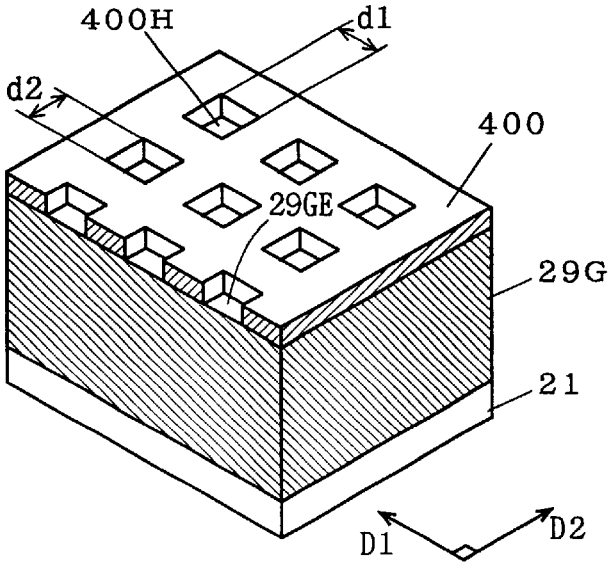

S4 is a step of forming a dry film resist 400 (hereinafter referred to as a DFR) having a predetermined reticulated pattern specified by the place where the barrier ribs of the first and second types 29 and 50 are provided or by the first and second gaps thereof. Thus, a photosensitive film to be a member of the DFR 400 is stuck on the low melting point glass paste 29G. The photosensitive film includes a photosensitive member sandwitched, for example, between polyethylene terephthalate (PET) and polyolefin. Then, the photosensitive film is irradiated with ultraviolet rays, for example, via a predetermined reticulated mask pattern, and heated for speeding up of reaction. The photosensitive film is then developed with $Na_2CO_3$ solution, by which the reticulated DFR 400 having reticulations or openings 400H of almost the same shape and size, is formed as shown in FIGS. 39A and 39B (S4: the process for forming the DFR). The DFR 400 acts as a mask at the following step. In FIG. 39B, first and second lengths d1 and d2 correspond to the first gap between the barrier ribs of the first type 29 and the second gap between the barrier ribs of the second type 50, respectively.

Figure 40:
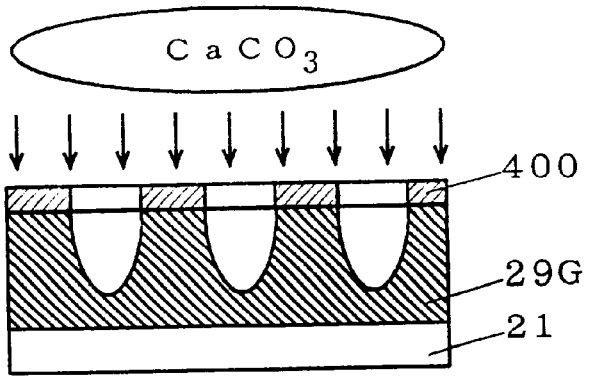
Figure 41:
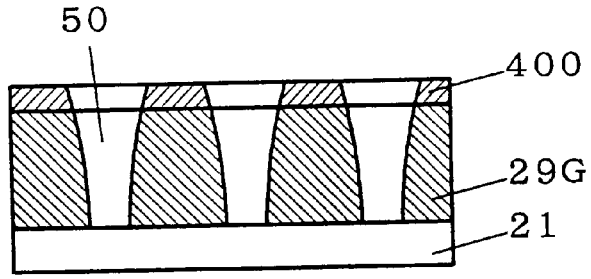

S5 is a sand blast step. For example, $CaCO_3$ is blasted on the whole exposed surface which includes the reticulated DFR400 and the surface of the dried low melting point glass paste 29G, exposed by the openings 400H, as shown in FIG. 40, so as to remove the dried low melting point glass paste 29G right under portions 29GE which are not masked by the reticulated DFR 400. This bores a hole from the portion 29GE through the low melting point glass paste 29G.

S6 is a step of determining whether the low melting point glass paste 29G dried by the sand blast process at the step S5 is removed to a predetermined depth (corresponding to the height H in FIG. 1) or not, that is, whether the hole in the low melting point glass paste 29G reaches the second substrate 21 or not. If the low melting point glass paste 29G is not removed to a predetermined depth, the process returns to the step S5 to continue the sand blast processing. After the low melting point glass paste is removed to a predetermined depth, the remaining reticulated DFR 400 is stripped, and the process proceeds to a firing step S7 (see FIG. 41).

Figure 42:
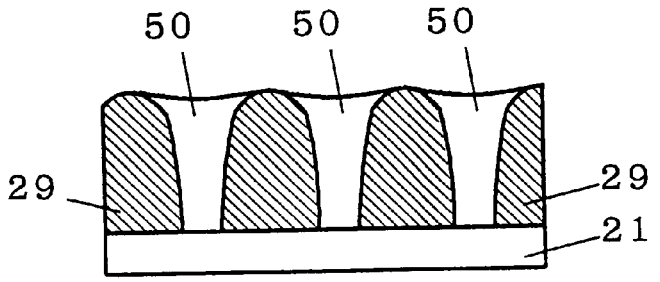

At the firing step S7, by melting the dried low melting point glass paste 29G by the application of heat, reticulated barriers which includes the barrier ribs of the first and second types 29 and 50 are completed on the inside surface 21S of the second substrate 21 (see FIG. 42).

The following steps (steps of forming phosphors, and the assembly process FS3 shown in FIG. 35) will be described in a fifth preferred embodiment.

In this manner, by preparing the DFR 400 having a regular reticulated pattern as shown in FIG. 39B by means of lithography, the conventional sand blast method can be adopted as it is without adding any new step, to form the barrier ribs of the first and second types 29 and 50 at the same time.

Further, the shape of the mask pattern used in lithography is determined according to the type of the photosensitive film, negative or positive. The same goes for the other fifth to seventh preferred embodiments.

6. Fifth Preferred Embodiment

We will now describe a second method for forming the barrier ribs of the first and second types 29 and 50 of the PDP 1A shown in FIG. 4.

FIGS. 43 to 46 are longitudinal sectional views of the rear panel for the PDP including the second substrate 21 in manufacture, when FIG. 4 is viewed from the second direction D2 in the same way as the fourth preferred embodiment. These figures show steps of the second method.

Figure 43:
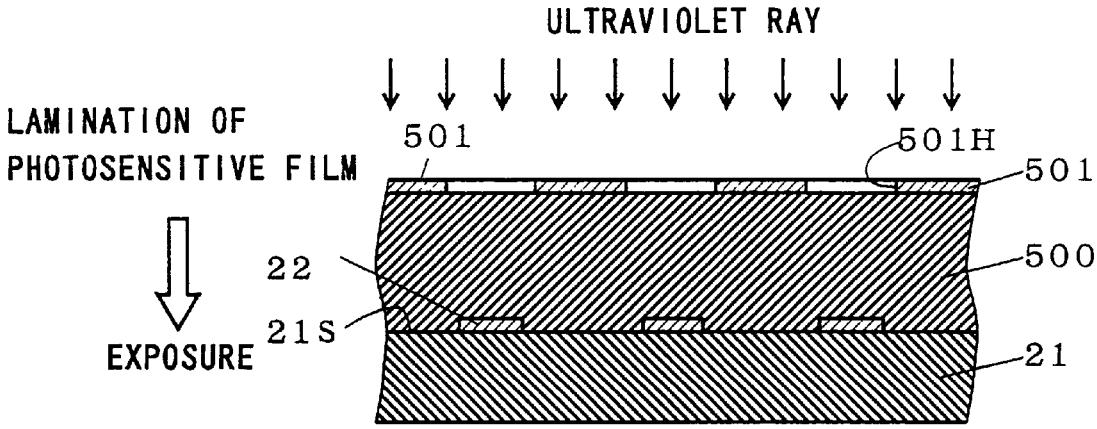
FIGS. 43 to 46 are longitudinal sectional views showing the manufacturing process of both barrier ribs according to the fifth preferred embodiment.
Figure 44:
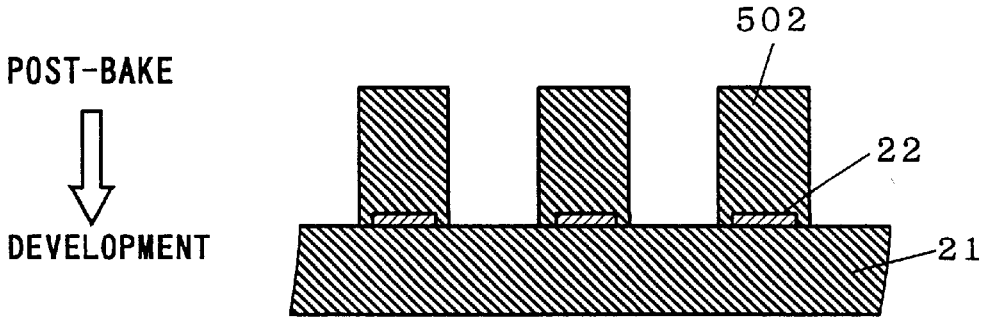

As shown in FIG. 43, a photosensitive film 500 (member of mask) of uniform thickness is stuck almost on the whole inside surface 21S of the second substrate 21 and the A electrode 22, and irradiated with ultraviolet rays via a pattern of, for example, a mask 501 for forming a dot-matrix pattern (called a first mask). Then, the photosensitive film 500 is heated (post-baked) for speeding up of reaction, and developed with $Na_2CO_3$ solution, as shown in FIG. 44. After the development of the film, a dot-matrix DFR 502 (mask) with the dot-matrix pattern of the first mask 501 transferred thereto is formed.

Figure 45:
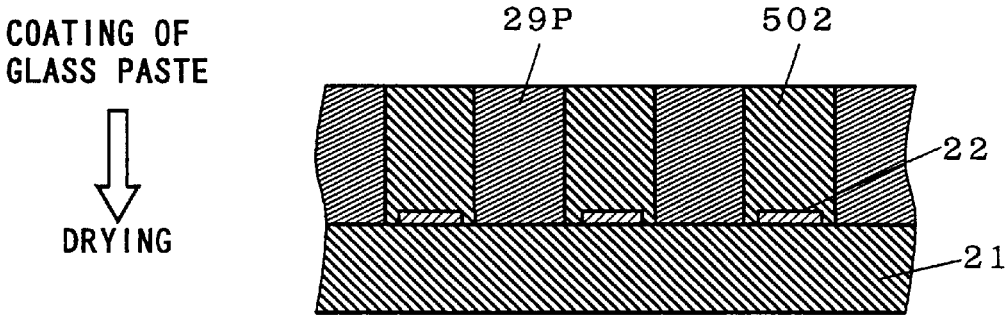

After the dot-matrix DFR 502 is formed, a low melting point glass paste 29P which contains paraffin, acrylic resin, and the like solidifying at 100° C. or less to maintain an outside shape and protect the shape in stripping, is coated along with the DFR 502, and dried by the application of heat, as shown in FIG. 45. The height of the low melting point glass paste 29P may be equalized after the application of heat, by polishing the upper surface of the dried low melting point glass paste 29P so as to expose the upper surface of the DFR 502.

Figure 46:
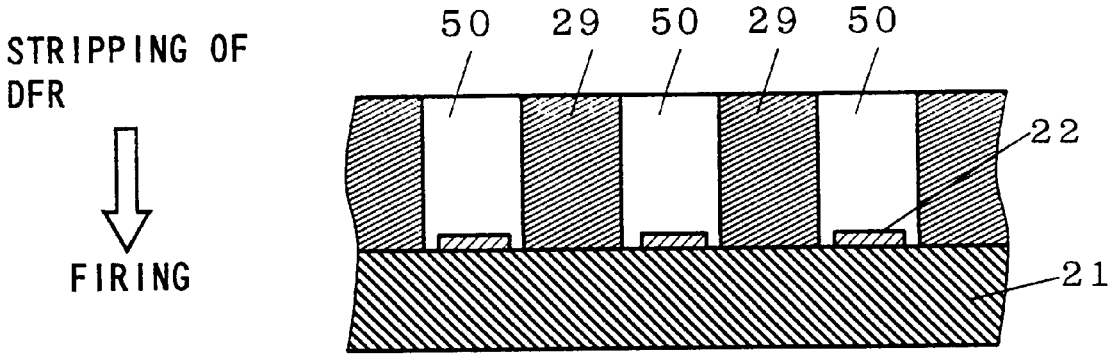

Then, only the DFR 502 is stripped as shown in FIG. 46, so that the dried reticulated low melting point glass paste 29P remains on the second substrate 21. By firing this residual low melting point glass paste 29P, the barrier ribs of the first and second types 29 and 50 are formed.

This method permits forming fine barrier ribs of the first and second types 29 and 50 with high formative accuracy, without rounding their edge portions and making large fluctuation in height.

After the barrier ribs of the first and second types 29 and 50 are formed by the aforementioned method, phosphor pastes are injected into respective box-shaped spaces specified by the first and second side surface portions 29W1 and 29W2 of the adjacent barrier ribs of the first type 29; the third and fourth side surface portions 50W3 and 50W4 of the adjacent barrier ribs of the second type 50; and the inside surface of the second substrate 21 with the A electrode 22 previously formed. Then, the phosphor pastes are dried and heated to form phosphors 28 which cover the opposite first and second side surface portions 29W1 and 29W2 of the adjacent barrier ribs of the first type 29; the opposite third and fourth side surface portions 50W3 and 50W4 of the adjacent barrier ribs of the second type 50; the inside surface of the second substrate 21 and the upper surface of the A electrode 22 which are sandwitched between the adjacent barrier ribs of the first type 29.

The assembly process FS3 shown in FIG. 35 works as follows. Completion of the PDP is attained by sticking the first and second substrates 11 and 21 together and sealing peripheral portions of the respective first and second substrates 11 and 21 with the low melting point glass or the like. In the fourth and fifth preferred embodiments, however, since the barrier ribs of the first and second type 29 and 50 are completely or almost the same in height, the first and second top portions 29T and 50T thereof are in contact with the surface of the protective layer 18, and each discharge space 30 is completely closed. Thus, the sealing of the peripheral portions of the first and second substrates 11 and 21 should be conducted, for example, in an atmosphere of discharge gas pressure which is predetermined. This achieves the PDP 1A having the structure shown in FIG. 4.

As the substrates 11 and 21 increase in size, however, the sealing in the atmosphere of discharge gas pressure becomes difficult. In such a case, for example, the first and second substrates 11 and 21 may be stuck together with a predetermined shape of space (not shown) provided therebetween so as to secure a somewhat gap between the protective layer 18 and the first and second top portions 29T and 50T of the barrier ribs of the first and second types 29 and 50. Then, the aforementioned sealing is conducted after the sequential processing of the exhaustion (evacuation) and filling of discharge gas. This provides a PDP with a gap provided between the surface of the protective layer 18 and the respective top portions 29T and 50T of the barrier ribs of the first and second types 29 and 50, which is a little different from the plasma display panel PDP 1A shown in FIG. 4. In this PDP, however, the aforementioned conventional problems (1) to (3) may somewhat come out between the unit luminescent areas adjacent to each other with respect to the first direction D1 (for example, between $EU_R$ and $EU_G$).

7. Sixth Preferred Embodiment

Now, we will describe a manufacturing method of the PDP 1B shown in FIG. 8, and especially a method for forming the barrier ribs 29 and 50 of different heights at the same time. This manufacturing method is similar to the methods described in the third and fourth preferred embodiments, but we will describe further in detail with reference to FIGS. 47 to 53.

Figure 47:
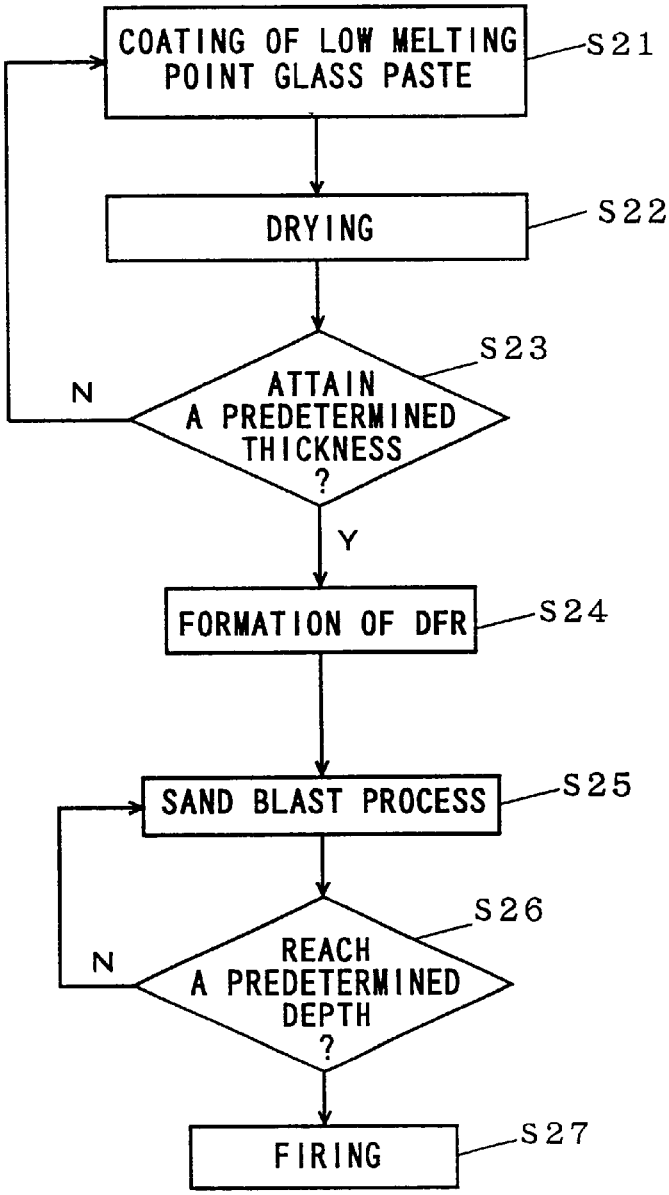
FIG. 47 is a flow chart of the manufacturing process of both barrier ribs according to the sixth preferred embodiment.

FIG. 47 is a flow chart showing how to form the barrier ribs of the first and second types 29 and 50 at the same time according to a sixth preferred embodiment of the present invention. In FIG. 47, S21 is a step of coating the low melting point glass paste 29P on the whole inside surface 21S (see FIG. 48); S22 is a step of drying the low melting point glass paste 29P coated at the step S21; and S23 is a step of determining whether the dried low melting point glass 29G attains a predetermined thickness or not (see FIG. 49). If the low melting point glass 29G has not attain the predetermined thickness, the process returns to the step S21. After the predetermined thickness is attained, for the purpose of forming a DFR 600 as a mask, a photosensitive film (member of mask) including a photosensitive member sandwitched between polyethylene terephthalate (PET) and polyolefin, for example, is stuck on the whole surface, and irradiated with ultraviolet rays, for example, via a reticulated mask pattern (such as glass mask) formed on the basis of the first and second gaps of the barrier ribs of the first and second types 29 and 50 (lithography method). Then, the photosensitive film is heated for speeding up of reaction to form the DFR 600. Further, the photosensitive film are developed with $Na_2CO_3$ solution. After the development, a reticulated DFR 600 shown in FIGS. 50A and 50B is formed (S24: step of forming a DFR). The DFR 600 includes a first mask portion 601 of a first mask width N, formed along the second direction D2, and a second mask portion 602 of a second mask width M which is equal to or less than the first mask width N ($M \leqq N$), formed along the first direction D1. The first mask width N is decided depending on the width of the barrier ribs of the first type 29, and the second mask width M is decided depending on the width L of the barrier ribs of the second type 50.

Figure 51:
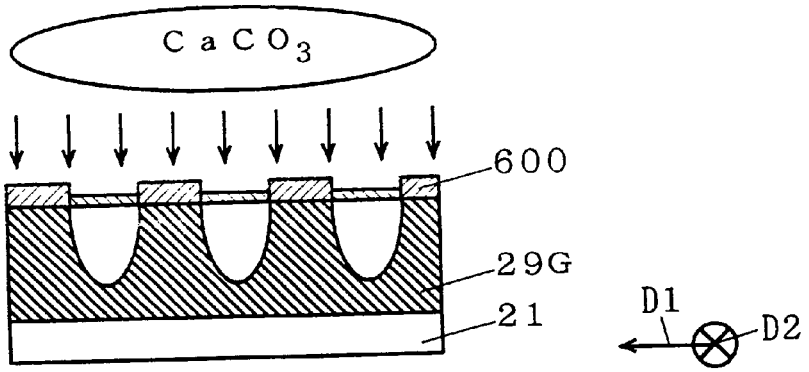

S25 is a sand blast step shown in FIG. 51. For example, $CaCO_3$ is blasted on the whole surface which includes the reticulated DFR 600 (mask) and an exposed surface of the dried low melting point glass paste 29G, to remove the dried low melting point glass paste 29G except where it is masked by the reticulated DFR 600.

Figure 52:
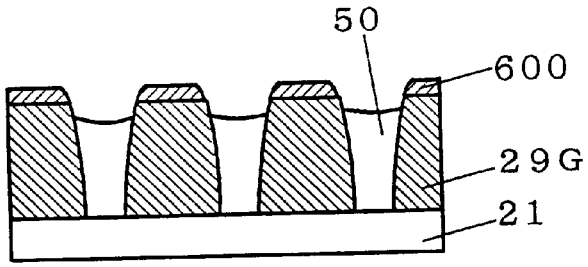
Figure 53:
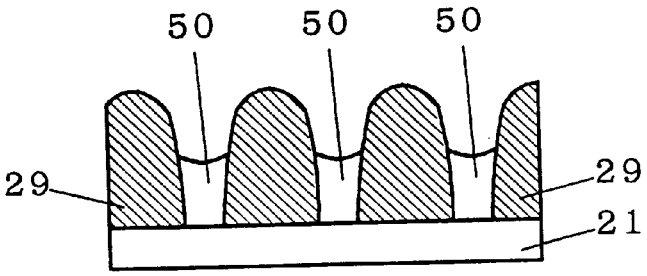

S26 is a step of determining whether the dried low melting point glass paste 29G is removed to a predetermined depth (corresponding the height H) or not by the sand blast step S25 (see FIG. 52). If the low melting point glass paste 29G has not been removed to the predetermined depth, the process returns to the step S25 to continue the sand blast process After the low melting point glass paste 29G is removed to the predetermined depth, the residual reticulated DFR 600 is stripped, and then the process proceeds to a firing step S27. At the step S27, by melting the dried low melting point glass paste 29G by the application of heat, reticulated barrier ribs including the barrier ribs of the first and second types 29 and 50 are completed on the second substrate 21 (see FIG. 53).

In the reticulated DFR 600 of the sixth preferred embodiment as described above, a portion corresponding to the barrier ribs of the first type 29 (first mask portion 601) and a portion corresponding to the barrier ribs of the second type 50 (second mask portion 602) have different mask widths. Namely, as shown in FIG. 50B, the first mask width N of the first mask portion 601 corresponding to the barrier ribs of the first type 29 is not less than the second mask width M of the second mask portion 602 corresponding to the barrier ribs of the second type 50. Here, at the sand blast step S25, the DFR 600 is removed (grinned) with the low melting point glass paste 29G not masked. Although the first and second mask portions 601 and 602 are removed together, since the second mask width M of the second mask portion 602 corresponding to the barrier ribs of the second type 50 is smaller than the first mask width N of the first mask portion 601 corresponding to the barrier ribs of the first type 29, the second mask portion 602 corresponding to the barrier ribs of the second type 50 will be sooner or later removed. Thus, when the sand blast process at the step S25 further continues after the resist of the second mask portion 602 is removed, the low melting point glass paste 29G which was covered by the second mask portion 602 can be grinned.

After this, the sand blast process further continues, with only the first mask portion 601 corresponding to the barrier ribs of the first type 29 remaining on the low melting point of the glass paste. Thus, while a portion of the dried low melting point glass paste 29G, which is covered by the first mask portion 601 corresponding to the barrier ribs of the first type 29 remains the same in height (H), another portion of the dried low melting point glass paste 29G which was covered by the second mask portion 602 corresponding to the barrier ribs of the second type 50 is partially removed. As a result, the barrier ribs of the second type 50 are formed smaller in height than the barrier ribs of the first type 29.

As described above, according to this preferred embodiment, the conventional sand blast method can be used as it is to manufacture the PDP 1B shown in FIG. 8 by using the DFR 600 having the reticulated pattern shown in FIGS. 50A and 50B as a mask. Thus, the barrier ribs of the first and second types 29 and 50 of different heights can be formed without any new manufacturing apparatus nor new process.

8. Seventh Preferred Embodiment

Next, we will describe a second method for forming the barrier ribs 29 and 50 of the PDP 1B. FIGS. 54 to 59 are longitudinal sectional views of the rear panel for the PDP including the second substrate 21 in manufacture. These figures shows the manufacturing steps of the second method.

Figure 54:
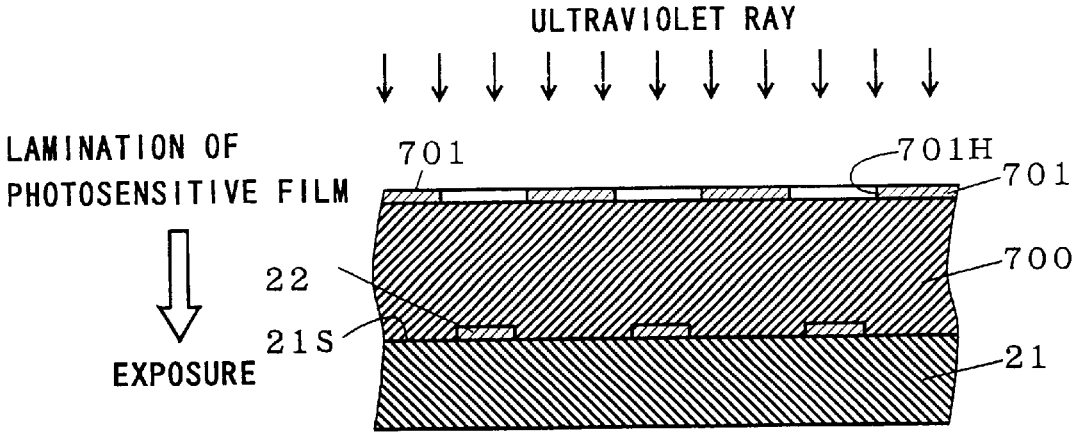
FIGS. 54 to 59 are longitudinal sectional views showing the manufacturing process of both barrier ribs according to the seventh preferred embodiment.
Figure 55:
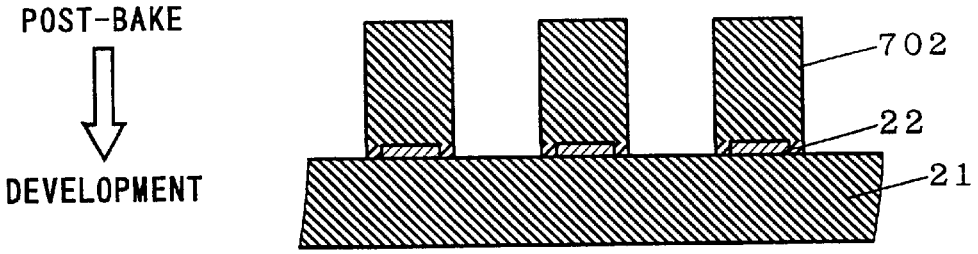
Figure 56:
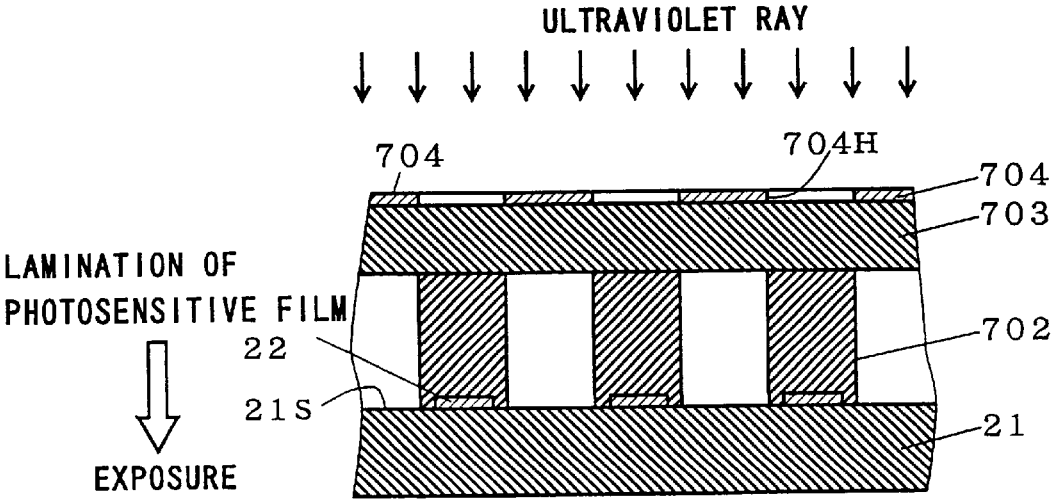
Figure 57:
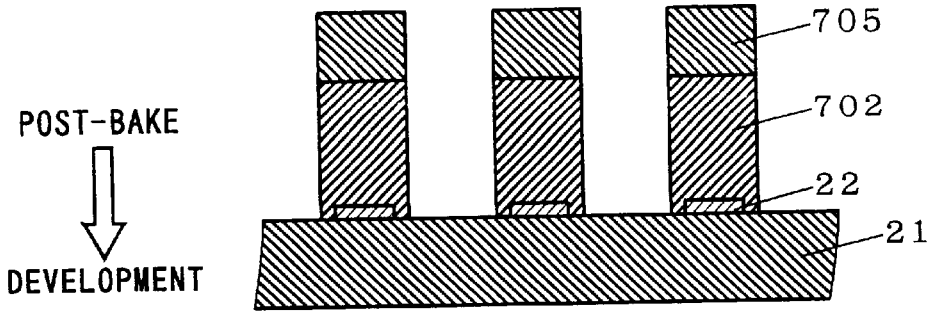
Figure 58:
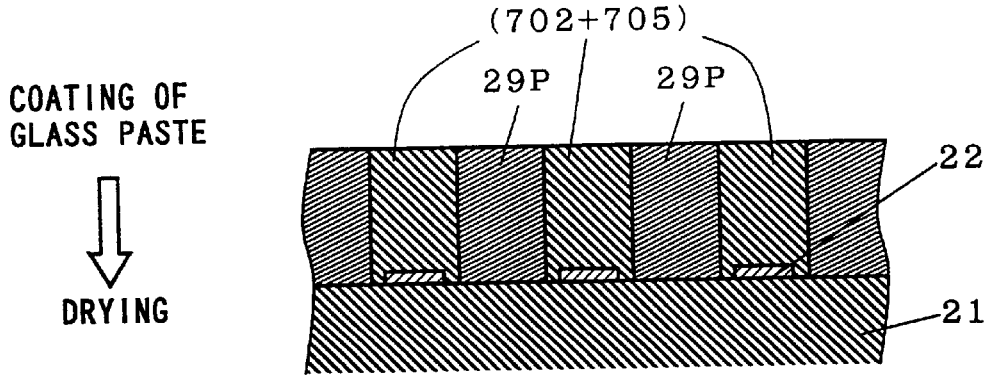
Figure 59:
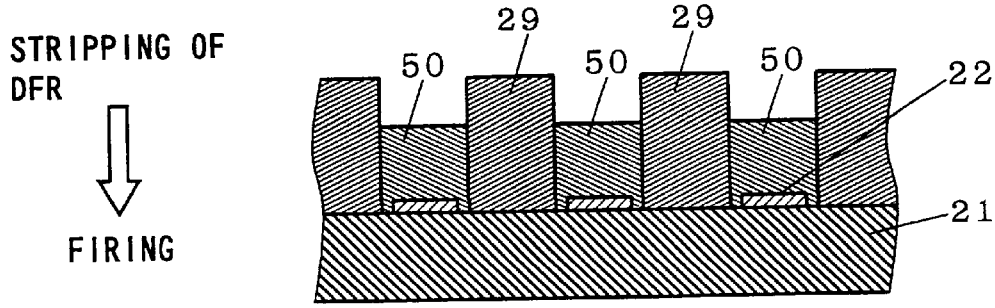
Figure 60:
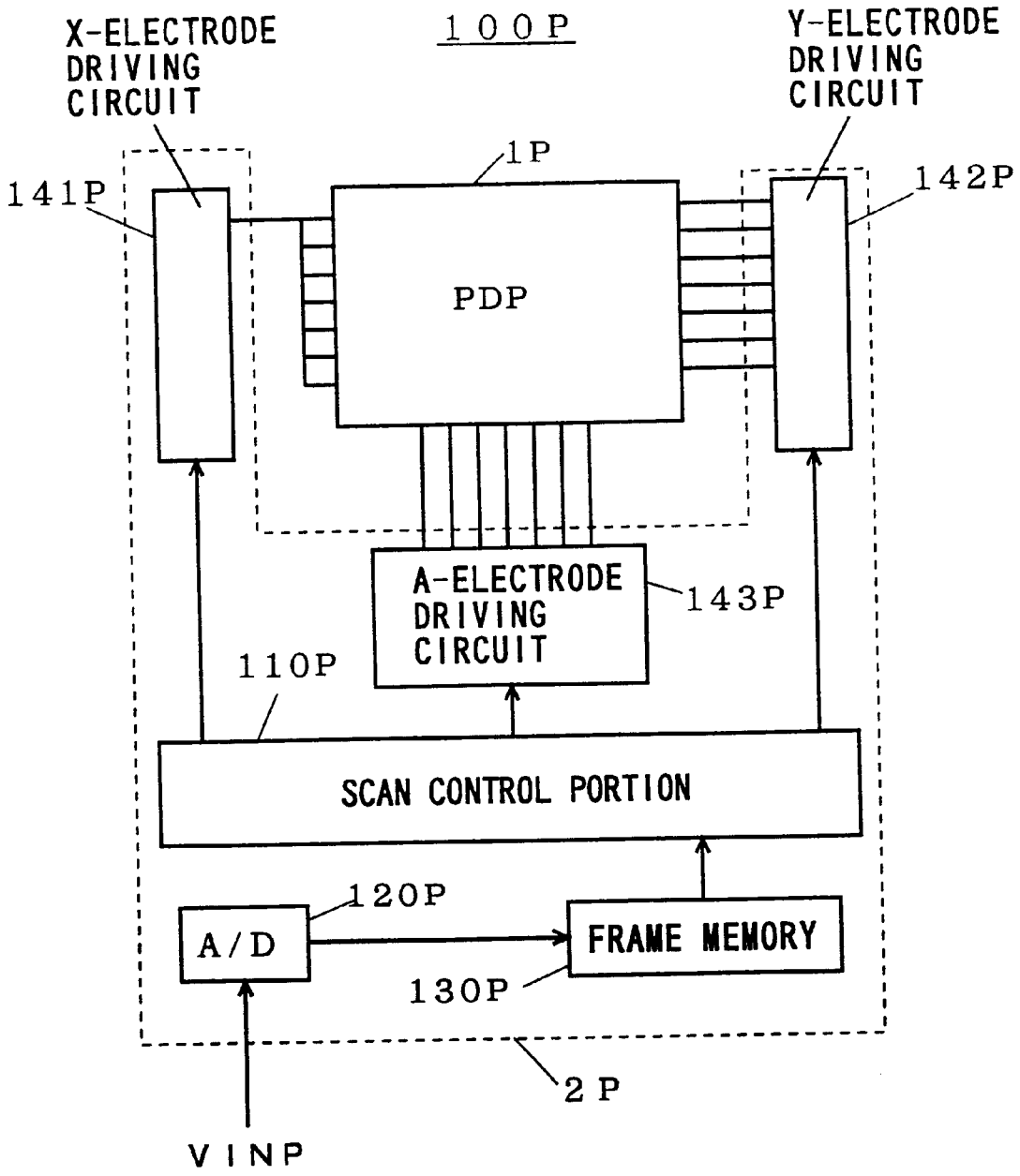
FIG. 60 (PRIOR ART)
FIG. 60 is a block diagram showing an overall structure of a surface discharge type plasma display device according to the conventional technique.

First, a first dot-matrix DFR is formed. As shown in FIG. 54, a first photosensitive film 700 (member of mask) of uniform thickness (first thickness) is stuck on the whole surface of the second substrate 21, and a first pattern forming mask 701 of a mesh type having mask widths each corresponding to the first and second gaps is arranged on the surface of the first photosensitive film 700. The first photosensitive film 700 is irradiated with ultraviolet rays via the first pattern forming mask 701, heated for speeding up of reaction, and further developed with $Na_2CO_3$ solution. After the development, an unnecessary portion of the first photosensitive film 700 (non-sensitized portion) is removed, so that a first dot-matrix DFR 702 with a pattern of the first pattern forming mask 701 transferred thereto is formed as shown in FIG. 55.

Next, a second stripe DFR is formed. A second photosensitive film 703 (member of mask) of uniform thickness (second thickness) is stuck on the surface of the first dot-matrix DFR 702, and a second stripe pattern forming mask 704 (in which a plurality of stripe apertures having widths corresponding to the width of the barrier ribs of the first type 29 are arranged along the second direction at first intervals) is arranged on the surface of the second photosensitive film 703. The second photosensitive film 703 is irradiated with ultraviolet rays via the second pattern forming mask 704 (see FIG. 56), heated for speeding up of reaction, and then developed with $Na_2CO_3$ solution. After the development, an unnecessary portion (non-sensitized portion) of the second photosensitive film 703 is removed, so that each second stripe DFR 705 is formed along the first direction D1 on the corresponding one of the first dot-matrix DFRs 702 which are arranged along the first direction D1 (see FIG. 57).

After the first dot-matrix DFR 702 and the second stripe DFR 705 are formed on the inside surface of the second substrate 21, the low melting point glass paste 29P which contains paraffin or arctic resin or the like, solidifying at 100° C. or less to maintain an outside shape and protect the shape in stripping, is coated on the second substrate 21 with the DFRs 702 and 705 as masks, so as to fill a space surrounded by the DFRs 702 and 705 and the inside surface of the second substrate 21 with the low melting point glass paste 29P. The low melting point glass paste 29 is then dried by the application of heat (see FIG. 58). The height of the low melting point glass paste 29P may be equalized after the application of heat, by polishing the upper surface of the dried low melting point glass paste 29P so as to expose the upper surface of the DFR.

After that, when only the first and second DFRs 702 and 705 are stripped, the reticulated dried low melting point glass paste and the strip one formed thereon remain on the second substrate 21. Then, by firing the residual low melting point glass pastes, the barrier fibs of the first type 29, and the barrier ribs of the second type 50 smaller in height than the barrier ribs of the first type 29 are completed (see FIG. 59). In this case, the sum of the first thickness of the first photosensitive film 700 and the second thickness of the second photosensitive film 703 almost corresponds to the height H of the barrier ribs of the first type.

This method permits forming fine barrier ribs with high formative accuracy, without rounding their edge portions and making large fluctuation in height.

After the barrier ribs of the first and second types 29 and 50 are formed as described above, each phosphor paste is injected into each box-shaped space specified by the first and second side surface portions 29W1 and 29W2 of the adjacent barrier ribs of the first type 29; the third and fourth side surface portions 50W3 and 50W4 of the adjacent barrier ribs of the second type 50; and the inside surface of the second substrate 21 sandwitched between the barrier ribs of the first type 29. Then, the phosphor pastes are dried and heated to thereby adhere the phosphors 28 to the opposite first and second side surface portions 29W1 and 29W2 of the adjacent barrier ribs of the first type 29; the opposite third and fourth side surface portions 50W3 and 50W4 of the adjacent barrier ribs of the second type 50; both of the second top portions 50T of the adjacent barrier ribs of the second type; the inside surface of the second substrate 21 and the upper surface of the A electrode 22 which are sandwitched between the adjacent barrier ribs of the first type 50.

9. Modifications of Method for Forming Barrier Ribs (i) As a modification of the method for forming the barrier ribs 29 and 50, the barrier ribs of the first and second types 29 and 50 may be formed by irradiating a glass paste mixed with ultraviolet-ray hardening resin, with ultraviolet rays via a reticulated mask pattern as shown in FIGS. 39B or 50B.

(ii) Further, the barrier ribs 29 and 50 may be formed by irradiating a glass paste mixed with a thermosetting resin, with heat rays such as laser light via a reticulated mask pattern as shown in FIGS. 39B or 50B.

(iii) Furthermore, while the aforementioned flow charts of the manufacturing processes shown in FIGS. 36 and 47 include the step of determining whether or not the coated low melting point glass paste 29P attains a predetermined thickness, and the step of determining whether or not the dried glass paste 29G is removed to a predetermined depth by the sand blast process, these steps may be omitted by coating the low melting point glass paste 29P for a predetermined number of times or by performing the sand blast process for a predetermined period of time.

While the invention has been described in detail, the foregoing description is in all aspects illustrative and not restrictive. It is understood that numerous other modifications and variations can be devised without departing from the scope of the invention.

We claim:

1. A method of manufacturing a surface discharge type plasma display panel comprising steps of:

(a) providing a second substrate which specifies a plurality of discharge spaces filled with discharge gas along with a first substrate, said second substrate comprising a plurality of address electrodes extending along a second direction;

(b) on said second substrate, at the same time, forming a plurality of barrier ribs of a first type extending in parallel with each other at first intervals along said second direction so that each of said plurality of address electrodes is located between adjacent barrier ribs of the first type out of said plurality of barrier ribs of the first type, and a plurality of barrier ribs of a second type extending in parallel with each other at second intervals along a first direction orthogonal to said second direction so as to intersect with said plurality of barrier ribs of the first type; and (c) adhering phosphors to said second substrate sandwiched between adjacent barrier ribs of the first type out of said plurality of barrier ribs of the first type, a first side surface poriton of one of said adjacent barrier ribs of the first type, and a second side surface portion of the other of said adjacent barrier ribs of the first type facing to said first side surface portion.

2. A method of manufacturing a surface discharge type plasma display panel comprising steps of:

(a) providing a second substrate which specifies a plurality of discharge spaces filled with discharge gas along with a first substrate, said second substrate comprising a plurality of address electrodes extending along a second direction;

(b) on said second substrate, forming a plurality of barrier ribs of a first type extending in parallel with each other at first intervals along said second direction so that each of said plurality of address electrodes is located between adjacent barrier ribs of the first type out of said plurality of barrier ribs of the first type, and a plurality of barrier ribs of a second type extending in parallel with each other at second intervals along a first direction orthogonal to said second direction so as to intersect with said plurality of barrier ribs of the first type; and (c) adhering phosphors to said second substrate sandwiched between adjacent barrier ribs of the first type out of said plurality of barrier ribs of the first type, a first side surface portion of one of said adjacent barrier ribs of the first type, and a second side surface portion of the other of said adjacent barrier ribs of the first type facing to said first side surface portion, wherein said step (a) comprises a step of:

(a-1) preparing a member utilized when a mask is generated, said mask comprising a reticulated pattern specified by said first and second intervals; and in said step (b), said mask is made from said member, and said plurality of barrier ribs of the first type and said plurality of barrier ribs of the second type are formed at the same time on the basis of said mask.

3. The method of manufacturing a surface discharge type plasma display panel according to claim 2, wherein step (b) includes forming a glass layer on said second substrate, forming a photo-sensitive pattern on said glass layer, and removing portions of said glass layer according to said photo-sensitive pattern.

4. The method of manufacturing a surface discharge type plasma display panel according to claim 3, wherein said step of removing portions of said glass layer includes using sand-blasting.

5. The method of manufacturing a surface discharge type plasma display panel according to claim 3, wherein said step of forming a photo-sensitive pattern includes forming two photo-sensitive mask portions having different thicknesses.

6. The method of manufacturing a surface discharge type plasma display panel according to claim 2, wherein step (b) includes forming a first photo-sensitive pattern on said second substrate, forming a second photo-sensitive pattern on said first photo-sensitive pattern, and forming a glass layer on said second photo-sensitive pattern.

7. The method according to claim 2, wherein the step (a-1) further comprises steps of: (a-1-2) preparing a glass paste; and (a-1-3) preparing a predetermined photosensitive film as the member, and the step (b) comprises steps of: (b-1) forming the glass paste of a predetermined thickness on the whole surface of the second substrate; and (b-2) sticking the photosensitive film on the surface of the glass paste to form a dry film resist comprising the reticulated pattern as the mask by lithography method, and continuing to bore a hole in the glass paste by sand blast method from an exposed surface of the glass paste through a reticulated aperture of the dry film resist until the hole reaches the second substrate.

8. The method according to claim 7, wherein the dry film resist comprises a first mask portion of a first mask width extending along the second direction, and a second mask portion of a second mask width extending along the first direction so as to be orthogonal to the first mask portion, the first mask width is not less than the second mask width; and the first and second mask widths are set on the basis of the first and second intervals, respectively.

9. The method according to claim 2, wherein the step (a) further comprises steps of: (a-2) preparing a glass paste: and (a-3) preparing a photosensitive film of a predetermined thickness as the member, and the step (b) comprises steps of: (b-1) sticking the photosensitive film on the whole surface of the second substrate; (b-2) transferring the reticulated pattern to the photosensitive film by arranging a first mask comprising the reticulated pattern specified by the first and second intervals on the surface of the photosensitive film and by irradiating the photosensitive film with a predetermined light through the first mask to thereby expose the photosensitive film, and then developing the photosensitive film; and (b-3) coating the glass paste on the second substrate by using the photosensitive film with reticulated pattern transferred as the mask, drying the glass paste, and then stripping the photosensitive film.

10. The method according to claim 2, wherein the step (a-1) comprises a step of preparing a first mask having mask widths each corresponding to the first and second intervals, and a second mask with a plurality of apertures extending along the first direction and having a width corresponding to the first intervals which are arranged at intervals corresponding to the width of the barrier ribs of the first type, the step (a) further comprises steps of: (a-2) preparing a glass paste; and (a-3) preparing a first photosensitive film of a first thickness and a second photosensitive film of a second thickness as the member, and the step (b) comprises steps of: (b-1) sticking the first photosensitive film on the while surface of the second substrate; (b-2) transferring a pattern of the first mask corresponding to the reticulated pattern to the first photosensitive film by arranging the first mask on the surface of the first photosensitive film and by irradiating the first photosensitive film with a predetermined light through the first mask to thereby expose the first photosensitive film, and then developing the first photosensitive film; (b-3) sticking the second photosensitive film on the surface of the developed first photosensitive film; (b-4) transferring a pattern of the second mask to the second photosensitive film by arranging the second mask on the surface of the second photosensitive film and by irradiating the second photosensitive film with the predetermined light through the second mask to thereby expose the second photosensitive film, and then developing the second photosensitive film; and (b-5) drying the glass paste after coating the glass paste on the second substrate by using the first and second photosensitive films remaining after the step (b-4) as the mask, and then stripping the first and second photosensitive films, wherein the sum of the first thickness and the second thickness corresponds to the height of the barrier ribs of the first type from the second substrate.

11. A method of manufacturing a surface discharge type plasma display panel comprising steps of:

providing a first substrate and a second substrate which specifies a plurality of discharge spaces filled with discharge gas along with said first substrate;

forming on said second substrate a plurality of barrier ribs of a first type extending in parallel with each other at first intervals along said second direction and a plurality of barrier ribs of a second type extending in parallel with each other at second intervals along a first direction orthogonal to said second direction so as to intersect with said plurality of barrier ribs of the first type;

adhering phosphors to said second substrate sandwiched between adjacent barrier ribs of the first type; and providing a mask, wherein said mask comprises a reticulated pattern specified by said first and second intervals, and wherein said plurality of barrier ribs of the first type and said plurality of barrier ribs of the second type are formed at the same time on the basis of said mask.

12. A method of manufacturing a surface discharge type plasma display panel comprising steps of:

(a) providing a second substrate which specifies a plurality of discharge spaces filled with discharge gas along with said first substrate, said second substrate comprising a plurality of address electrodes extending along a second direction;

(b) on said second substrate, forming a plurality of barrier ribs of a first type extending in parallel with each other at first intervals along said second direction so that each of said plurality of address electrodes is located between adjacent barrier ribs of the first type out of said plurality of barrier ribs of the first type, and a plurality of barrier ribs of a second type extending in parrallel with each other at second intervals along a first direction orthogonal to said second direction so as to intersect with said plurality of barrier ribs of the first type; and (c) adhering phosphors to said second substrate sandwiched between adjacent barrier ribs of the first type out of said plurality of barrier ribs of the first type, a first side surface portion of one of said adjacent barrier ribs of the first type, and a second side surface portion of the other of said adjacent barrier ribs of the first type facing to said first side surface portion.

* * * * *

UNITED STATES PATENT AND TRADEMARK OFFICE

CERTIFICATE OF CORRECTION

PATENT NO. : 6,638,129 B2
DATED : October 28, 2003
INVENTOR(S) : Ko Sano et al.

It is certified that error appears in the above-identified patent and that said Letters Patent is hereby corrected as shown below:

Column 7,
Line 23, change “sandwitched” to -- sandwiched --.

Column 9,
Line 6, change “sandwitched” to -- sandwiched --.

Column 22,
Lines 44, 46, 56 and 65, change “sandwitched” to -- sandwiched --.

Column 41,
Line 1, change “sandwitched” to -- sandwiched --.

Column 42,
Line 40, change “sandwitched” to -- sandwiched --.

Column 43,
Lines 30-31, change “sandwitched” to -- sandwiched --.

Column 45,
Lines 53 and 62, change “sandwitched” to -- sandwiched --.

Column 46,
Line 26, change “poriton” to -- portion --.

Column 50,
Line 1, change “parrellel” to -- parallel --.

Signed and Sealed this

Thirty-first Day of August, 2004

JON W. DUDAS
*Director of the United States Patent and Trademark Office*